US009677393B2

(12) United States Patent
Morris

(10) Patent No.: US 9,677,393 B2
(45) Date of Patent: Jun. 13, 2017

(54) METHOD FOR PERFORMING A STIMULATION OPERATION WITH PROPPANT PLACEMENT AT A WELLSITE

(71) Applicant: SCHLUMBERGER TECHNOLOGY CORPORATION, Sugar Land, TX (US)

(72) Inventor: Joseph P. Morris, Winchester, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/460,654

(22) Filed: Aug. 15, 2014

(65) Prior Publication Data

US 2015/0060058 A1 Mar. 5, 2015

Related U.S. Application Data

(60) Provisional application No. 61/870,901, filed on Aug. 28, 2013.

(51) Int. Cl.
*E21B 43/267* (2006.01)
*E21B 43/26* (2006.01)

(52) U.S. Cl.
CPC ..... *E21B 43/267* (2013.01); *E21B 43/26* (2013.01)

(58) Field of Classification Search
CPC ..... C09K 8/68; C09K 2208/30; C09K 8/80; C09K 8/62; E21B 43/267; E21B 43/26; E21B 43/17
See application file for complete search history.

(56) References Cited

U.S. PATENT DOCUMENTS 4,828,028 A 5/1989 Soliman
6,101,447 A 8/2000 Poe
(Continued)

FOREIGN PATENT DOCUMENTS

CN 102174883 A 9/2011
WO 2004009956 A1 1/2004
(Continued)

OTHER PUBLICATIONS

Alves, et al., "A convergent and universally bounded interpolation scheme for the treatment of advection", International Journal for Numerical Methods in Fluids, vol. 41, 2003, pp. 47-75.
(Continued)

*Primary Examiner* — Zakiya W Bates
(74) *Attorney, Agent, or Firm* — Michael L. Flynn; Jody Lynn DeStefanis; Robin Nava

(57) ABSTRACT

A method of performing a stimulation operation at a wellsite is provided. The wellsite has a wellbore penetrating a formation having fractures therein. The method involves predicting placement of proppant parameters in the fractures based on wellsite data, generating an asperity model based on the predicted placement, predicting aperture change for a prescribed closure stress using the asperity model, and determining fracture conductivity based on the predicted aperture change. The method also involves placing into the fractures with a stimulation fluid by injecting the stimulation fluid having the proppant therein into the formation based on the determined fracture conductivity and producing fluid from the reservoirs and into the wellbore through the propped fractures.

24 Claims, 27 Drawing Sheets

(56) References Cited

U.S. PATENT DOCUMENTS

| | | | |
|---|---|---|---|
| 6,776,235 | B1 | 8/2004 | England |
| 7,363,162 | B2 | 4/2008 | Thambynayagam et al. |
| 7,451,812 | B2 | 11/2008 | Cooper et al. |
| 7,581,590 | B2 | 9/2009 | Lesko et al. |
| 7,788,074 | B2 | 8/2010 | Scheidt et al. |
| 8,066,068 | B2 | 11/2011 | Lesko et al. |
| 8,412,500 | B2 | 4/2013 | Weng et al. |
| 8,490,700 | B2 | 7/2013 | Lesko et al. |
| 8,584,755 | B2 | 11/2013 | Willberg et al. |
| 2005/0203725 | A1 | 9/2005 | Jenny et al. |
| 2008/0068645 | A1 | 3/2008 | Nakano |
| 2008/0133186 | A1 | 6/2008 | Li et al. |
| 2010/0138196 | A1 | 6/2010 | Hui et al. |
| 2010/0250215 | A1 | 9/2010 | Kennon et al. |
| 2012/0156787 | A1* | 6/2012 | Abass ..... E21B 43/26 436/2 |
| 2012/0179444 | A1 | 7/2012 | Ganguly et al. |
| 2012/0325472 | A1 | 12/2012 | Litvinets et al. |

FOREIGN PATENT DOCUMENTS

| | | | |
|---|---|---|---|
| WO | 2007086771 | A1 | 8/2007 |
| WO | 2008075242 | A | 6/2008 |

OTHER PUBLICATIONS

Ameli, et al., "Fracture Permeability Alteration due to Chemical and Mechanical Processes: A Coupled High-Resolution Model", Rock Mechanics and Rock Engineering, vol. 47, Issue 5, Sep. 2014, pp. 1563-1573.

Bittleston, et al., "Mud removal and cement placement during primary cementing of an oil well", Journal of Engineering Mathematics, vol. 43, 2002, pp. 229-253.

Brown, et al., "Closure of random elastic surfaces in contact", Journal of Geophysical Research: Solid Earth and Planets, vol. 90, Issue B7, Jun. 10, 1985, pp. 5531-5545.

Detwiler, et al., "Experimental observations of fracture dissolution: The role of Peclet number on evolving aperture variability", Geophysical Research Letters, vol. 30, No. 12, 2003, 4 pages.

Ejofodomi, et al., "Application of Channel Fracturing in the Vaca Muerta Shale Formation", SPE-169383-MS SPE Latin America and Caribbean Petroleum Engineering Conference, Maracaibo, Venezuela, May 21-23, 2014, 9 pages.

Founargiotakis, "Laminar, transitional and turbulent flow of Herchel-Bulkley fluids in concentric annulus", The Candadian Journal of Chemical Engineering, vol. 86, 2008, pp. 676-683.

Greenwood, et al., "Contact of Nominally Flat Surfaces", Proceedings of the Royal Society A: Mathematical, Physical & Engineering Sciences, vol. 295, No. 1442, Dec. 6, 1966, pp. 300-319.

Grinchik, et al., "Axial flow of a nonlinear viscoplastic fluid through cylindrical pipes", Journal of Engineering Physics, vol. 23, No. 2, 1974, pp. 1039-1041.

Huuse, et al., "Subsurface sediment remobilization and fluid flow in sedimentary basins: an overview", Basin Research, vol. 22, No. 4, 2010, pp. 342-360.

Kothe, et al., "A comparison of interface tracking methods", Proceedings of the 26th American Institute of Aeronautics and Astronautics (AIAA) Computational Fluid Dynamics Conference, San Diego, California, U.S.A., Jun. 19-22, 1995.

Lawal, et al., "Extrusion and lubrication flows of viscoplastic fluids with wall slip", Chemical Engineering Communications, vol. 122, 1993, pp. 127-150.

Medvedev, et al., "On the Mechanisms of Channel Fracturing", SPE 163836—SPE Hydraulic Fracturing Technology Conference, The Woodlands, Texas, Feb. 4-6, 2013, 13 pages.

Metwally, "A Computational Study of Enhanced Laminar Forced Convection Heat Transfer to Newtonian and non-Newtonian Fluid Flows in Sinusoidal Corrugated-Plate Channels", PhD Thesis, Division of Research and Advanced Studies of the University of Cincinnati, 2002.

Monaghan, "Smoothed Particle Hydrodynamics and its diverse applications", Annual Review of Fluid Mechanics, vol. 44, 2012, pp. 323-346.

Montgomery, "Fracturing Fluids", Proceedings of the International Conference for Effective and Sustainable Hydraulic Fracturing (HF2013), InTech, Brisbane, Australia, May 20-22, 2013, pp. 3-24.

Morris, et al., "A switch to reduce SPH viscosity", Journal of Computational Physics, 1997, pp. 41-50.

Morris, et al., "Predicting the Long-term Evolution of Fracture Transport Properties in CO2 Sequestration Systems", ARMA-11-399, 45th U.S. Rock Mechanics and Geomechanics Symposium, San Francisco, California, Jun. 26-29, 2011, pp. ARMA 11-399.

Morris, et al., "Understanding Heterogeneously Propped Hydraulic Fractures Through Combined Fluid Mechanics, Geomechanics, and Statistical Analysis", ARMA-2014-7408, 48th U.S. Rock Mechanics/Geomechanics Symposium, Minneapolis, Minnesota, Jun. 1-4, 2014, pp. 2014-7408.

Murdoch, et al., "Forms and sand transport in shallow hydraulic fractures in residual soil", Canadian Geotechnical Journal, vol. 43, No. 10, 2006, pp. 1061-1073.

Pelipenko, et al., "Visco-plastic fluid displacements in near-vertical eccentric annuli: librication modelling", Journal of Fluid Mechanics, vol. 520, 2004, pp. 343-377.

Pyrak-Nolte, et al., "Single fractures under normal stress: The relation between fracture specific stiffness and fluid flow", International Journal of Rock Mechanics and Mining Sciences, vol. 37, Issues 1-2, Jan. 1, 2000, pp. 245-262.

Sahu, et al., "Linear instability of pressure-driven channel flow of a Newtonian and a Herschel-Bulkley fluid", Physics of Fluids, vol. 19, 2007, p. 122101.

Sussman, et al., "A level set approach for computing solutions to incompressible two-phase flow", Journal of Computational Physics, vol. 114, 1994, pp. 146-159.

Youngs, "An interface tracking method for a 3D Eulerian hydrodynamics code", Aldermaston, Berkshire, U.K.: Technical Report AWRE/44/92/35, 1987.

Dakshinamoorthy et al., "Modeling Proppant Transport in Fractures Using ANSYS", Sep. 8, 2011, Accessed Nov. 23, 2015 at http://support.ansys.com/staticassets/ANSYS/Conference/Houston/downloads/Modeling Proppant Transport in Fractures—Dakshinamoorthy.pdf, 33 pages.

Kamenov, "The Effect of Proppant Size and Concentration on Hydraulic Fracture Conductivity in Shale Reservoirs", May 1, 2013, accessed Nov. 23, 2015 at https://oaktrust.library.tamu.edu/bitstream/handle/1969.1/149386/KAMENOV-THESIS-2013.pdf?sequence=1&isAllowed=y, 92 pages.

Liu, "Settling and Hydrodynamic Retardation of Proppants in Hydraulic Fractures", Aug. 1, 2006, accessed Nov. 23, 2015 at http://www.lib.utexas.edu/etd/d/2006/liuy32924/liuy32924.pdf, 216 pages.

Drazer, et al., "Permeability of self-affine rough fractures", Physical review. E, Statistical physics, plasmas, fluids, and related interdisciplinary topics, Jun. 19, 2000, vol. 62, No. 2, pp. 8076-8085.

Pyrak-Nolte, et al., "Hydraulic and Mechanical Properties of Natural Fractures in Low Permeability Rock", ISRM-6CONGRESS-1987-042, 6th ISRM Congress, Montreal, Canada, Aug. 30-Sep. 3, 1987, pp. 225-231.

Van Der Vorst, et al., "BI-CGSTAB: a fast and smoothly converging variant of BI-CG for the solution of nonsymmetric linear systems", SIAM Journal on Scientific and Statistical Computing archive, vol. 13, Issue 2, Mar. 1992, pp. 631-644.

Yang, et al., "Network modeling of flow in natural fractures", Rock Mechanics as a Guide for Efficient Utilization of natural resources, 1989, pp. 57-64.

Office Action issued in Chinese Patent Application No. 201410649142.0 on Oct. 8, 2016; 23 pages (with English translation).

Al-Fariss, et al., "Flow through porous media of a shear-thinning liquid with yield stress", Canadian Journal of Chemical Engineering, vol. 65, 1987, pp. 391-405.

Bird, et al., "The rheology and flow of viscoplastic materials", Reviews in Chemical Engineering, vol. 1, No. 1, 1983, pp. 1-70.

(56) References Cited

OTHER PUBLICATIONS

Covey, et al., "Use of the parallel-plate plastometer for the characterization of viscous fluids with a yield stress", Journal of Non-Newtonian Fluid Mechanics, vol. 8, 1981, pp. 249-260.
Di Federico, et al., "Bingham fluid flow in spatially variable fractures", Advances in Fluid Mechanics, vol. 5, 2004, pp. 169-177.
Frigaard, et al., "Flow of a visco-plastic fluid in a channel of slowly varying width", Journal of Engineering Mathematics, vol. 43, 2002, pp. 229-253.
Gupta, "On developing laminar Herschel-Bulkley fluid flow", Advances in Fluid Mechanics, vol. 14, 1997, p. 91.
Sahu, et al., "Three-dimensional linear instability in pressure-driven two-layer channel flow of a Newtonian and Herschel-Bulkley fluid", Physics of Fluids, vol. 22, 2010, p. 112103-1 to 14.
Harlow, et al., "The particle-in-cell computing method for fluid dynamics", Journal of Computational Physics, vol. 3, 1964, pp. 319-343.
Hopkins, "The Effect of Surface Roughness on Joint Stiffness, Aperture, and Acoustic Wave Propagation", Ph.D. Thesis, University of California at Berkeley, 1991, 842 pages.
Jung, "Goodbye or Back to the Future", in Effective and Sustainable Hydraulic Fracturing, Proceedings of the International Conference for Effective and Sustainable Hydraulic Fracturing (HF2013), InTech, Brisbane, Australia, May 20-22, 2013, pp. 95-121.
Kern, et al., "The Mechanism of Sand Movement in Fracturing", Transactions of the American Institute of Mining and Metallurgical Engineers, vol. 216, 1959, pp. 403-405.
Mader, et al., "The rheology of two-phase magmas: A review and analysis", Journal of Volcanology and Geothermal Research, vol. 257, 2013, pp. 135-158.
Manga, et al., "Seismic triggering of eruptions in the far field: Volcanoes and geysers", Annual Review of Earth and Planetary Sciences, vol. 34, 2006, pp. 263-291.
Szabo, et al., "Flow of viscoplastic fluids in eccentric annular geometries", Journal of Non-Newtonian Fluid Mechanics, vol. 45, 1992, pp. 149-169.

* cited by examiner

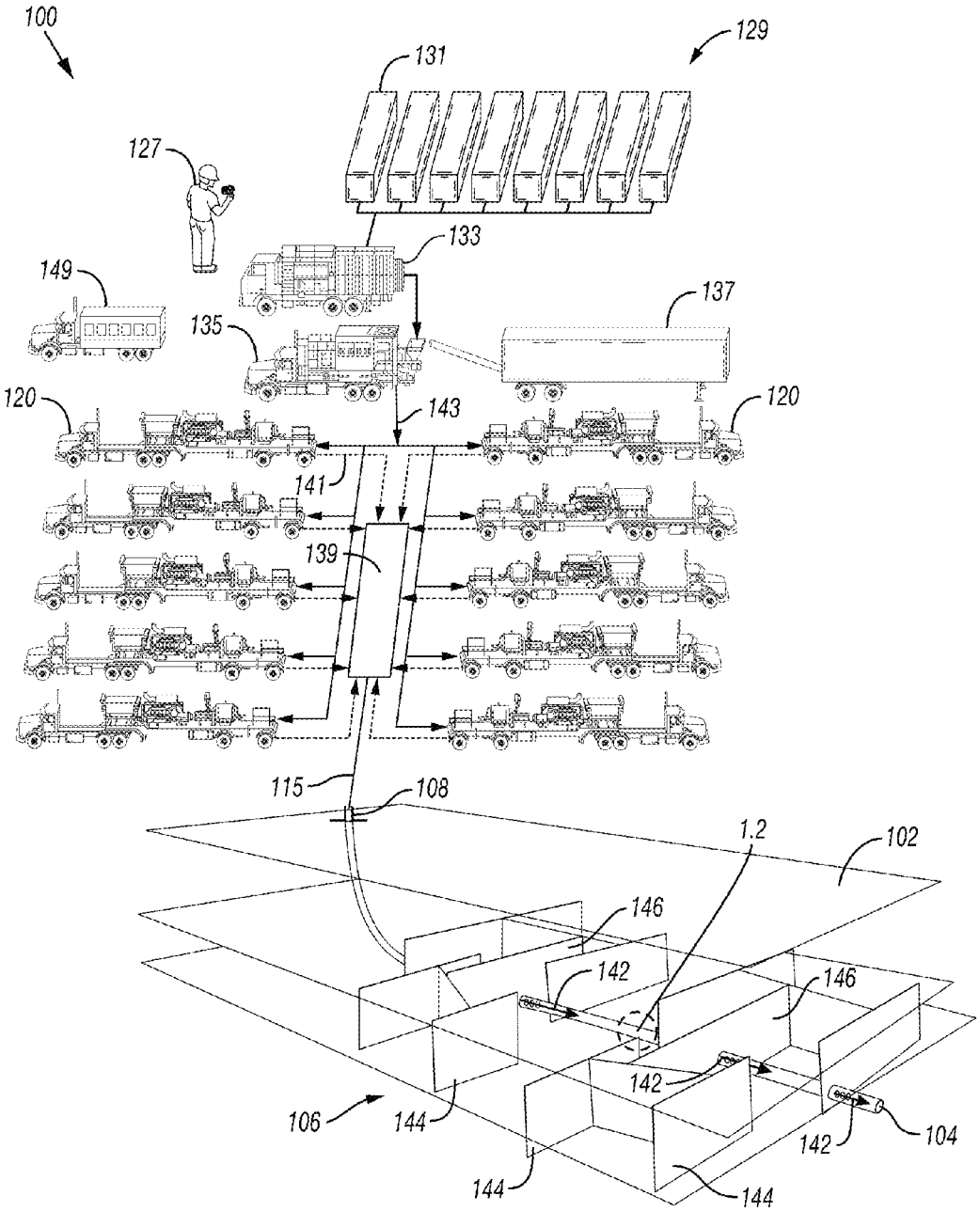
FIG. 1.1

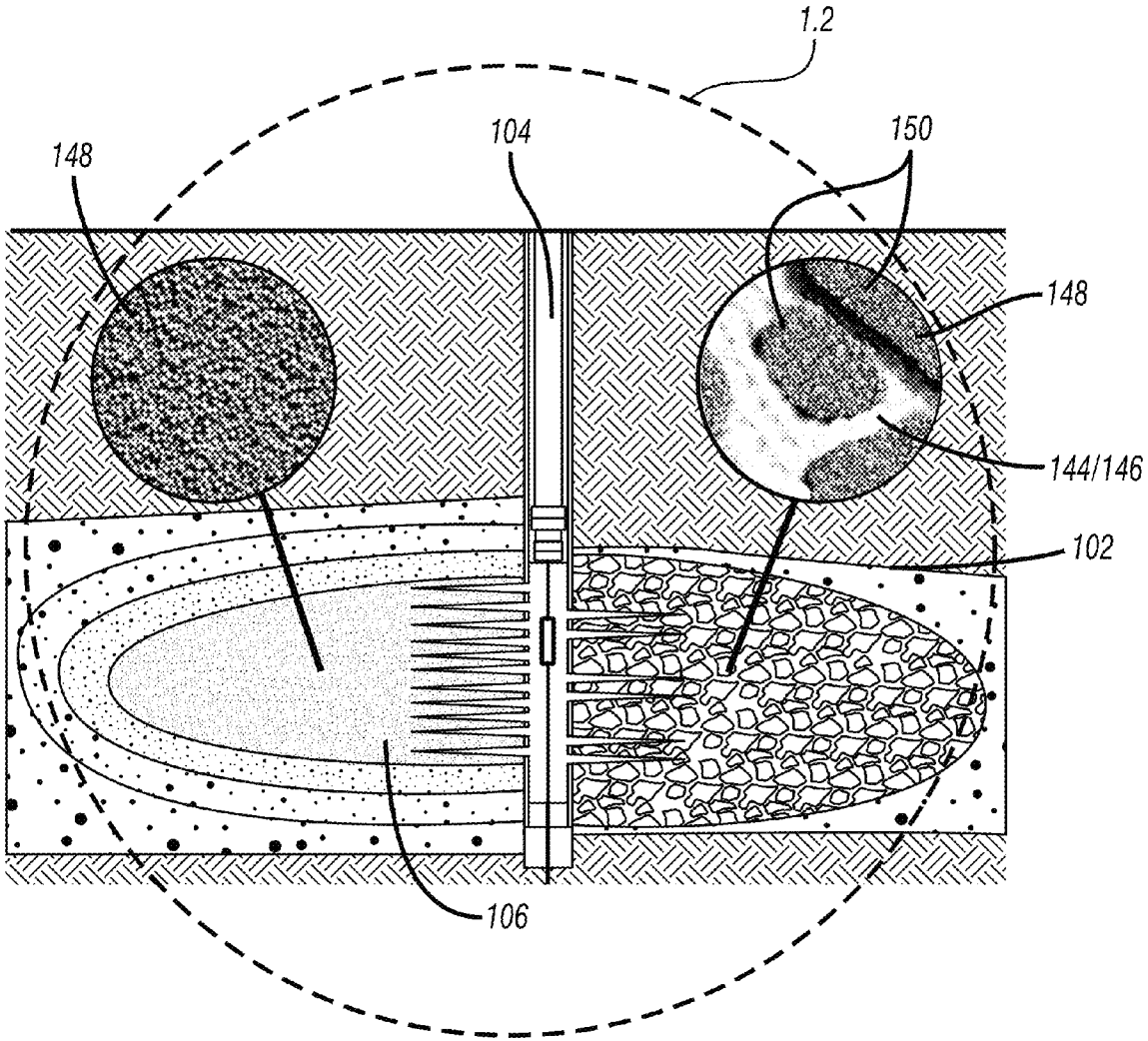
FIG. 1.2

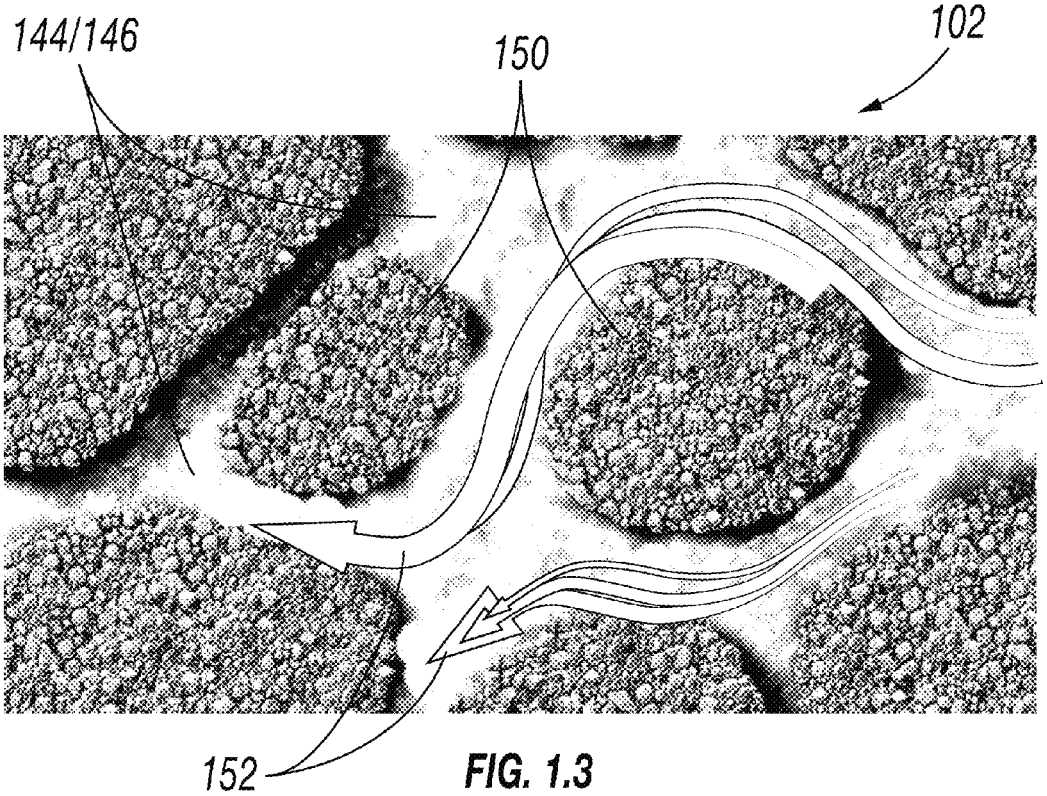
FIG. 1.3
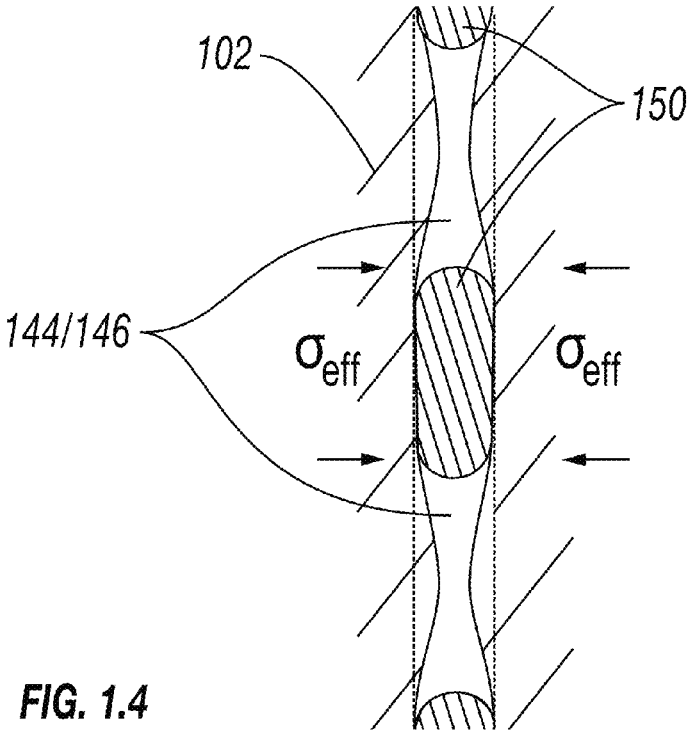
FIG. 1.4

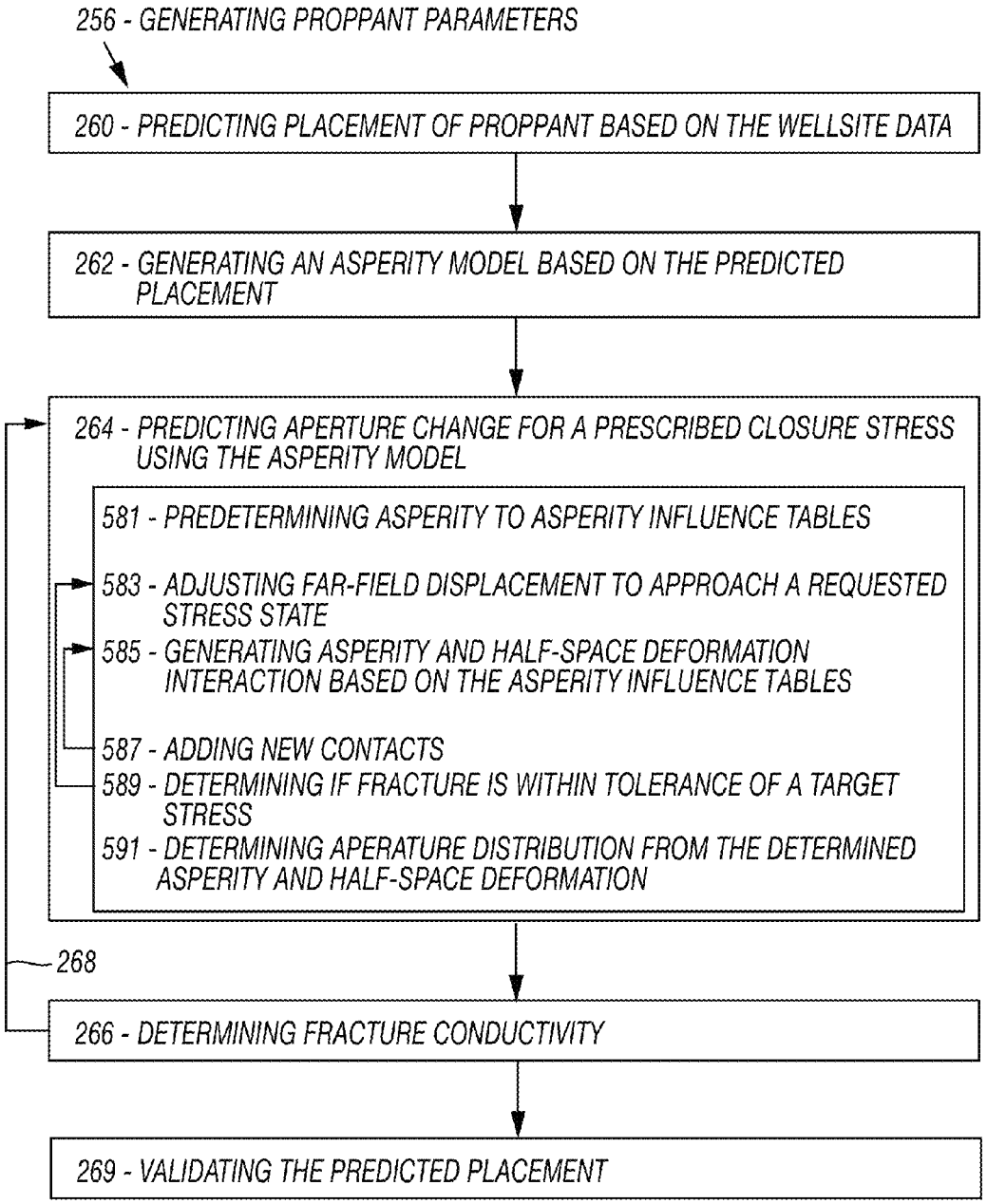
FIG. 5.1

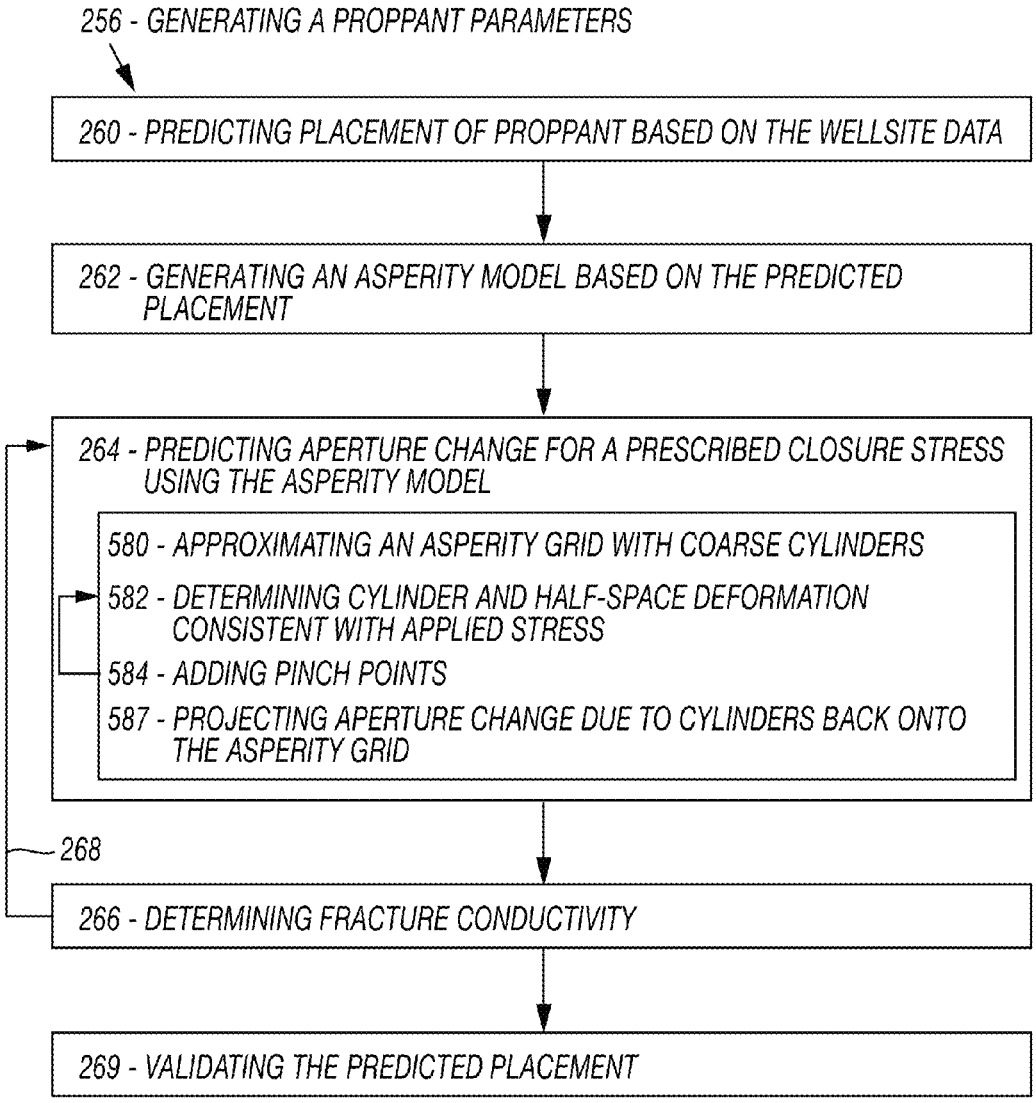
FIG. 5.2

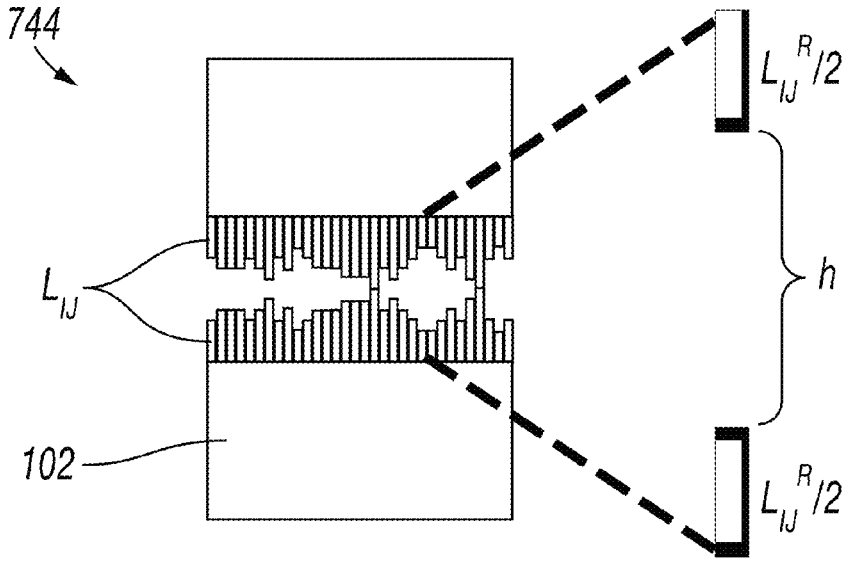
FIG. 7.1
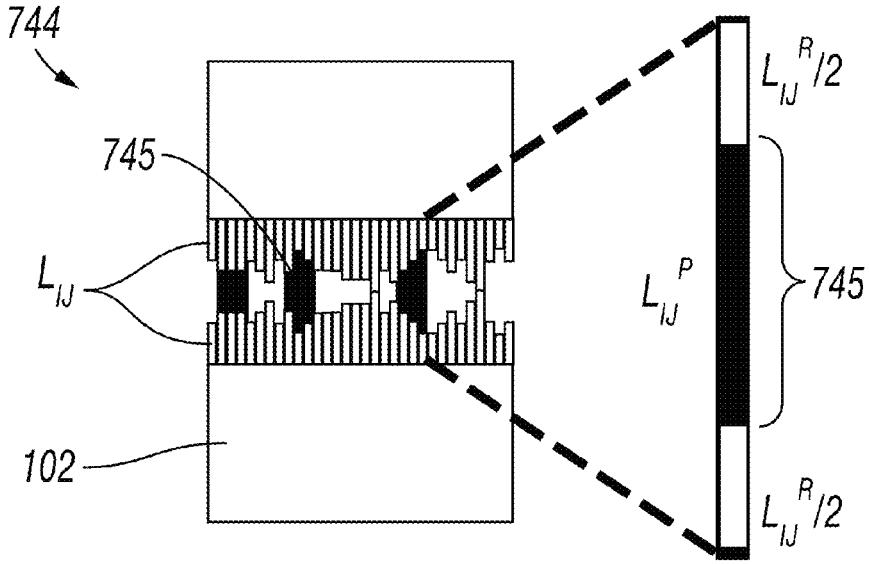
FIG. 7.2

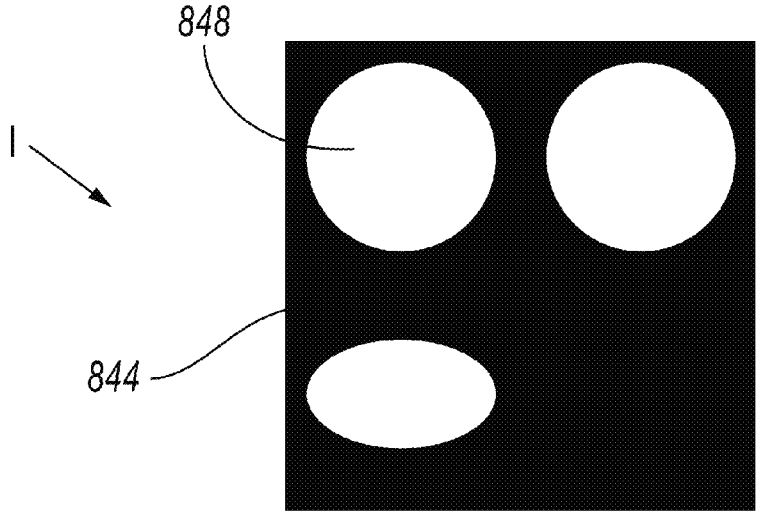
FIG. 8.1
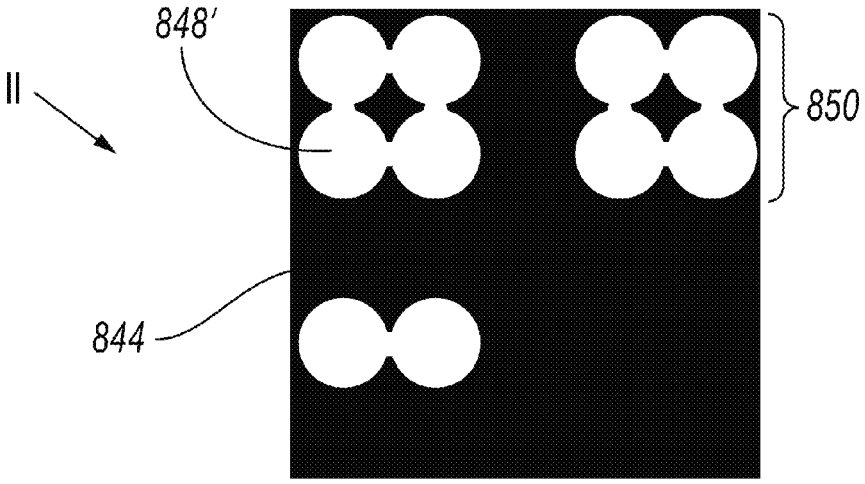
FIG. 8.2
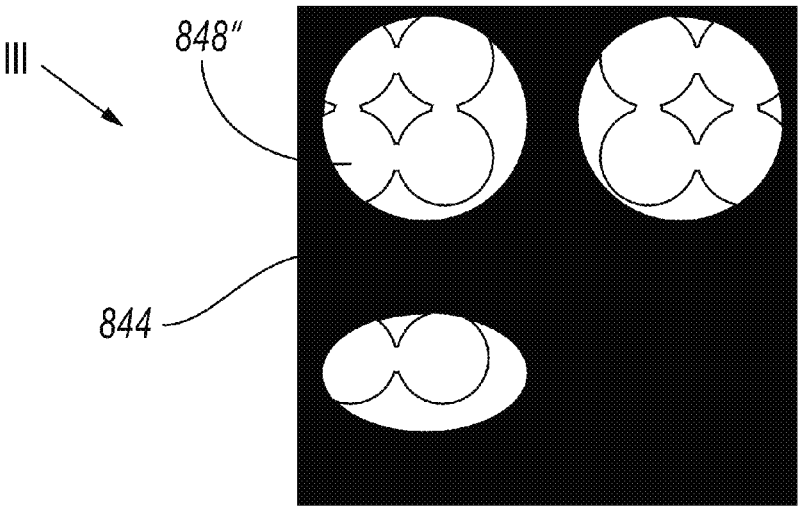
FIG. 8.3

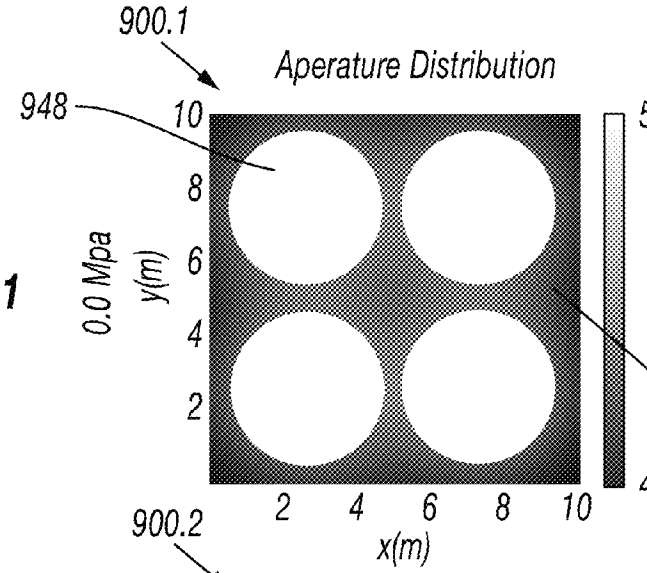
FIG. 9.1
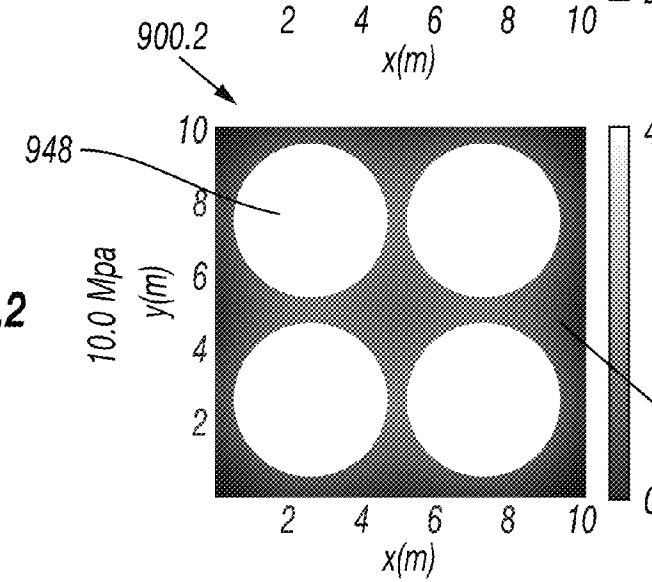
FIG. 9.2
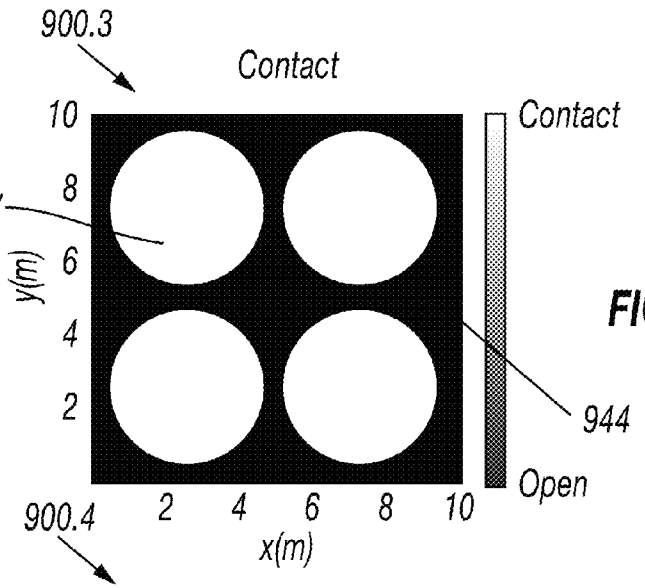
FIG. 9.3
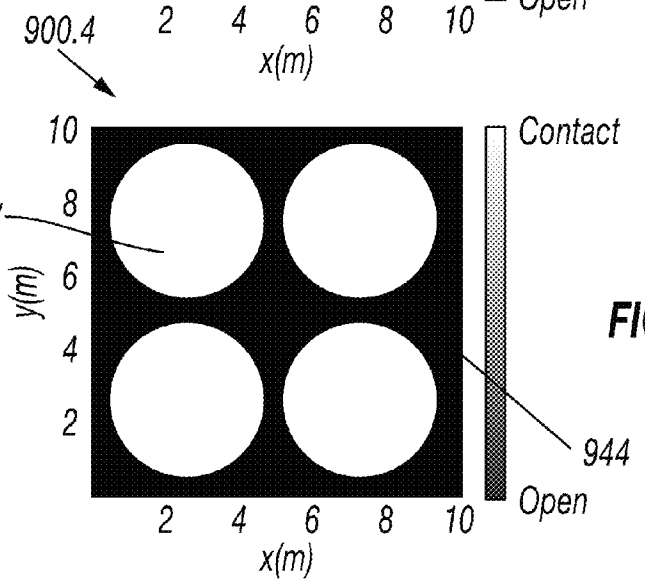
FIG. 9.4

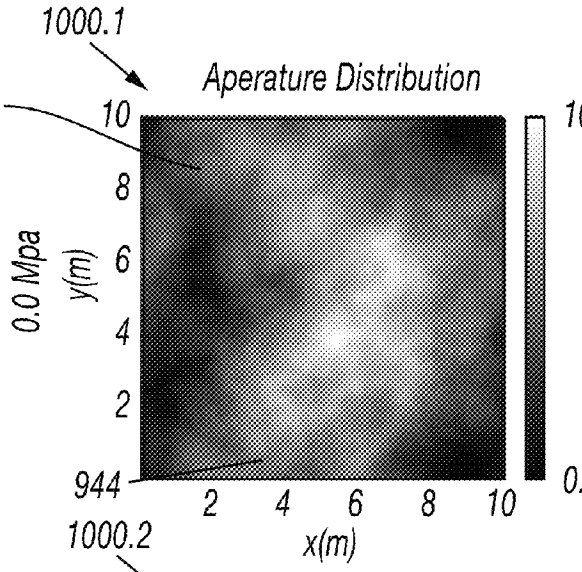
FIG. 10.1
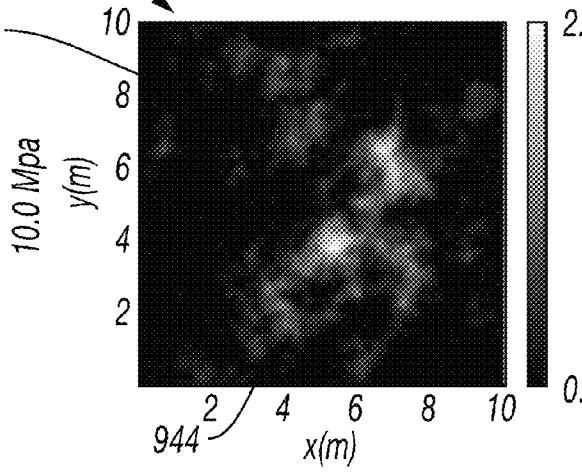
FIG. 10.2
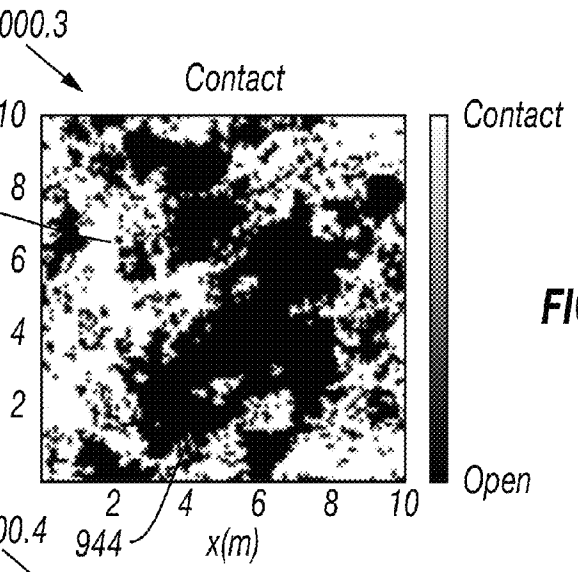
FIG. 10.3
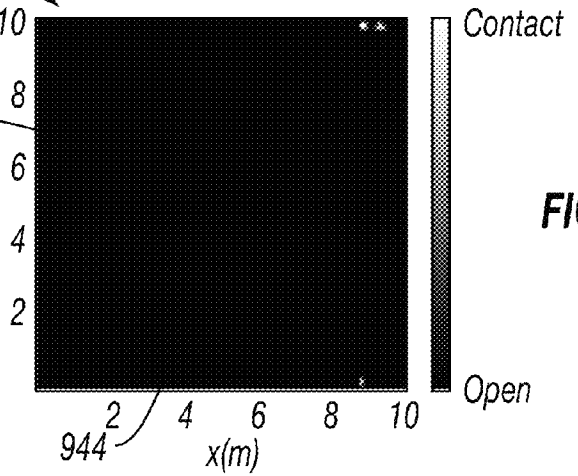
FIG. 10.4

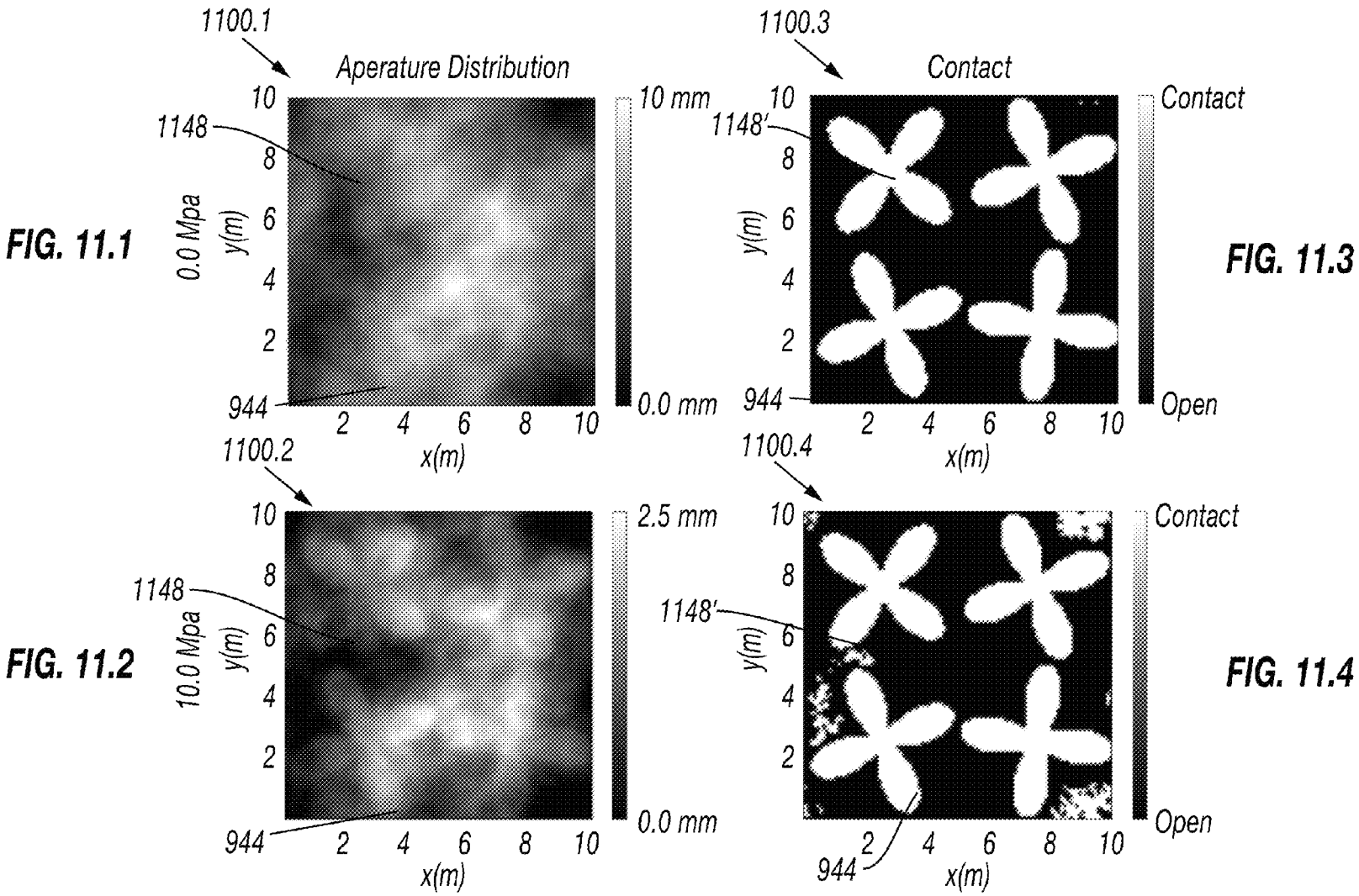
FIG. 11.1
FIG. 11.2
FIG. 11.3
FIG. 11.4

FIG. 12.1
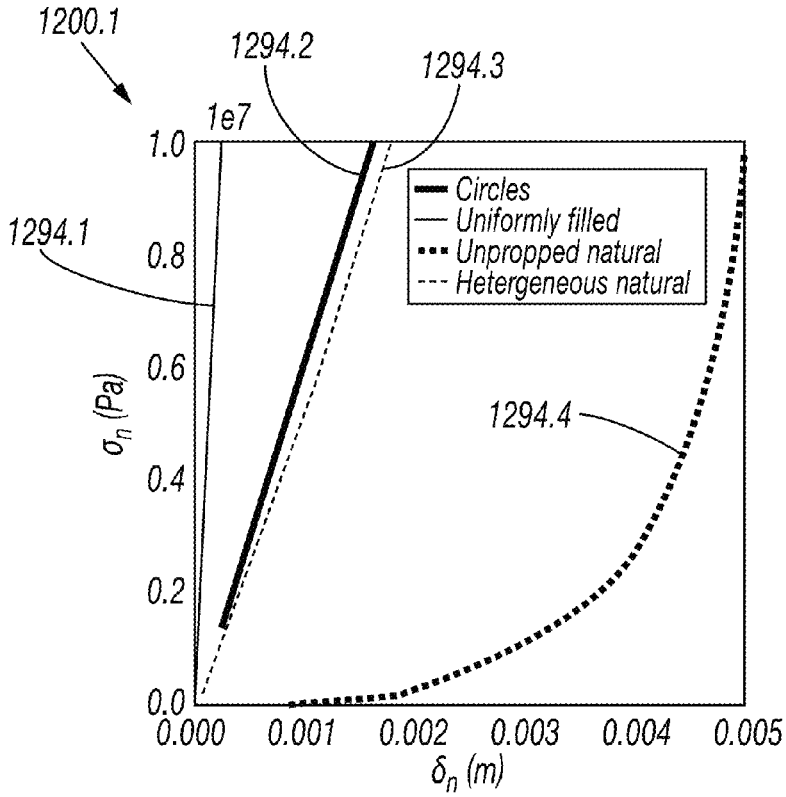
FIG. 12.2
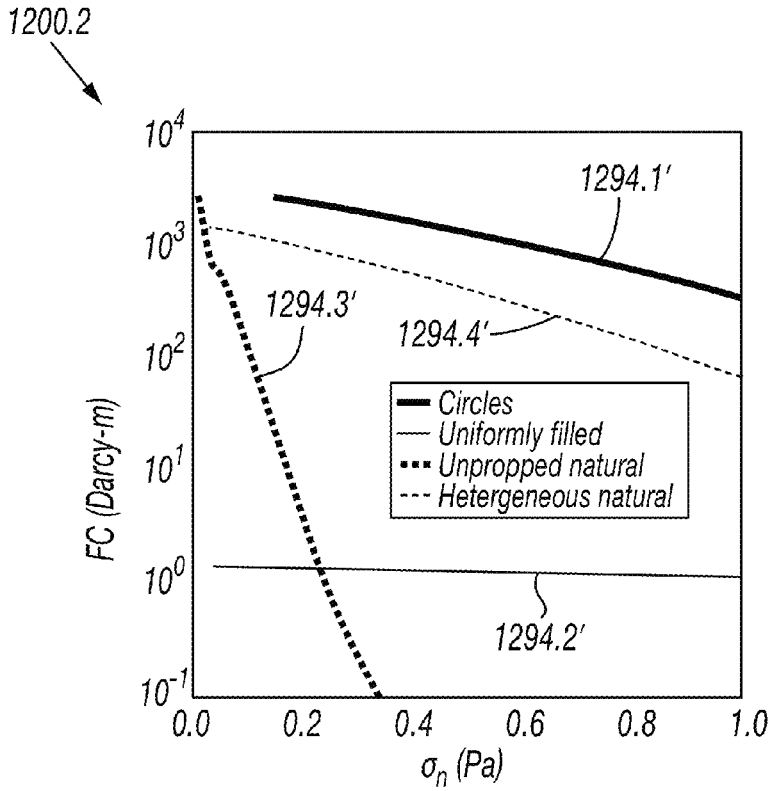

FIG. 16
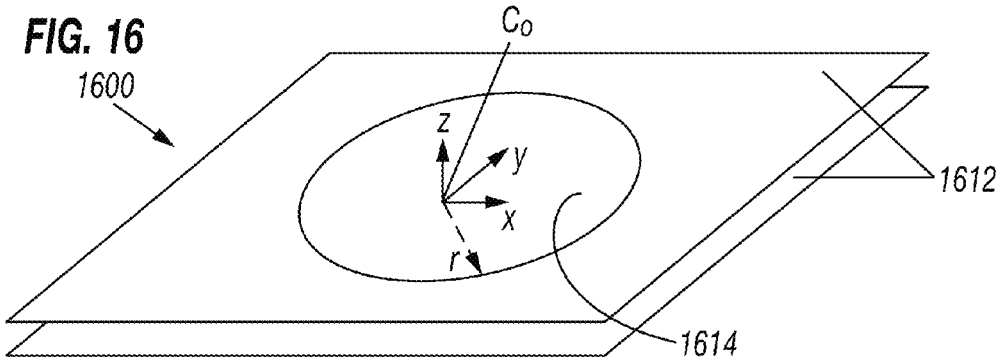
FIG. 17
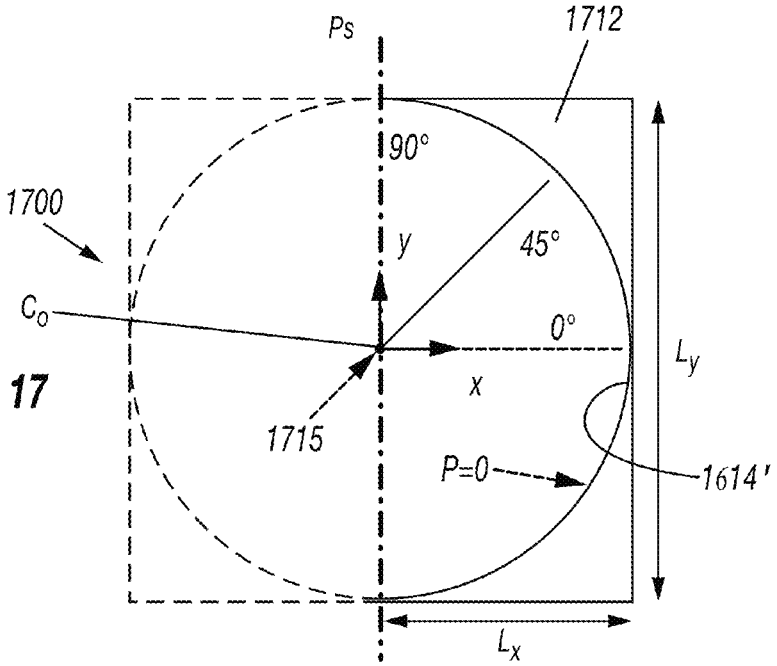
FIG. 18.1 FIG. 18.2 FIG. 18.3
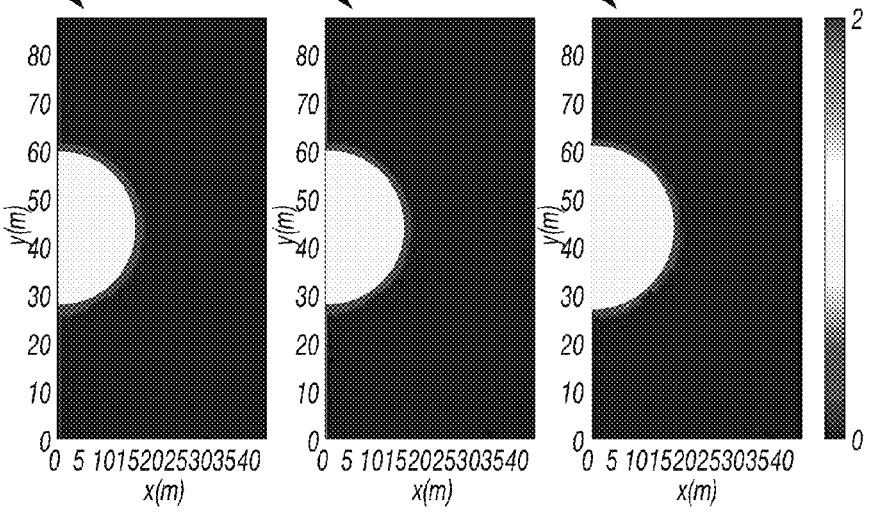

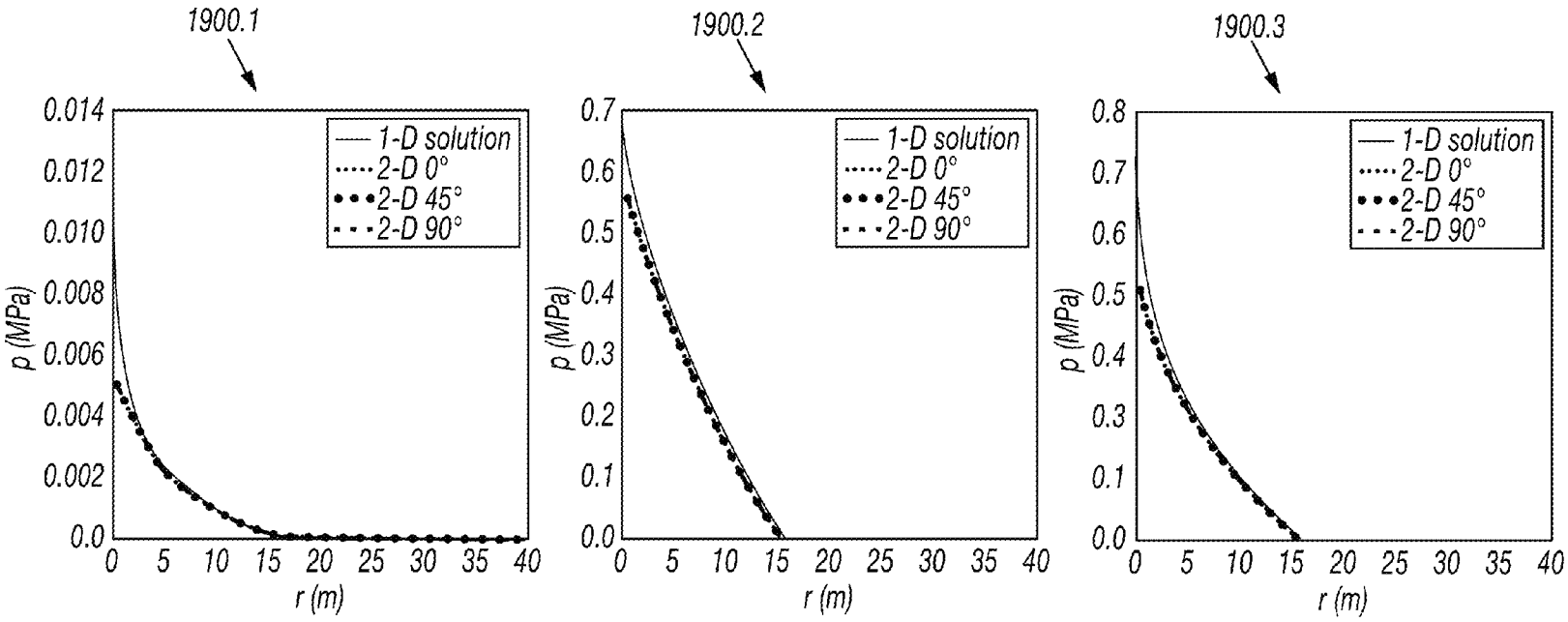
FIG. 19.1
FIG. 19.2
FIG. 19.3

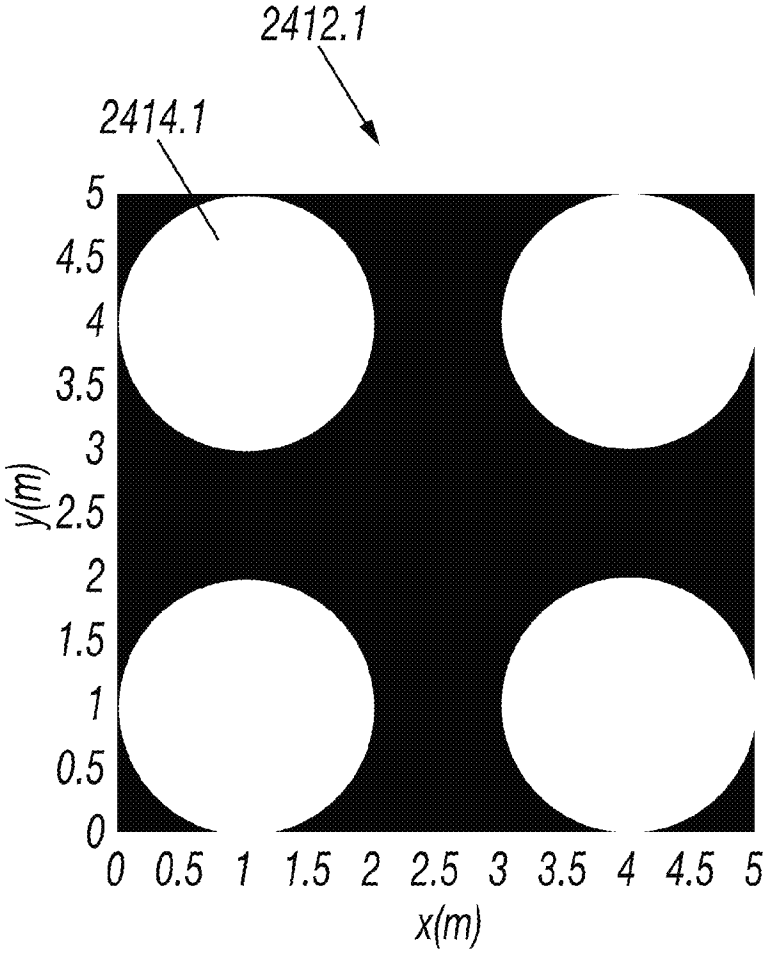
FIG. 24.1
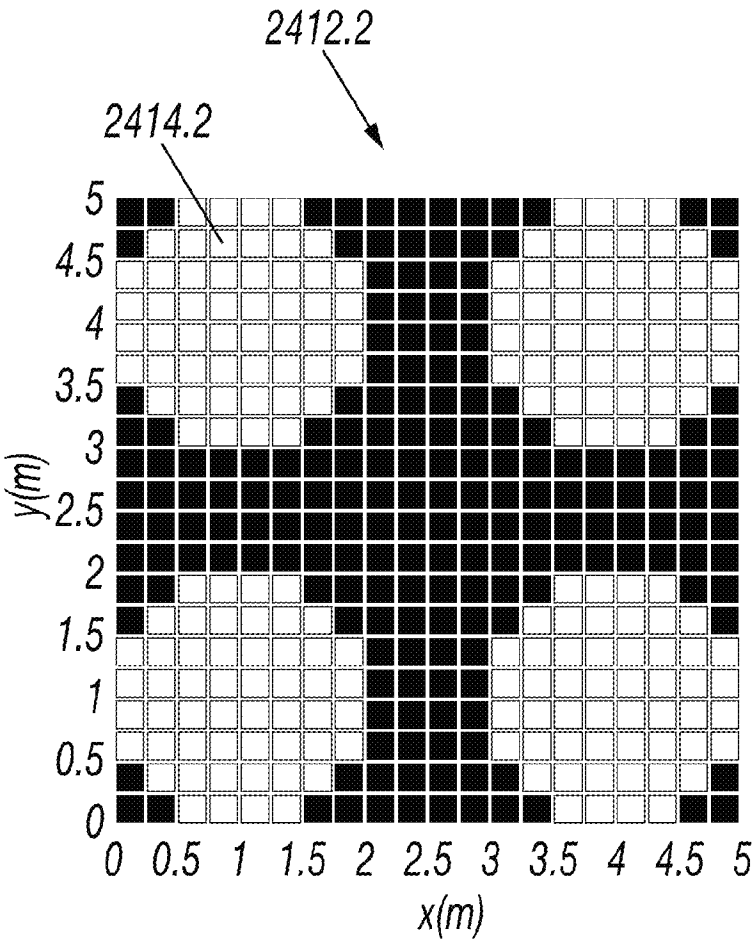
FIG. 24.2

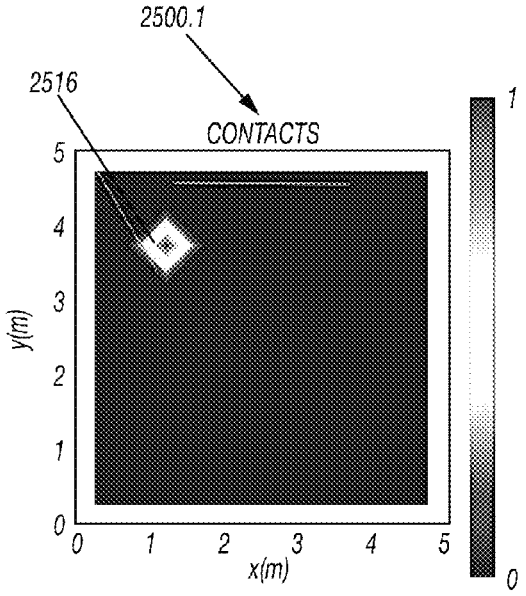
FIG. 25.1
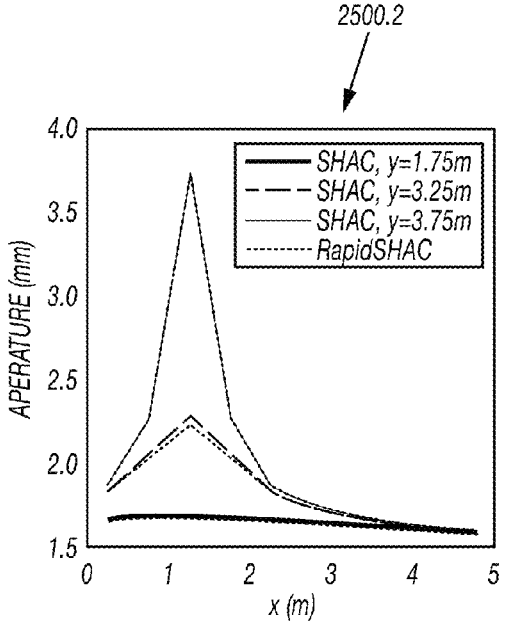
FIG. 25.2
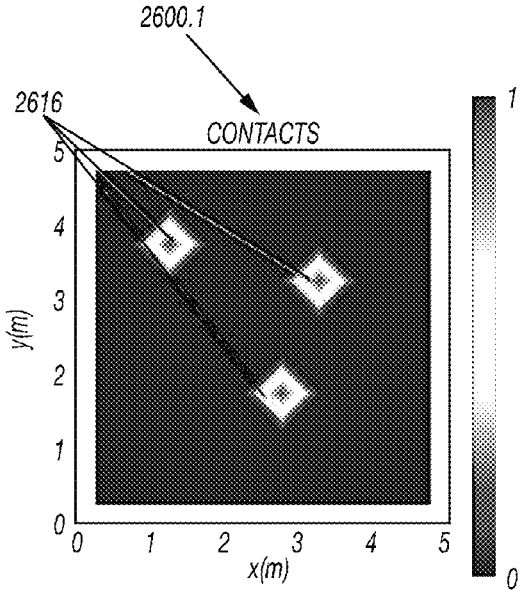
FIG. 26.1
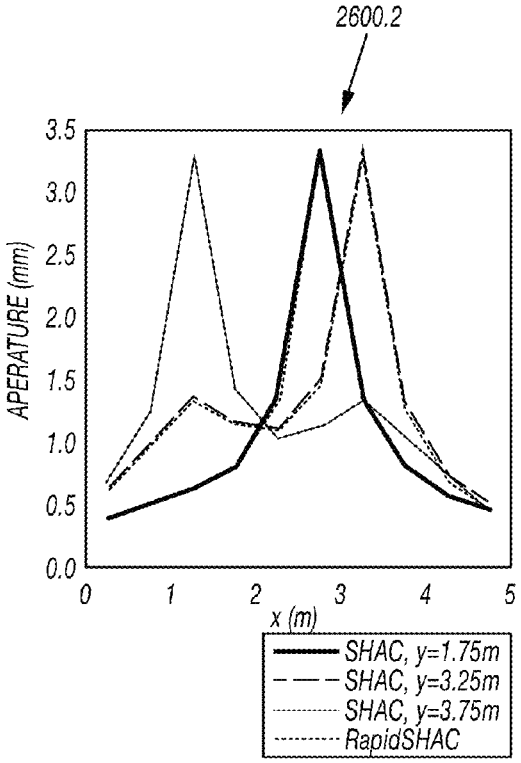
FIG. 26.2

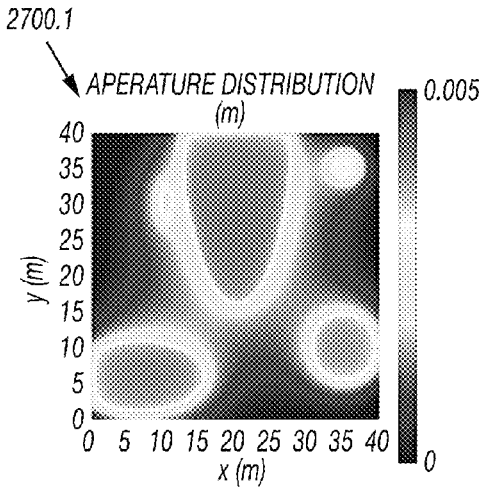
FIG. 27.1
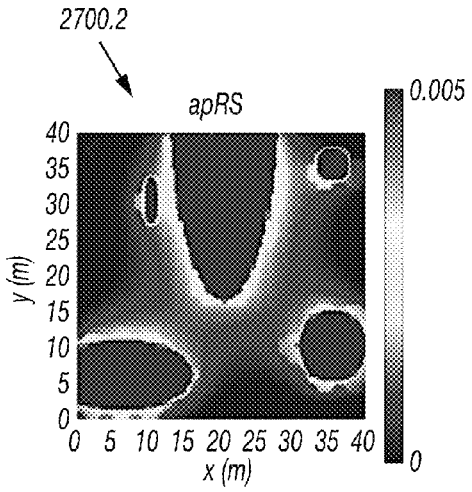
FIG. 27.2
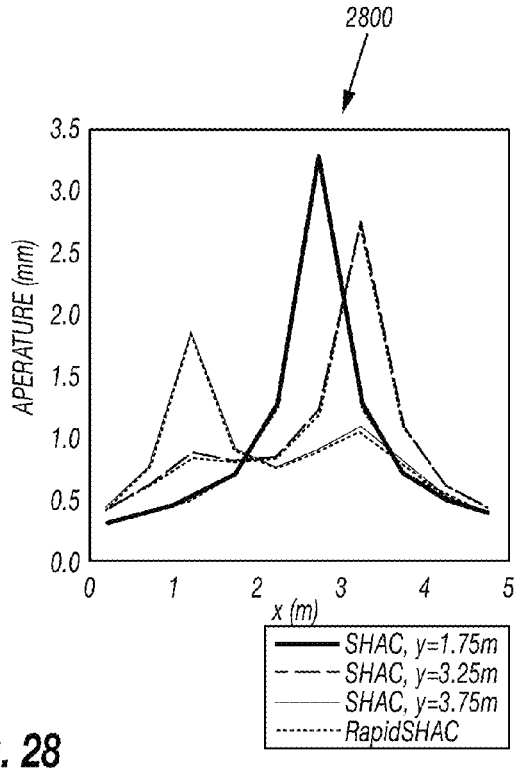
FIG. 28

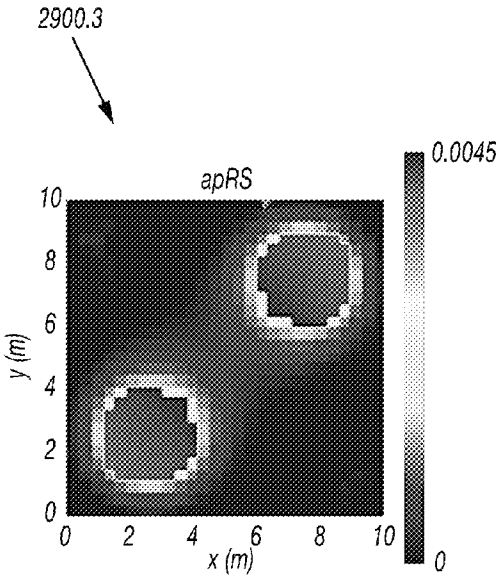
FIG. 29.3
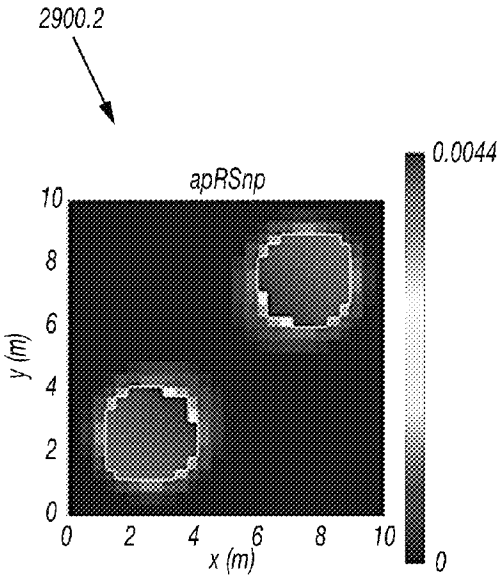
FIG. 29.2
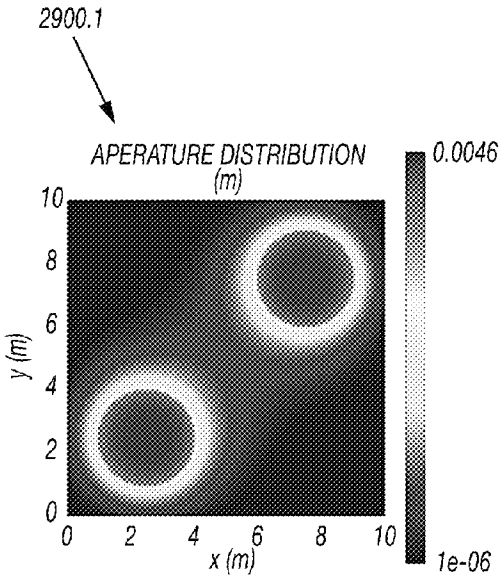
FIG. 29.1

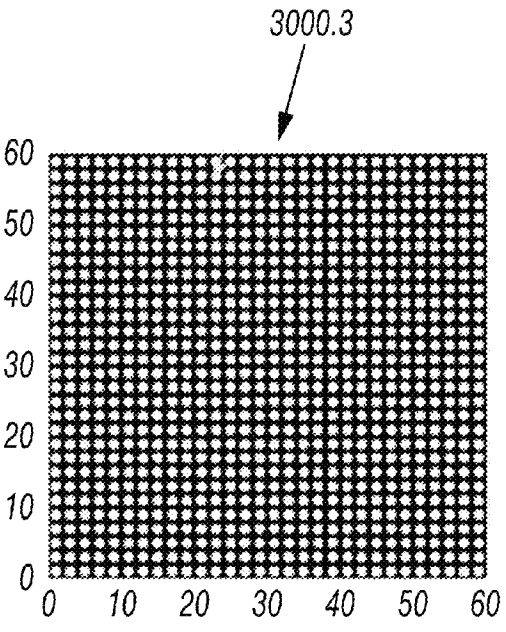
FIG. 30.3
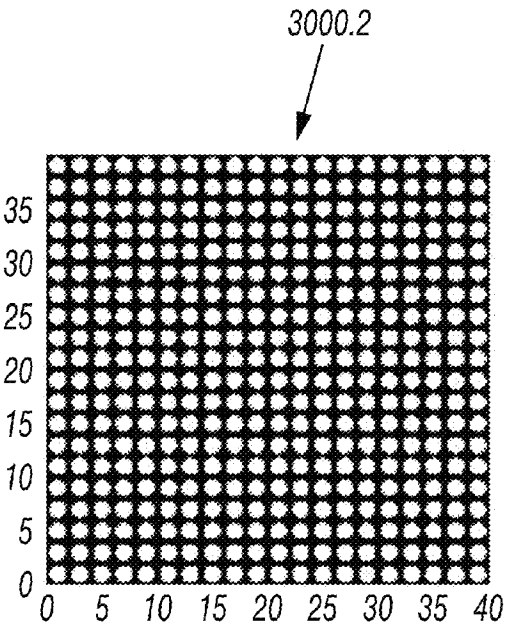
FIG. 30.2
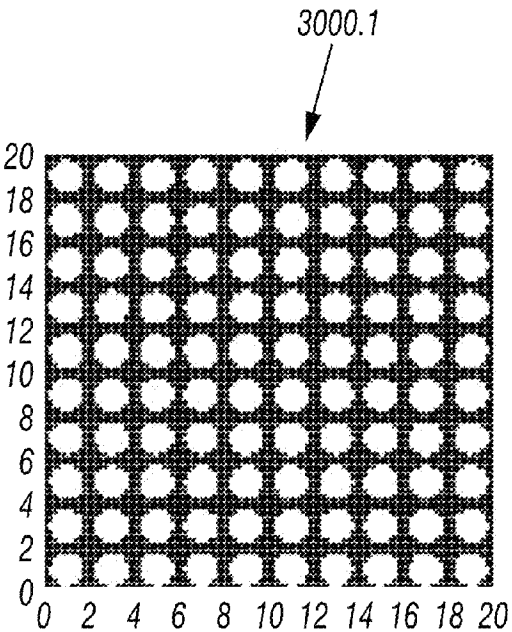
FIG. 30.1

METHOD FOR PERFORMING A STIMULATION OPERATION WITH PROPPANT PLACEMENT AT A WELLSITE

CROSS REFERENCE TO RELATED APPLICATION

This application claims priority to US Provisional Application No. 61/870,901 filed on Aug. 28, 2013, the entire contents of which are hereby incorporated by reference herein.

BACKGROUND

In at least one aspect of the present disclosure, at least one embodiment relates to techniques for performing oilfield operations. More particularly, at least one embodiment of the present disclosure relates to techniques for performing stimulation operations, such as perforating, injecting, and/or fracturing, a subterranean formation having at least one reservoir therein.

In order to facilitate the recovery of hydrocarbons from oil and gas wells, the subterranean formations surrounding such wells can be stimulated by hydraulic fracturing. Hydraulic fracturing may be used to create cracks in subsurface formations to allow oil or gas to move toward the well. A formation is fractured by introducing a specially engineered fluid (referred to as "fracturing fluid", "treatment fluid", or "fracturing slurry" herein) at high pressure and high flow rates into the formation through one or more wellbores.

Hydraulic fractures may extend away from the wellbore hundreds of feet in opposing directions according to the natural stresses within the formation. Under certain circumstances, they may form a complex fracture network. Complex fracture networks may include induced hydraulic fractures and natural fractures, which may or may not intersect, along multiple azimuths, in multiple planes and directions, and in multiple regions.

Patterns of hydraulic fractures created by the fracturing stimulation may be complex and may form a fracture network as indicated by a distribution of associated microseismic events. Complex hydraulic fracture networks have been developed to represent the created hydraulic fractures. Examples of fracture models and fracture simulators are provided in U.S. Patent/Application Nos. U.S. Pat. Nos. 6,101,447, 7,363,162, 7,788,074, 8,412,500, 20120179444, 20080133186, 20100138196, 20100250215, U.S. Pat. Nos. 6,776,235, 8,584,755, and 8,066,068, the entire contents of which are hereby incorporated by reference herein.

Fracturing fluids may be injected into the wellbore in a manner that provides the desired fractures. The fracturing fluids may include proppants to prop fractures open and facilitate fluid flow to the wellbore. Examples of fracturing and/or proppant techniques are provided in U.S. Patent/Application Nos. U.S. Pat. Nos. 6,776,235, 8,066,068, 8,490,700, 8,584,755, 7,581,590, and 7,451,812, the entire contents of which are hereby incorporated by reference herein.

SUMMARY

In at least one aspect, the present disclosure relates to a method for performing a stimulation operation at a wellsite. The wellsite has a wellbore penetrating a formation having fractures therein. The method involves predicting placement of proppant in the fractures based on wellsite data (including geometry of the fractures), generating an asperity model based on the predicted placement, predicting aperture change for a prescribed closure stress using the asperity model, determining fracture conductivity based on the predicted aperture change, and placing proppant into the fractures with a stimulation fluid by injecting the stimulation fluid having the proppant therein into the formation based on the determined fracture conductivity.

In another aspect, the disclosure relates to a method for performing a stimulation operation at a wellsite. The wellsite has a wellbore penetrating a formation having fractures therein. The method involves determining proppant parameters of the fractures by predicting placement of proppant in the fractures based on wellsite data using a plurality of simulations (the wellsite data comprising geometry of the fractures), generating an asperity model based on the predicted placement, predicting aperture change for a prescribed closure stress using the asperity model, determining fracture conductivity based on the predicted aperture change, and validating the predicted placement by comparing the plurality of simulations, and placing proppant into the fractures with a stimulation fluid by injecting the stimulation fluid having the proppant therein into the formation based on the validated fracture conductivity.

Finally, in another aspect, the disclosure relates to a method for stimulating a wellbore at a wellsite. The wellsite has a wellbore penetrating a formation having fractures therein. The method involves determining proppant parameters of the fractures by predicting placement of proppant in the fractures based on wellsite data, the wellsite data comprising geometry of the fractures, generating an asperity model based on the predicted placement, predicting aperture change for a prescribed closure stress using the asperity model, and determining fracture conductivity based on the predicted aperture change, and placing proppant into the fractures with a stimulation fluid by injecting the stimulation fluid having the proppant therein into the formation based on the validated fracture conductivity, and producing fluid from the reservoirs and into the wellbore through the propped fractures.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the method for performing a stimulation operation involving proppant placement are described with reference to the following figures. The same numbers are used throughout the figures to reference like features and components. Implementations of various technologies will hereafter be described with reference to the accompanying drawings. It should be understood, however, that the accompanying drawings illustrate only the various implementations described herein and are not meant to limit the scope of various technologies described herein.

FIGS. 1.1-1.4 are schematic illustrations of a wellsite depicting a stimulation operation involving placement of proppant into a formation;

FIGS. 3, 4, 5.1, 5.2, and 6 are flow charts depicting in greater detail various aspects of the method of performing a fracture operation;

FIGS. 7.1 and 7.2 are schematic diagrams depicting asperity representations of a propped and an unpropped fracture, respectively;

FIGS. 8.1-8.3 are schematic diagrams depicting proppant placement in a fracture;

FIGS. 9.1-9.4 are plots depicting predicted propped fractures with circular pillars of heterogeneous proppant at various distributions and stresses;

FIGS. 10.1-10.4 are plots depicting predicted propped fractures with unpropped rough fractures at various distributions and stresses;

FIGS. 11.1-11.4 are plots depicting predicted propped fractures with arbitrary, heterogeneous distribution of proppant in fractures for various stresses;

FIGS. 12.1 and 12.2 are graphs depicting a closure stress and an evolution of fracture conductivity, respectively, for a range of proppant-fracture geometries;

FIG. 16 is a schematic diagram depicting flow between parallel plates through a fracture;

FIG. 17 is a schematic diagram depicting a 2-D computational domain of a symmetric half of the full fracture of FIG. 16;

FIGS. 18.1-18.3 are graphs depicting flow through the fracture of FIG. 16 with various fluids;

FIGS. 19.1-19.3 are graphs comparing 1-D and 2-D solutions at various angles for various fluids;

FIGS. 24.1 and 24.2 are various schematic views of a fracture;

FIGS. 25.1 and 25.2 are point and line graphs depicting a first comparison of simulators;

FIGS. 26.1 and 26.2 are point and line graphs depicting a second comparison of simulators;

FIGS. 27.1 and 27.2 are graphs depicting aperture depicting a third comparison of simulators;

FIG. 28 is a graph depicting a comparison of various simulations;

FIGS. 29.1-29.3 are graphs depicting a comparison of simulations at various resolutions; and FIGS. 30.1-30.3 are schematic diagrams depicting heterogeneous proppant placement for various pillars.

DETAILED DESCRIPTION

Figure 2:
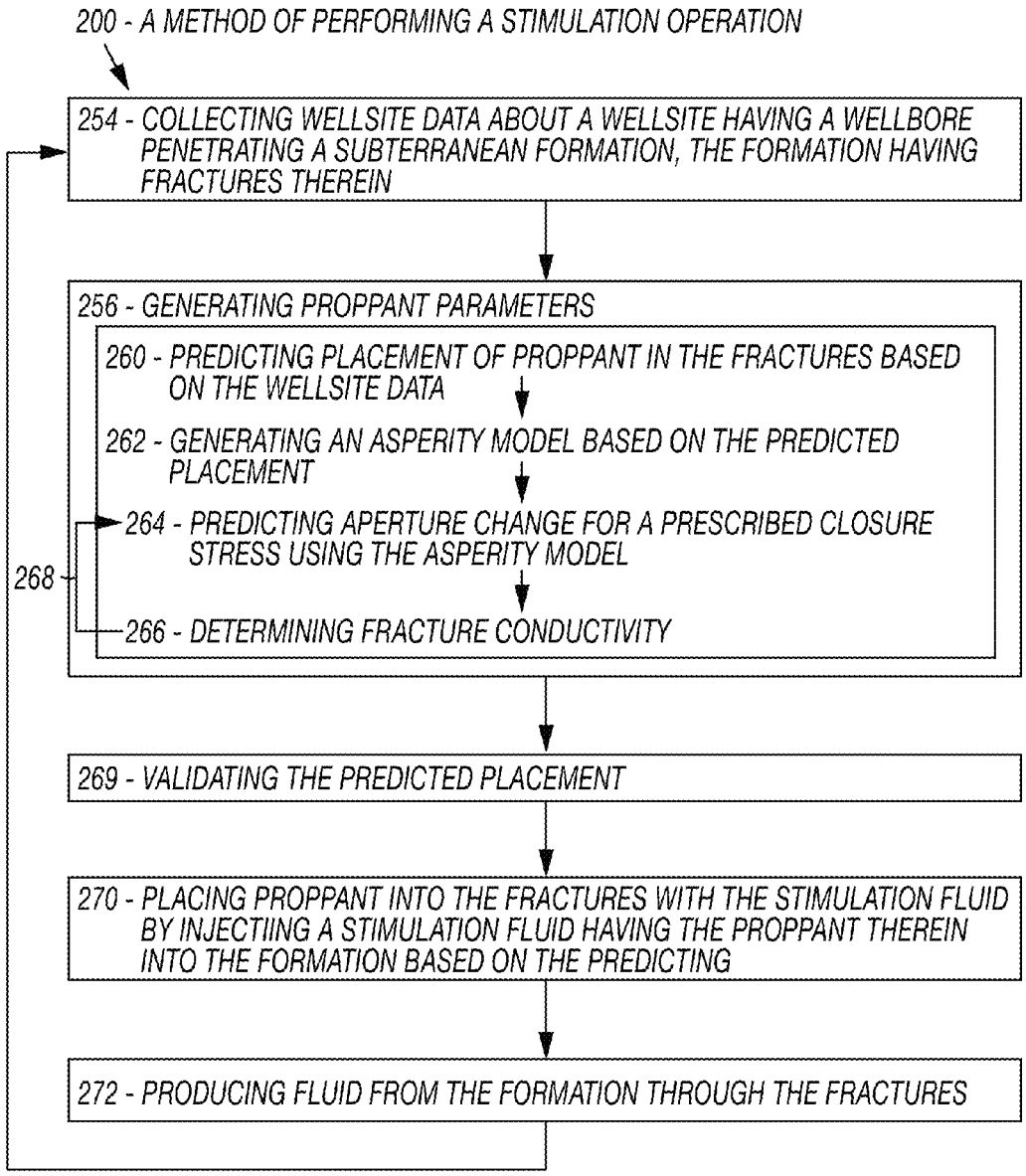
FIG. 2 is a flow chart depicting a method of performing a stimulation operation.

The description that follows includes apparatuses, methods, techniques, and instruction sequences that embody techniques of the inventive subject matter. However, it is understood that the described embodiments may be practiced without these specific details.

In at least one aspect, the present disclosure provides a method for performing a stimulation operation at a wellsite. The stimulating involves generating proppant parameters by predicting placement of proppant in fractures, generating an asperity model (sometimes referred to as an asperity-based model) based on the prediction, predicting aperture change for a given closure stress using the asperity model, and determining fracture conductivity based on the closure stress. The proppant may then be placed into the fractures by injecting a stimulation fluid with the proppant therein into the formation based on the determined fracture conductivity. Reservoir fluids may then be produced through the propped fractures.

An independently prescribed arbitrary, heterogeneous distribution of proppant may also be considered. The predicting may optionally be validated by comparison with other predictions and/or measurements. Placement of proppant and the resultant conductivity within a rough fracture may be predicted under any prescribed closure stress. The rough fracture may be represented by a collection of asperities, which may be arranged upon a regular grid attached to two deformable half-spaces.

At least two approaches for deformation are described. With the first, the deformation characteristics of the deformable half-spaces may be pre-calculated, allowing for efficient prediction of the deformation of the formation on either side of the fracture. The present disclosure provides a method for automatically detecting additional contact as the fracture closes during increasing closure stress (such as during flow-back and production). In addition, the asperity mechanical response can be modified to account for a combined mechanical response of the rough fracture surface and proppant that may be present in the fracture at that location. In this way, the deformation of any combination of fracture roughness and heterogeneous arrangement of proppant in the fracture may be evaluated.

Another approach approximates detailed asperities with a more coarse collection of cylinders for the mechanical calculation. With both mechanical models, the deformed state is then converted into a pore network model which calculates the conductivity of the fracture during flow-back and subsequent production. This alternative approach may be faster than the first approach and may have reduced accuracy. In some cases, the approaches may be compared for validation and/or to detect issues, such as water injection and multiple fluid interactions.

The methods for predicting proppant placement may involve consideration of the interplay between fracture roughness, generalized heterogeneous proppant geometry and proppant compliance. Such placement may be intended to efficiently simulate detailed, arbitrary proppant arrangements, including the natural roughness of real fractures in detail and capturing nonlinear stiffening behavior of the fracture as it closes.

Placement may utilize accelerated solutions by pre-calculating the mechanical response of the formation on the grid of consideration. Such placement may take into account the following mechanisms: arbitrary distribution of proppant within the fracture; mechanical deformation of both the proppant and host rock; roughness of the fracture surface in detail; feedback of stress redistribution as fracture surfaces make additional contact; and flow between the deformed fracture surfaces and within the heterogeneously placed proppant within the gap between the surfaces.

Proppant placement may be used to uniformly fill a fracture with proppant in order to maintain adequate fracture aperture. By uniformly filling fractures, reservoir fluids may then be produced back through the proppant. Heterogeneous Proppant Placement (HPP) strategies seek to increase propped fracture conductivity by selectively placing the proppant such that the fracture is held open at discrete locations and the reservoir fluids can be transported through open channels between the proppant. An example of HPP technology is HiWAY™ commercially available from SCHLUMBERGER™, Ltd. Of Houston, Tex. (see: www.s-lb.com). Additional descriptions of proppant technology are provided, for example, in U.S. Pat. No. 6,776,235, U.S. Pat. No. 8,066,068, and U.S. Pat. No. 8,584,755, previously incorporated by reference herein.

HPP may be used to introduce proppant into the fractures in discrete slugs. Mixing of the proppant slugs with clean slugs may be limited by the presence of fibers. The slugs may be transported down the wellbore and into the fractures with the goal of creating isolated pillars which support the fracture against closure stress, while preserving pristine flow channels in the space between.

For the purposes of technology development and optimization, tools may be developed for predicting conductivity of the heterogeneously propped fractures during the increase in closure stress resulting from flow-back and subsequent production. In at least one aspect of the present disclosure there is provided means to predict proppant placement and to calculate the resultant conductivities for arbitrary proppant distribution within, for example, realistic, rough walled fractures.

I. Injection and Proppant Placement

Aspects of the present disclosure may be performed at a wellsite, such as the wellsite 100 of FIG. 1.1. The wellsite 100 has a wellbore 104 extending from a wellhead 108 at a surface location and through a subterranean formation 102 therebelow. A fracture network 106 extends about the wellbore 104. A pump system 129 is positioned about the wellhead 108 for passing fluid through tubing 142.

The pump system 129 is depicted as being operated by a field operator 127 for recording maintenance and operational data and/or performing the operation in accordance with a prescribed pumping schedule. The pumping system 129 pumps fluid from the surface to the wellbore 104 during the fracture operation.

The pump system 129 may include a water source, such as a plurality of water tanks 131, which feed water to a gel hydration unit 133. The gel hydration unit 133 combines water from the tanks 131 with a gelling agent to form a gel. The gel is then sent to a blender 135 where it is mixed with a proppant from a proppant transport 137 to form a fracturing fluid. The gelling agent may be used to increase the viscosity of the fracturing fluid, and to allow the proppant to be suspended in the fracturing fluid. It may also act as a friction reducing agent to allow higher pump rates with less frictional pressure.

The fracturing fluid is then pumped from the blender 135 to the treatment trucks 120 with plunger pumps as shown by solid lines 143. Each treatment truck 120 receives the fracturing fluid at a low pressure and discharges it to a common manifold 139 (sometimes called a missile trailer or missile) at a high pressure as shown by dashed lines 141. The missile 139 then directs the fracturing fluid from the treatment trucks 120 to the wellbore 104 as shown by solid line 115. One or more treatment trucks 120 may be used to supply fracturing fluid at a desired rate.

Each treatment truck 120 may be normally operated at any rate, such as well under its maximum operating capacity. Operating the treatment trucks 120 under their operating capacity may allow for one to fail and the remaining to be run at a higher speed in order to make up for the absence of the failed pump. A computerized control system 149 may be employed to direct the entire pump system 129 during the fracturing operation.

Various fracturing fluids, such as conventional stimulation fluids with proppants, may be used to create fractures. Other fluids, such as viscous gels, "slick water" (which may have a friction reducer (polymer) and water) may also be used to hydraulically fracture shale gas wells. Such "slick water" may be in the form of a thin fluid (e.g., nearly the same viscosity as water) and may be used to create more complex fractures, such as multiple micro-seismic fractures detectable by monitoring.

As also shown in FIG. 1.1, the fracture network includes fractures located at various positions around the wellbore 104. The various fractures may be natural fractures 144 present before injection of the fluids, or hydraulic fractures 146 generated about the formation 102 during injection.

FIG. 1.2 depicts a portion 1.2 of the wellbore 104 of FIG. 1.1 showing the proppant 148 placement in the formation 102. As schematically depicted in this figure, the proppant 148 may be pumped into the formation 102 and dispersed throughout the fracture network 106. As also schematically depicted in this figure, the proppant 148 may be dispersed in clusters (or slugs) 150 defining channels 152 therebetween in the fractures 144/146.

The clusters 150 may be passed into the fracture network 106 such that portions of the fractures 144/146 are propped open with the proppant 148 and portions of the fractures 144/146 remain open to transport flow to the wellbore 102 (FIG. 1.2) for producing fluids as schematically depicted by arrows 152 in FIG. 1.3.

As shown in FIG. 1.4, formation stresses may be applied to the proppant clusters 150 within the fractures 144/146. Changes in stresses ($\sigma_{eff}$) may affect the flow of fluid through the fractures 144/146. Such flow, referred to as conductivity, describes the ease with which fluid move through the fractures 144/146 and may depend on permeability of the formation, saturation of the formation, and/or density and viscosity of the fluid.

FIG. 2 is a flow chart depicting a method 200 of performing a stimulation operation. The method 200 may be used to determine conductivity and perform operations based on the determined conductivity. The method 200 involves collecting 254 wellsite data. The wellsite data may be from a wellsite having a wellbore penetrating a subterranean formation having fractures therein as shown in FIGS. 1.1-1.4. The wellsite data may be, for example, wellbore sonic data, microseismic event data, wellsite equipment information, operational parameters, or other data.

The method 200 may also involve generating 256 proppant parameters. The proppant parameters may be determined from the wellsite data 254. The predicting 256 may involve predicting 260 placement of proppant in the fractures based on the wellsite data, generating 262 an asperity model based on the proppant prediction, predicting 264 aperture change for a prescribed closure stress using the asperity model, and determining 266 fracture conductivity based on the aperture change. The predicting 264 and determining 266 may be repeated 268 for various closure stresses.

The method 200 may also involve 269 validating the placement prediction, placing 270 the proppant into the fractures with a stimulation fluid, and producing 272 fluid from the formation through the fractures. The method may be performed at the wellsite 100 (see, e.g., FIGS. 1.1-1.4) using the equipment depicted therein. Portions of the method may be performed using, for example, the pumping system 129 to perform stimulation and the control system 149 to perform the proppant placement. Portions of the present disclosure may be performed using a processor of a computer system.

Fracture conductivity 266 may be used to determine how to inject and/or place proppant for optimized production. The placing 270 may be performed by injecting the stimulation fluid having the proppant therein into the formation based on the determined fracture conductivity 266, and producing 272 fluid from the formation through the fractures. The method may also involve, adjusting the injecting based on new information, and other methods as desired.

The method 200 may be performed in any order and repeated as desired. FIGS. 3-6 depict various portions of the method 200 shown in greater detail.

1.1 Placement Prediction

Figure 3:
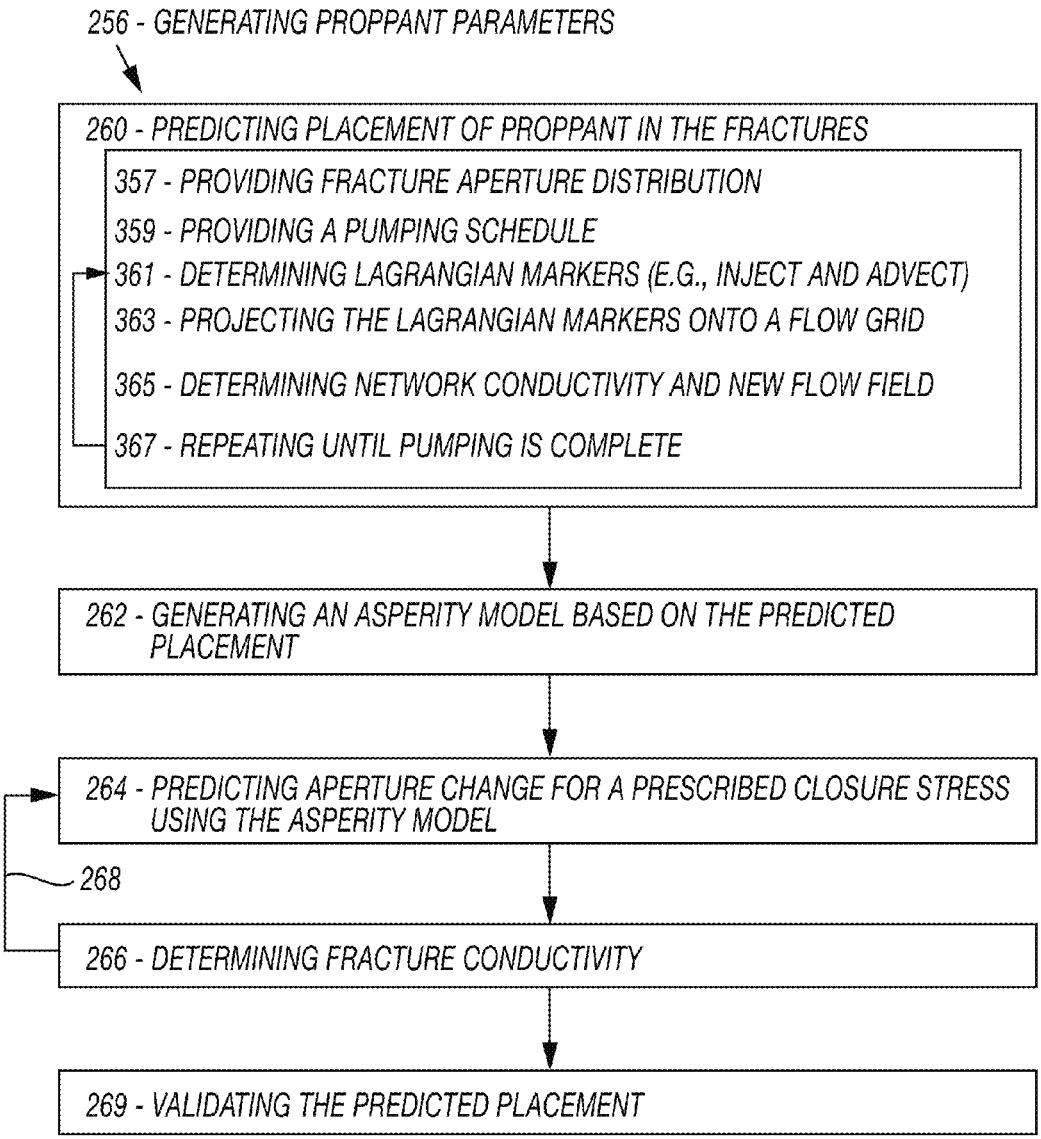

FIG. 3 depicts another view of the generating 256 proppant parameters of FIG. 2 showing the predicting placement of proppant 260 in greater detail. The predicting 260 may involve a prediction of the placement of the proppant and other placed fluids within the rough fracture, such as the rough fracture of FIG. 1.3. The method of FIG. 3 may also provide a detailed workflow for placement prediction within the overall fracture conductivity workflow.

The predicting 260 may include providing 357 fracture aperture distribution and 359 a pumping schedule. The fracture aperture distribution 357 and pumping schedule 359 may be information provided as part of the wellsite data collected (e.g., 254 of FIG. 2), or may be input separately. The predicting 260 may also include determining the trajectory and location of 361 Lagrangian markers, projecting 363 the Lagrangian markers onto the flow grid, and determining 365 network conductivity and a flow field. The determining 361 may be based on the fracture aperture distribution 357 and the pumping schedule 359.

The network conductivity and new flow field may be determined 365. The determining 361, projecting 363, and determining 365 may be repeated 367 until pumping is complete. Once complete, the remainder of the predicting 260 (e.g., 262-268) and/or method 200 (e.g., 270, 272) may be performed.

Providing fracture aperture distribution 357 may be obtained from real or synthetic methods. For example, the three-dimensional geometry of the fracture can be approximated using a two-dimensional array of locations where the local fracture aperture, b(x,y) is known:

$$b_{ij}=b(x=i\Delta x,y=j\Delta x) \tag{1}$$

where Δx is the size of the cells used for the computational grid and x and y are coordinates lying in the mid-plane of the fracture and i and j are indices that identify the i,j-cell. For the fracture surface geometry, either measurements of real fractures can be used to dictate the surface geometry or a synthetic algorithm can be employed.

In the latter case, the present disclosure utilizes a synthetic fracture generation algorithm. Using this approach, a square matrix with the same number of cells as the desired fracture is initialized with Gaussian distributed random numbers. A Fourier transform is performed on the matrix and this transform is then modified using a power-law, high-wavenumbers filter. The aperture distribution is then obtained by taking the inverse Fourier transform of the filtered spectrum. Either via measurement or synthesis, a digitized representation of the fracture surfaces can be obtained. Regardless of the source of data, the fracture surfaces may be approximated by a regular grid of points at which the aperture is known, bij.

The pumping schedule may be provided 359, for example, based on the well plan for the wellsite. The pumping schedule may be pre-existing data provided as an input from external sources. Based on the provided pumping schedule, the proppant parameters within the fracture may be calculated using particle placement methods, such as a Lagrangian marker of particles placed throughout the computational domain. The method may be performed using aspects of a Particle-in-Cell (PIC) method developed by Harlow, F. H., "A Machine Calculation Method for Hydrodynamic Problems", Los Alamos Scientific Laboratory report LAMS-1956 (1955), the entire contents of which are hereby incorporated by reference herein.

Lagrangian markers (and/or their locations) may be determined 361 through injection and advection. The particles may carry information, such as the mass of gas, gel, water and proppant at that given location. At injector locations, source terms are introduced into the flow equations and Lagrangian marker particles are injected with the appropriate volume fractions of the components being injected at that time.

The Lagrangian particles can also be advected with the local fluid velocity during the determining 361. For example, if particle α occupies cell i, j its change in position, $\Delta x_\alpha$, $\Delta y_\alpha$ is given by:

$$\Delta x_\alpha=v_{ij}^x\Delta t \tag{2}$$

$$\Delta y_\alpha=v_{ij}^y\Delta t \tag{3}$$

where $v_{ij}^x$, $v_{ij}^y$ are the current velocity components in cell i, j and Δt is the discrete timestep used for integration. Other history dependent variables can also be evolved at this point in the method. For example, the solid volume fraction of each particle can be changed due to local estimates of the rate of fluid leak-off.

The updated Lagrangian particle states may be projected 363 onto a flow grid. Within each timestep of length Δt, the Lagrangian particles contribute to the volume fractions of the various components within the Cartesian cell they are located within. For example, $V_{ij}^\beta$, the volume fraction of species β (where β corresponds to one of: water, gel, proppant, etc.) in cell i, j can be estimated using:

$$V_{ij}^\beta=\frac{\Sigma_{\alpha\in\Omega_{ij}}V_\alpha V_\alpha^\beta}{\Sigma_{\alpha\in\Omega_{ij}}V_\alpha} \tag{4}$$

where $\Omega_{ij}$ is the region occupied by cell i,j:

$$(i-½)\Delta x<x<(i+½)\Delta x \tag{5}$$

$$(j-½)\Delta x<y<(j+½)\Delta x \tag{6}$$

and $V_\alpha$ is the volume of particle α and $V_\alpha^\beta$ is the volume fraction of particle α occupied by phase β. Thus, the volume fractions of all fluid species, along with other properties, such as solid volume fraction are obtained at all points on the grid.

The grid properties so obtained may then be used to determine local conductivities 365 using the expression for the flow of fluid between parallel plates. For example, for the case of a Hershel-Bulkley fluid, the flow element conductivity is calculated using the following relationship between flux Q and the pressure gradient in the direction of the flow element, $P_x$:

$$Q=-\mathrm{sgn}(P_x)2\delta y\frac{n}{n+1}\frac{(|P_x|H-\tau_0)^{n+1/n}}{k^1/nP_x^2}\left\{\tau_0+\frac{n+1}{2n+1}(|P_x|H-\tau_0)\right\} \tag{7}$$

where $\tau_0$ is the yield-stress of the fluid, k is the consistency coefficient, n is the power-law exponent, H is half the aperture of the element, and δy is the side-length of an element in the direction perpendicular to flow.

The network conductivity and new flow field can then be determined 365 for all locations within the fracture using the approach described in Section 1.4 (Fracture Conductivity Calculation, below). If pumping is not complete the process may be repeated (367) and the new flow field can then be used to update the velocities of all Lagrangian particles within the fracture used by Equations (2) and (3) to advect the particles 361.

At the end of the pumping schedule, the location and density of proppant can be obtained within all cells of the computational grid. These results can be passed to the next phase described in Section 2 (Generation of Asperity Model 262).

1.2 Generation of Asperity Model

Figure 4:
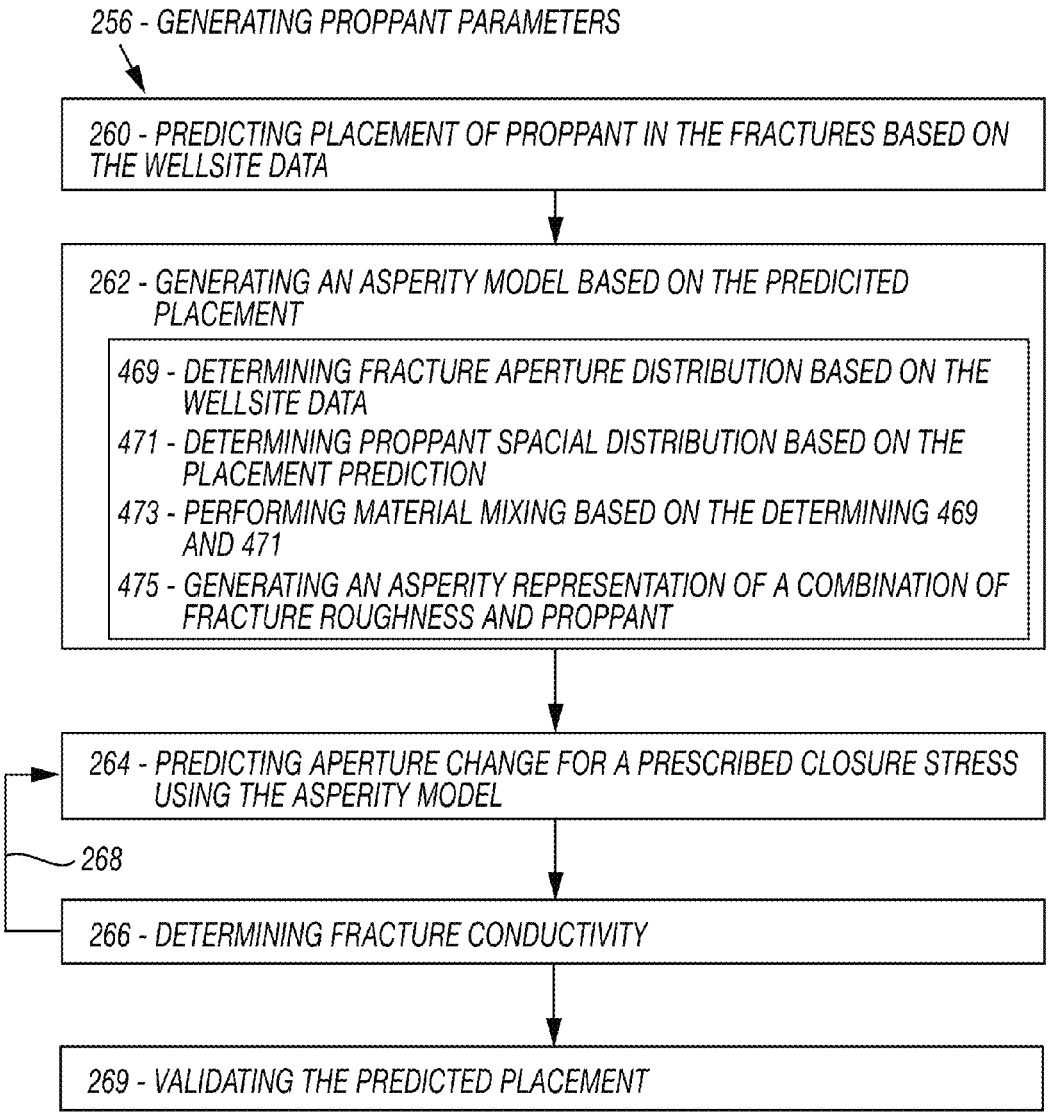

FIG. 4 depicts another portion of the predicting 256 of FIG. 2. In this view, the generating 262 an asperity model is shown in greater detail. The method of FIG. 4 provides a detailed view of generation of the asperity model within the overall fracture conductivity method 256. The generating 262 involves developing an asperity-based representation of the combination of fracture roughness and placed proppant as obtained either from the proppant parameters 256 as described in Section 1, above or from some other independent source.

As shown in the example of FIG. 4, the generating 262 involves determining 469 fracture aperture distribution, determining 471 proppant spatial distribution, performing 473 material mixing, and generating 475 an asperity representation of a combination of fracture roughness and proppant.

System geometry, such as fracture aperture distribution, may be determined 469 by the geometry of the fracture surfaces in combination with the arrangement of proppant 471 between the fracture surfaces. Mechanically, the fracture is then represented by two elastic half-spaces separated by a forest of asperities of lengths, $L_{ij}^R$, using the same discretization as was used in the generating 256 of Section 1.1 above.

FIG. 7.1 is a schematic diagram depicting an unpropped rough natural fracture 744. FIG. 7.2 provides a cross-section through the asperity model for the rough fracture 744 containing proppant 745. These diagrams depict a cross-section through the asperity model for the unpropped rough natural fracture 744. In at least one aspect, the above description, along with the figures, provides a representation of the geometry and local mechanical properties of a fracture containing a heterogeneous arrangement of the proppant 475.

Asperity lengths Lij are defined along the fracture 744. The asperity lengths are related to the apertures by the following equation:

$$L_{ij}^R = \max(b_{ij}) - b_{ij} \tag{8}$$

The present disclosure next considers the introduction of the proppant 745 into the fracture 744, filling the gaps between the rock surfaces as schematically depicted in FIG. 7.2. The present disclosure presumes the geometry of the proppant distribution is obtained via the predicted placement 260 and can be approximated by additional asperity lengths, $L_{ij}^P$, throughout the fracture. The present disclosure assumes that the deformation of the proppant is uniaxial (i.e. perpendicular to the x-y plane) and so the change in height, $\Delta L_{ij}^P$, of the proppant under stress is dictated by the uniaxial modulus of the proppant, $M^R$:

$$\sigma_{ij} = M_{ij}^P \frac{\Delta L_{ij}^P}{L_{ij}^P} \tag{9}$$

where $\sigma_{ij}$ is the uniaxial stress in asperity i, j.

The uniaxial modulus for predicting the combined response of the rock asperity, $L_{ij}^R$, and proppant asperity, $L_{ij}^P$, is obtained using a harmonic mean:

$$M_{ij} = \frac{L_{ij}}{L_{ij}^R / M^R + L_{ij}^P / M_{ij}^P} \tag{10}$$

where $L_{ij} = L_{ij}^R + L_{ij}^P$ and $M^R$ is the longitudinal modulus of the formation. Equation (10) may be used as a material mixing algorithm for the performing 473.

1.3 Prediction of Aperture Change for Prescribed Closure Stress

In another aspect, at least one embodiment of the present disclosure provides for approaches for predicting 264 the change in aperture due to prescribed closure stress. A first approach, shown in FIG. 5.1, relates to "Cartesian Prediction of Aperture Change For Prescribed Closure Stress" (a Cartesian method) and uses a grid-based approach to solve the mechanical equations efficiently on the same grid as the flow using pre-calculated influence functions. A second approach, shown in FIG. 5.2, relates to a "Cylinder-Based Prediction of Aperture Change For Prescribed Closure Stress" (a non-linear cylinder method) which approximates the asperity grid with large cylindrical asperities for a rapid mechanical solution that is then projected back upon the original asperity grid.

1.3.1 Cartesian Prediction of Aperture Change for Prescribed Closure Stress

Mechanically, the heterogeneously propped fracture is treated as two elastic half-spaces of material, separated by asperities whose mechanical properties are obtained via generation of asperity model 262. As described in FIG. 5.1, a method for Cartesian prediction of aperture change for a prescribed closure stress within the overall fracture conductivity workflow is provided.

As shown in FIG. 5.1, the predicting 264 involves predetermining 581 asperity-to-asperity influence (interaction) tables, adjusting 583 far-field displacement, 585 generating asperity and half-space deformation interaction based on the asperity-to-asperity influence tables, adding 587 new contacts, determining 589 if fracture is within tolerance of a target stress, and determining 591 aperture distribution from the determined asperity and half-space deformation.

After generating 585, a decision may be made whether to add or delete new contacts 587. If so, the generating 585 may be repeated with the addition of new contacts. If not, the generating 264 may continue to the determining 589 and 591. The adjusting 583 may be repeated after the determining 589 and the generating 585 may be repeated when contacts are added 587.

The predetermining of asperity-to-asperity tables 581 can be achieved by recognizing that, given an asperity, I, in contact with the half-spaces it is possible to calculate the radial dependence of the deflection of the half-space due to the asperity loading analytically or numerically. The analytic function or numerical result may be pre-calculated on a grid 581 upon initialization. The present disclosure assumes a function, a(x', y'), which gives the increase in aperture per unit load between the half-spaces at displacement x', y' relative to a loaded asperity. Consequently, the increase in half-space opening at asperity J due to a force $f_I$ exerted at asperity I can be written as follows:

$$w_{IJ}=f_I\alpha(x_J-x_I,y_J-y_I)=f_I\alpha([i_J-i_I]\Delta x,[j_J-j_I]\Delta x)=f_I\alpha_{IJ} \tag{11}$$

where:

$$\alpha_{IJ}=\alpha([i_J-i_I]\Delta x,[j_J-j_I]\Delta x) \tag{12}$$

and $x_I$, $Y_I$, and $x_J$, $y_J$ are the coordinates of asperity I and J, respectively, while and $i_I$, $j_I$, and $i_J$, $j_J$ are the integer coordinates of asperity I and J, respectively.

The present disclosure pre-determines (or pre-calculates) 581 the $\alpha_{ij}$ of equation (12) once upon initialization of the aperture change stage. The present disclosure obtains the stress distribution within asperities and the associated deformation of surrounding material by enforcing compatibility between the asperity stresses and associated deformation. Specifically, at any location where an asperity is in contact, the change in asperity length and the additional half-space opening at that location should be consistent. That is, the deformed asperity should match the deformed gap:

$$D+\Sigma_J w_{JI}=L_I^0-\Delta L_I \tag{13}$$

where D is the gap which would be between the half-spaces in the absence of any asperity contact, $L_I^0$ is the unstressed length of the asperity I.

The far-field displacement D can be adjusted 583 to approach a requested stress state in the generation of asperity and half-space deformation interaction 585. The asperity and half-space interaction 585 may be generated by recognizing that the change in length of the asperity I due to the current stress, $\Delta L_I$, is given by:

$$\Delta L_I = \frac{\sigma_I L_I^0}{M_I} = \frac{f_I L_I^0}{\Delta x^2 M_I} \tag{14}$$

and a linear system of equations that can be solved for the individual changes in asperity length, $\Delta L_I$, is obtained:

$$D + \sum_J \frac{\Delta x^2 M_J \Delta L_J}{L_J^0}\alpha_{JI} = L_I^0 - \Delta L_I, \forall I \tag{15}$$

where $L_I=L_{Ij_Ii_I}$, $\Delta L_I=\Delta L_{ij_Ii_I}$, and $M_J=M_{ij_Ji_J}$, and ∀I indicates that Equation (15) applies for all values I.

The solution of this system provides the deformed state of the fracture 585. Once this deformed state is obtained, the present disclosure checks for new contact between the two surfaces due to the deformation and selects new candidate asperities for contact 587. The deformed state is then recalculated and the process is repeated until all additional points of contact have been identified.

At this point the current stress state, $\sigma_n$, is calculated by dividing the total force by the total area, A, of the fracture:

$$\sigma_n = \frac{\sum_I f_I}{A} \tag{16}$$

It may then be determined if the gap, D, needs to be adjusted 583 up or down to bring $\sigma_n$ closer to the requested stress level and the procedure is repeated until $\sigma_n$ is deemed sufficiently close to the requested stress level as shown in FIG. 5.1.

1.3.2 Cylinder-Based Prediction of Aperture Change for Prescribed Closure Stress Using an alternative approach for mechanical deformation, the asperity grid is approximated by a coarse collection of cylindrical asperities. FIG. 5.2 provides a detailed view of the predicting 264 for a cylinder-based prediction of aperture change for a prescribed closure stress within the generating 256.

As shown in FIG. 5.2, the predicting 264 involves approximating 580 an asperity grid with coarse cylinders, determining 582 for cylinder and half-space deformation consistent with applied stress, adding 584 pinch-points, and projecting 587 aperture change due to cylinders back onto the asperity grid. After the solving 582, a decision may be made whether to add or delete new pinch-points 584. If so, the solving 582 may be repeated. If not, the projecting 587 may be performed.

FIGS. 8.1-8.3 are schematic views depicting proppant placement in three stages (I), (II), and (III), respectively. These figures depict conversion of (I) detailed asperity model (FIG. 8.1—two circles and an ellipse) into (II) coarse cylinder representation (FIG. 8.2), and then projection back to (III) deformed detailed asperity model as part of the cylinder-based fracture deformation workflow (FIG. 8.3).

FIG. 8.1 shows an example of a simple prescribed, asperity-based Cartesian grid of proppant 848 distributed within a fracture 844. With the cylinder-based approach, this grid is approximated by a collection of cylinders that are much larger than the individual asperities. For example, FIG. 8.2 shows the coarse, cylinder-based approximation to this distribution with the proppant 848' grouped into clusters 850. The deformation and interaction among the coarse cylinders can then be calculated 582 using analytic expressions, such as the far-field approximations to the deformation of a half-space. For example, the change in aperture, $w_{IJ}$, at cylinder I due to $f_J$, the total force exerted by cylinder J, may be given by:

$$w_{IJ} = \frac{2(1-\upsilon^2)}{\pi E r_{IJ}} f_J \tag{17}$$

where E and υ are the Young's modulus and Poisson ratio of the half-spaces and $r_{IJ}$ is the distance between the two asperities.

The determining of cylinder and half-space deformation consistent with applied stress 582 can be achieved by assembling a system of linear equations for displacement compatibility. In the cylinder-based approximation, the number of equations may be reduced by an order of magnitude or more compared with the Cartesian-based mechanical solution to increase efficiency.

Similar to the Cartesian-based approach, with the cylinder-based approach new contact points may be sought within the fracture on a coarse grid of points referred to as "pinch-points." As new pinch-points are detected 584, a cylinder is added at that location and the calculation is repeated until convergence is achieved (see FIG. 5.2).

The coarse approximation may introduce artificial blockages or channels into the domain. For example, in FIG. 8.2, the open channel across the top of the domain was closed by the coarse cylinder approximation. Once the deformed state of the cylinders is obtained, the change in aperture 587 may be projected back upon the original asperity grid (see FIG. 8.3).

FIG. 8.3 shows the change in aperture for a stressed proppant pillar 848" within the fracture 844. In this way, artifacts, such as blocked channels or new openings introduced by the coarse cylinder approximation, may be prevented from propagating back to the grid used for the conductivity calculation, and the change in aperture due to stress may be included.

1.4 Fracture Conductivity Calculation

Figure 6:
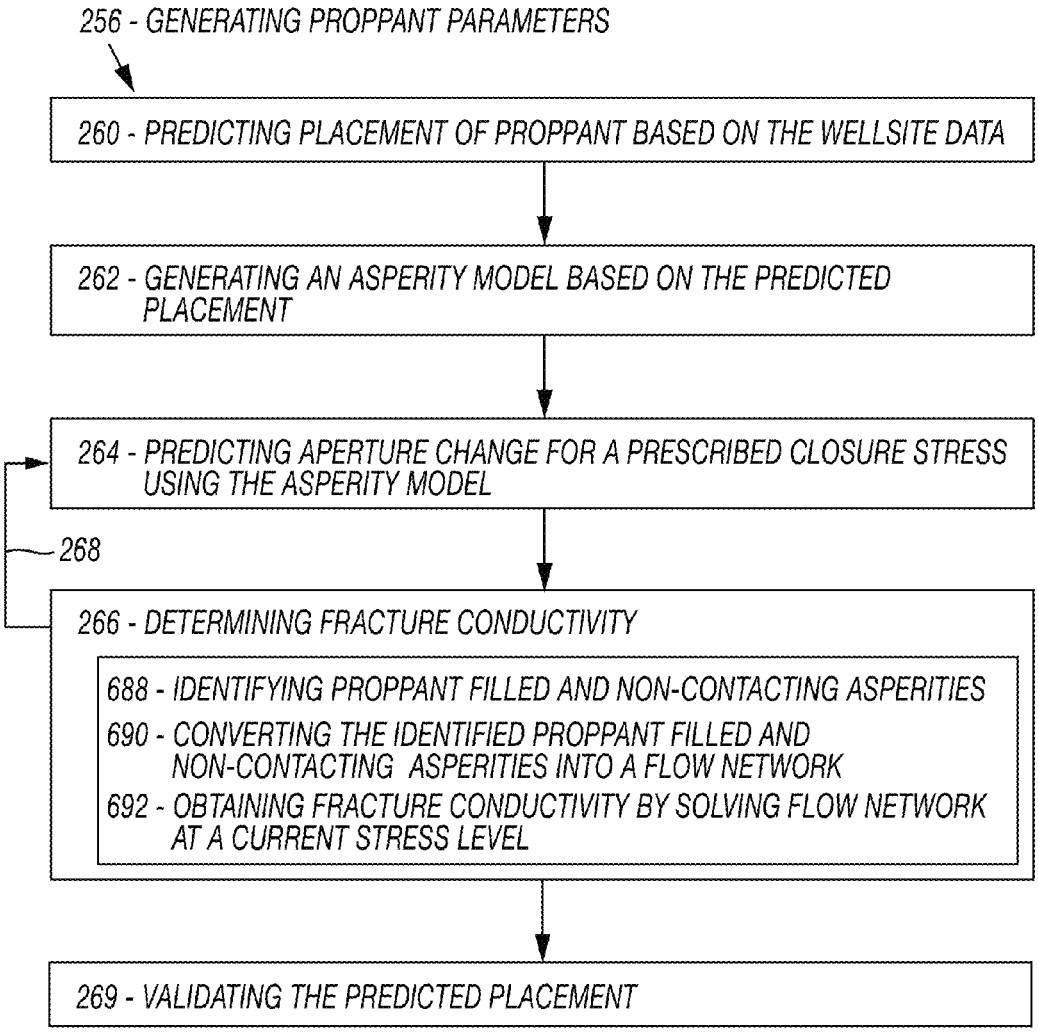

FIG. 6 provides a detailed method for determining 266 fracture conductivity calculation within the generating 256. As shown in FIG. 6, the determining 266 fracture conductivity involves identifying 688 proppant filled and non-contacting asperities, converting 690 the identified proppant filled and non-contacting asperities into a flow network, and obtaining 692 fracture conductivity by solving flow network at a current stress level.

The converting 690 may involve converting cells into a flow network. The converting 690 may vary depending upon the state of each cell. The flow from cell, I located at $i_I j_I$ to cell J, located at $i_J$, $j_J$ can be given by:

$$q_{IJ}=c_{IJ}(p_I-p_J) \tag{18}$$

where $p_I$ is the pressure in cell I and $c_{IJ}$ is the conductivity between cell I and cell J. The method for determining $c_{IJ}$ depends on whether or not the cell is proppant-filled.

The converting of cells into a flow network 690 in the proppant-free regions of the fracture may be calculated using a network model. See, e.g., Yang. G., Cook, N. H. W., Myer, L. R., Network Modeling Of Flow In Natural Fractures, Rock Mechanics as a Guide for Efficient Utilization of Natural Resources, p. 57-64 (1989), the entire contents of which is hereby incorporated by reference herein. Using this approach, the fracture may be represented locally by conductive pipes where the conductivity of the pipes is calculated using the solution for flow between two parallel plates. Consequently, the conductivity 692 between cells within the unpropped regions of the fracture is given by:

$$c_{IJ}=\frac{b_{IJ}^3}{12\mu} \tag{19}$$

where μ is the fluid viscosity and $b_{IJ}$ is the average aperture of the two cells:

$$b_{IJ}=2\frac{b_I b_J}{b_I+b_J} \tag{20}$$

where $b_I=b_{i_I j_I}$ is the aperture at asperity I.

The converting of cells into a flow network 690 within the stressed proppant filled regions can be treated differently. It may be assumed that the permeability of the packed proppant depends upon the applied stress. In one aspect, at least one embodiment of the present disclosure calculates the local proppant permeability given the local stress in the fracture and converts the permeability into a conductivity through the assumption of local porous Darcy flow with a stress-dependent permeability:

$$c_{IJ}=b_{IJ}\frac{k_{IJ}}{\mu} \tag{21}$$

where:

$$k_{IJ}=(k(\sigma_I)+k(\sigma_J))/2 \tag{22}$$

and k(σ) is the stress-dependent permeability of the proppant and $\sigma_I$ is the local stress as obtained during the fracture closure during step 264.

The obtaining of fracture conductivity 692 can be achieved by recognizing that the net flux into each asperity-cell is zero and constructing a system of linear equations for the unknown pressure field is:

$$\Sigma_J q_{IJ}=\Sigma_J c_{IJ}(p_I-p_J)=0, \forall I \tag{23}$$

except at specified locations where pressure boundary conditions are applied, and p is known. This system of equations is solved for the pressure field, p, which is then substituted back into the local flux equation to evaluate the conductivity of the fracture 692.

If conductivity of the fracture at an additional closure stress is sought, the present disclosure now returns to 264 prediction of aperture change for prescribed closure stress as shown in FIG. 6. In this manner, the present disclosure obtains the conductivity of a natural, rough fracture under stress in the presence of arbitrary distributions of proppant.

EXAMPLE

Demonstration Application

This example provides an application involving a range of fractures and proppant geometries in accordance with at least one embodiment of the present disclosure. The rock-mass was assumed to have a Young's modulus of 20 GPa and Poisson ratio of 0.22. The proppant had a uniaxial modulus of 230 MPa and a permeability-stress dependence prescribed by:

$$k(\sigma)=(300-\sigma/2\times10^5) \tag{24}$$

where k is in Darcy and σ is in Pa.

FIGS. 9.1-9.4 shows results predicted by the present disclosure when applied to a fracture measuring 10 m square, with an aperture of 5 mm, containing circular proppant pillars of radius 2 m. These figures depict aperture distribution and contact distribution for the case of circular pillars of heterogeneous proppant between flat rock surfaces as predicted by the present disclosure at 0 MPa and 10 MPa closure stress.

FIGS. 9.1-9.4 are graphs 900.1-900.4 depicting distributions 948,948' along an x-axis (m) and a y-axis (m) in a fracture 944 between two flat rock surfaces. FIGS. 9.1 and 9.2 shows aperture distribution 948 at 0.0 MPa and 10.0 MPa, respectively. FIGS. 9.3 and 9.4 shows contact distribution 948' at 0.0 MPa and 10.0 MPa, respectively.

This heterogeneously propped fracture was loaded up to a closure stress of 10 MPa and fracture stiffness and fracture conductivity were calculated via application of the present disclosure. This process was then repeated for a series of fractures with different aperture geometries and proppant distributions.

FIGS. 10.1-10.4 depict aperture distribution and contact for a rough, natural fracture 944, as predicted by the present disclosure at 0 MPa and 10 MPa closure stress. FIGS. 10.1-10.4 are graphs 1000.1-1000.4 depicting distributions 1048,1048' along an x-axis (m) and a y-axis (m) in a fracture 944. FIGS. 10.1 and 10.2 shows aperture distribution 1048 at 0.0 MPa and 10.0 MPa, respectively. FIGS. 10.3 and 10.4 shows contact distribution 1048' at 0.0 MPa and 10.0 MPa, respectively.

FIGS. 11.1-11.4 show the fracture 944 propped with a complicated, heterogeneous arrangement of proppant. FIGS. 11.1-11.4 depict aperture distribution 1148 and contact distribution 1148' for an arbitrary, heterogeneous distribution within a rough, natural fracture 944 as predicted by the present disclosure for 0 MPa and 10 MPa closure stress. FIGS. 11.1-11.4 are graphs 1100.1-1100.4 depicting distributions 1148,1148' along an x-axis (m) and a y-axis (m) in a fracture 944. FIGS. 11.1 and 11.2 shows aperture distribution 1148 at 0.0 MPa and 10.0 MPa, respectively. FIGS. 11.3 and 11.4 shows contact distribution 1148' at 0.0 MPa and 10.0 MPa, respectively.

For comparison, a uniformly packed fracture was also simulated. All fractures considered measured 10 m on a side and had an average aperture of 5 mm. The natural fracture surfaces were obtained via the self-affine generation scheme with $\zeta$=0.8 and I=3.7×10-17. These may be provided per the definitions of set forth in Drazer, G. and J. Koplik, Permeability of Self-Affine Rough Fractures, Physical Review E, 62(6):8076-8085 (2000), the entire contents of which is hereby incorporated by reference herein.

FIGS. 12.1 and 12.2 are graphs 1200.1, 1200.2 showing stress versus displacement and conductivity versus stress responses, respectively, predicted for each fracture by the present disclosure. FIG. 12.1 provides a comparison of a relationship between normal closure ($\delta_n$) and closure stress ($\sigma_n$) for the range of proppant-fracture geometries considered. Graph 1200.1 depicts normal closure ($\delta_n$) (m) (x-axis) and closure stress ($\sigma_n$) (Pa) (y-axis) for various fracture dimensions, including circular (1294.2), uniformly filled (1294.1), unpropped natural (1294.4), and heterogeneous natural (1294.3), respectively.

FIG. 12.2 provides a comparison of the evolution of fracture conductivity under closure stress for the combinations of proppant and fracture geometry considered. Graph 1200.2 depicts conductivity (FC) (Darcy-m)) (y-axis) and stress response ($\sigma_k$) (Pa) (x-axis) for various fracture dimensions, including circular (1294.1'), uniformly filled (1294.2'), unpropped natural (1294.3'), and heterogeneous natural (1294.4'), respectively.

As expected, the unpropped fracture of this example exhibits the greatest closure under 10 MPa of closure stress. In contrast, the uniformly packed smooth fracture shows the least closure with the heterogeneously packed fractures exhibiting an intermediate response. The conductivity of the unpropped rough fracture decreases rapidly with increasing closure stress. As expected, the uniformly packed fracture maintains a relatively constant, and low conductivity with increasing stress with a value of approximately 1.5 D-m=300 D×5×10$^{-3}$ m. The heterogeneously propped fractures (both smooth and rough-walled) exhibit high conductivity over a wide range of closure stresses.

II. Modeling of Proppant Placement within a Fracture

FIGS. 13-19.3 describe additional methods relating to the predicting 256 of placement of proppant in the fractures, and for 269 validating (or verifying) the predicting 256. These methods are performed for proppant placement and pumped fluids within a rough fracture, such as those schematically depicted in FIGS. 7.1 and 7.2. The methods may be used as part of the 260 predicting placement of proppant as described, for example, with respect to FIG. 3. The methods may involve analytical, 1-D, 2-D and/or 3-D simulations. Comparisons of the various methods may be used for validating 269.

2.1 Analytical Solutions for Solving for Fluid Flow Between Two Plates

Analytical solutions, such as the Herschel Bulkley solution for the flow of fluid between infinite plates, may be used as a basis for analysis of fluid flow between plates. The Herschel-Bulkley fluid is a generalized model of a non-Newtonian fluid, in which the strain experienced by the fluid is related to the stress in a complicated, nonlinear way. It may be assumed that the flow is fully developed locally. "Fully-developed flow" means a flow which has had sufficient distance to develop such that the local fluid velocity distribution across the aperture of the fracture depends upon the local flux, and excludes details of an upstream velocity field. A derivation of the Herschel-Bulkley solution may be extended using analytical solutions for power-law and Bingham fluids. Examples of analytical solutions are described in Chhabra, R. P. & Richardson, J. F., Non-Newtonian Flow And Applied Rheology: Engineering Applications, 2-D ed. Elsevier (2008) (referred to herein as "Chhabra & Richardson"). A force-balance diagram 1300 of various forces applied to a rectangular fluid element 1301 as shown in FIG. 13 is considered.

Figure 13:
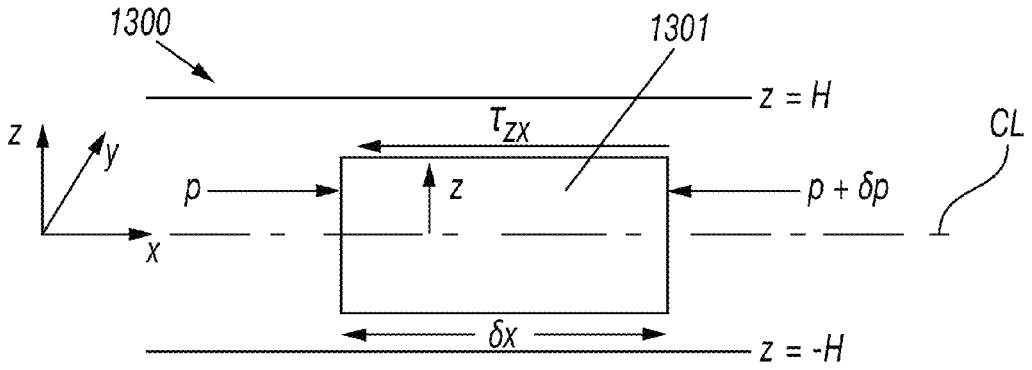
FIG. 13 is a schematic diagram of forces on a rectangle.

FIG. 13 depicts balance of pressure and viscous shear stress upon a rectangular region within laminar flow between parallel plates. The forces of FIG. 13 are represented by the following:

$$(p+\delta p)2z\delta y-p2z\delta y=-2\tau_{ZX}(z)\delta x\delta y \tag{25}$$

where $\delta x$ is the length of the rectangle along axis X, $\delta y$ is the length of the rectangle along axis Y, z is ½ the width along axis Z, p is fluid density, p is pressure, and $\tau_{zx}$ is the shear stress. From Equation (25), the following equation may be derived:

$$\tau_{zx}(z)=-\frac{\delta p}{\delta x}z=-P_x z \tag{26}$$

Applying the Herschel-Bulkley fluid case to Equation (26) provides the following:

$$\tau_{zx}=\pm\tau_0-k\left|\frac{dv_x}{dz}\right|^{n-1}\frac{dv_x}{dz},\quad |\tau_{zx}|\geq\tau_0 \tag{27}$$

$$\frac{dv_x}{dz}=0,\quad |\tau_{zx}|\leq\tau_0 \tag{28}$$

where $v_x$ is velocity, and k is a fluid consistency coefficient. Units of the fluid consistency coefficient k depend upon the value of n as follows:

$$[k]=[\text{stress}][\text{time}]^n \tag{29}$$

Given that the shear stress, $\tau_{zx}$ is zero on the centerline CL, there is a finite plug flow region about the centerline where the shear stress is insufficient to yield the material. A half-width, $z_p$, of this plug is obtained by solving for $\tau_{zx}=\tau_0$ in Equation (26) to obtain the following:

$$z_p=\frac{\tau_0}{P_x} \tag{30}$$

for flow specifically within a region z>0 and a case of $P_x>0$, corresponding to flow from right to left in FIG. 13. Assuming no-slip at the plate surface ($v_x(H)=0$), $v_x$ will be negative and $v_x$ will be monotonically decreasing in magnitude with increasing z and $dv_x/dz>0$, and $\tau_{zx}$ will be negative according to Equation (26). Thus, for $z>z_p$ Equation (27) becomes:

$$\tau_{zx} = -\tau_0 - k\left(\frac{dv_x}{dz}\right)^n \tag{31}$$

and combining with Equation (26), the following is generated:

$$-P_x z = -\tau_0 - k\left(\frac{dv_x}{dz}\right)^n \tag{32}$$

Equation (32) may be rearranged as follows:

$$\frac{dv_x}{dz} = \left(\frac{P_x z - \tau_0}{k}\right)^{\frac{1}{n}} \tag{33}$$

Equation (33) may be integrated to obtain the following:

$$v_x(z) = \frac{k}{P_x}\frac{\left(\frac{P_x z - \tau_0}{k}\right)^{\frac{1}{n}+1}}{\frac{1}{n}+1} + C \tag{34}$$

where C is the constant of integration. C may be chosen to satisfy $v_x(H)=0$ to provide the following:

$$v_x(z) = \frac{k}{P_x}\frac{n}{n+1}\left\{\left(\frac{P_x z - \tau_0}{k}\right)^{\frac{n+1}{n}} - \left(\frac{P_x H - \tau_0}{k}\right)^{\frac{n+1}{n}}\right\} \tag{35}$$

and the velocity of the plug, $v_p$, is obtained as follows:

$$v_P = v_x(z = \tau_0/P_x) = -\frac{k}{P_x}\frac{n}{n+1}\left(\frac{P_x H - \tau_0}{k}\right)^{\frac{n+1}{n}} \tag{36}$$

Provided that $P_x>\tau_0/H$, the total flux $Q_x$ in the x-direction through a section of width δy is obtained by integration across plug and non-plug zones of the fracture as follows:

$$\begin{aligned} Q_x &= \delta y \int_{z=-H}^{z=H} v_x(z)dz \\ &= 2\delta y\left(v_p z_p + \int_{z=z_p}^{z=H} v_x(z)dz\right) \\ &= -2\delta y \frac{k}{P_x}\frac{n}{n+1}\left\{\begin{array}{c} \frac{\tau_0}{P_x}\left(\frac{P_x H - \tau_0}{k}\right)^{\frac{n+1}{n}} + \\ \left(\frac{P_x H - \tau_0}{k}\right)^{\frac{1}{n}}(n+1)\frac{\tau_0^2 - 2P_x H\tau_0 + P_x^2 H^2}{k(2n+1)P_x} \end{array}\right\} \end{aligned} \tag{37}$$

-continued $$= -2\delta y \frac{k}{P_x}\frac{n}{n+1}\left\{\begin{array}{c} \frac{\tau_0}{P_x}\left(\frac{P_x H - \tau_0}{k}\right)^{\frac{n+1}{n}} + \\ \left(\frac{P_x H - \tau_0}{k}\right)^{\frac{1}{n}}(n+1)\frac{(P_x H - \tau_0)^2}{k(2n+1)P_x} \end{array}\right\}$$

where H is aperture height. Equation (37) may be rewritten as follows:

$$Q_x^{HB} = -2\delta y \frac{n}{n+1}\frac{(P_x H - \tau_0)^{\frac{n+1}{n}}}{k^{1/n}P_x^2}\left\{\tau_0 + \frac{n+1}{2n+1}(P_x H - \tau_0)\right\} \tag{38}$$

Equation (38) may be written in terms of the fracture aperture, h=2H, as follows:

$$Q_x^{HB} = -2\delta y \frac{n}{n+1}\frac{(P_x h/2 - \tau_0)^{\frac{n+1}{n}}}{k^{1/n}P_x^2}\left\{\tau_0 + \frac{n+1}{2n+1}(P_x h/2 - \tau_0)\right\} \tag{39}$$

This result corresponds to the case of $P_x>0$. Thus, Equation (39) may be generalized to consider an arbitrary sign of $P_x$ as follows:

$$Q_x^{HB} = -\mathrm{sgn}(P_x)2\delta y \frac{n}{n+1}\frac{(|P_x|H - \tau_0)^{\frac{n+1}{n}}}{k^{\frac{1}{n}}P_x^2} * \left\{\tau_0 + \frac{n+1}{2n+1}(|P_x|H - \tau_0)\right\} \tag{40}$$

for $(|P_x|H-\tau_0)>0$

The critical pressure gradient below which flow stops is given by:

$$|P_x| = \tau_0/H \tag{41}$$

where H=h/2.

Equation (40) recovers the various sub-classes of fluid rheology in appropriate limits, such as Newtonian, power-law, and Bingham limiting cases. For a limiting case of a Newtonian fluid, where n=1 and $\tau_0=0$, Equation (40) may be rewritten as follows:

$$Q_x^{Newtonian} = -\frac{2\delta y P_x H^3}{3k} = -\frac{\delta y P_x h^3}{12k} \tag{42}$$

which corresponds to the "cubic law" for Newtonian flow between two plates with k=μ. Substituting $T_0=0$ into Equation (40), the solution for a Power-Law fluid limiting case is provided as follows:

$$\begin{aligned} Q_x^{PL} &= -\frac{2\delta y k n H\left(\frac{P_x H}{k}\right)^{1+1/n}}{(2n+1)P_x} \\ &= -2H\delta y\left(\frac{n}{2n+1}\right)\left(\frac{P_x}{k}\right)^{1/n} H^{(n+1)/n} \end{aligned} \tag{43}$$

which corresponds to Chhabra & Richardson. Finally, considering the limiting case of a Bingham plastic fluid, n=1 in Equation (40) provides the following:

$$Q_x^{Bingham} = -\frac{\delta y}{kP_x^2}(P_xH-\tau_0)^2\left(\frac{2}{3}P_xH+\frac{1}{3}\tau_0\right) = -\frac{2\delta yH^2}{3k}P_xH\left(1+\frac{3}{2}\varphi+\frac{1}{2}\varphi^3\right), \quad (44)$$

where $$\varphi = \frac{\tau_0}{P_xH}$$

Equation (44) reproduces the result reported in Chhabra & Richardson.

2.2 Solving for Fluid Flow of Hershel-Bulkley Fluids Between Variable Aperture Plates The flow of multiple non-Newtonian fluids within a variable aperture fracture may be simulated. This includes a Lagrangian particle-based approach for tracking the different phases within the fracture. The resultant simulation may be verified through comparison with other simulations for multiphase flow in fractures of different geometries. Agreement for a wide range of injected fluids with viscosity contrasts spanning many orders of magnitude may be obtained.

Our method proceeds by using Equation (40) to provide a relationship between pressure drop and flux that, combined with local flux conservation, leads to a set of nonlinear simultaneous equations for the unknown $p_i$.

The solution may be obtained by iteratively solving a linearized form of Equation (40). Note that in the limit of small $\tau_0$ and $n\approx1$, the term $$(P_xH-\tau_0)^{\frac{n+1}{n}} \Big/ P_x^2$$

in Equation (40) is weakly dependent upon $P_x$. This term may be factored out and expressed in terms of the pressure gradient from the previous iteration as follows:

$$Q_x^{HB} = -\mathrm{sgn}(P_x^{m-1})2\delta y\frac{n}{n+1}\frac{(|P_x|^{m-1}H-\tau_0)^{\frac{n+1}{n}}}{k^{\frac{1}{n}}(|P_x|^{m-1})^2}*\left(1-\frac{n+1}{2n+1}\right)\tau_0 - 2\delta y\frac{n}{n+1}\frac{(|P_x|^{m-1}H-\tau_0)^{\frac{n+1}{n}}}{k^{1/n}(|P_x|^{m-1})^2}HP_x^m \quad (45)$$

where the superscript m on $P_x$ refers to the iteration of the pressure solution. The first term in Equation (45) does not depend upon $P_x^m$ and will become a term in the right hand side of the assembled linear system. Consequently, a linear system using coefficients and a right hand side vector based upon the solution to the previous iteration, $P_x^{m-1}$ may be assembled and the current iteration, $P_x^m$ solved for.

Another way to consider Equation (45) is that, within each iteration, the local fluid flow is approximated by a Newtonian fluid with local properties dictated by the magnitude of the pressure gradient from the previous iteration. That is, a set of linear equations may be assembled as follows to solve for the unknown pressure at the current iteration, $p_i^m$:

$$\sum_j -C_{ij}^m H(p_j^m - p_i^m) = \quad (46)$$

-continued $$\sum_j \mathrm{sgn}(P_{xij}^{m-1})2\delta y\frac{n}{n+1}\frac{(|P_x|_{ij}^{m-1}H-\tau_0)^{\frac{n+1}{n}}}{k^{\frac{1}{n}}(|P_x|_{ij}^{m-1})^2}\left(1-\frac{n+1}{2n+1}\right)\tau_{0,\forall i}$$

where the effective conductivity at the current iteration, $C_{ij}^m$, uses information from the previous iteration, m−1, and is given by:

$$C_{ij}^m = \frac{2n}{n+1}\frac{(|P_x|_{ij}^{m-1}H-\tau_0)^{\frac{n+1}{n}}}{k^{1/n}(|P_x|_{ij}^{m-1})^2} \quad (47)$$

An appropriate expression for $P_{xij}$ can be described. A simple one-dimensional finite difference approximation in terms of the unknown pressures, $p_i^m$, results in the following:

$$p_{xij}^m = (p_j^m - p_i^m)/\Delta x \quad (48)$$

The effective linear properties of each cell may be isotropic. If an approximation analogous to Equation (48) is used, the fluid may develop anisotropy when flowing at an angle to meshlines.

In contrast, the same pressure gradient applied in any direction should result in the same flux. Consequently, the pressure gradient terms from the previous iteration may be included in an isotropic fashion, using an appropriate finite difference template for the pressure gradient. A square-celled finite difference grid of cell side Δx may be introduced as follows:

$$|P_x|_{I,J}^{m-1} = |\nabla P|_{I,J}^{m-1} = \frac{(P_{I+1,J}^{m-1}-P_{I-1,J}^{m-1})^2+(P_{I,J+1}^{m-1}-P_{I,J-1}^{m-1})^2}{4\Delta x^2} \quad (49)$$

with I and J denoting the integer coordinates in the x- and y-directions, respectively. The pressure gradient magnitude used in the estimation of the conductivity between cells i and j uses the average magnitude as follows:

$$|P_x|_{ij}^{m-1} = \frac{|P_x|_{I(i),J(i)}^{m-1}+|P_x|_{I(j),J(j)}^{m-1}}{2} \quad (50)$$

where I(i), J(i) denotes the integer coordinates of cell i. Using this approximation, the contribution each cell makes to the effective conductivity between cells is independent of flow direction.

Computational challenges associated with solving a system of equations such as Equation (46) may be considered. The calculation of the conductivities of Equation (47) and the right-hand-side of Equation (46) involve dividing through by $P_x$. Consequently, as $P_x$ becomes very small, these terms in the system of equations diverge. This may be avoided by introducing a regularization parameter ϵ which scales according to a pressure gradient of the problem as follows:

$$P_x^* = P_x + \epsilon \quad (51)$$

where $$\epsilon = 0.001\frac{\Delta P}{L},$$

$\Delta P$ is the total pressure drop across the fracture, and L is the length of the fracture.

A second challenge to numerical solution is that Equation (46) is only applied between two cells when $|P_x|H>\tau_0$, otherwise the conductivity is zero. Links in the flow network can appear and disappear between iterations, which may lead to algorithmic complexity and convergence issues. Even if there is strictly no flow in reality, an estimate of the local pressure gradient for the purpose of establishing if the cell satisfies $|P_x|H>\tau_0$ or not on subsequent iterations may be provided.

To deal with such issues, a negligible, finite conductivity in parallel with the Herschel-Bulkley term may be introduced. This serves both for regularization and for ensuring that a local estimate of the pressure gradient may be available at all times. This conductivity is scaled with the fracture aperture $\langle h\rangle$ and a fluid viscosity $\langle\mu\rangle$ as follows:

$$C_{min} = \frac{(\alpha\langle h\rangle)^3}{12\langle\mu\rangle} \tag{52}$$

where $\alpha\approx 0.01$. This may introduce a negligible error into the solution for the pressure field while ensuring that a local estimate of the pressure gradient is available within all cells. The iterative procedure presumes the existence of an initial estimate of $P_x$ within each cell of the calculation.

When used within a time-evolving system, an initial guess for each time step can be taken from the previous time step. For the first iteration at t=0 or for instances where a steady-state solution is sought, an initial guess at the pressure field by substituting a Newtonian fluid within the fracture may be made. Being a linear problem, one iteration may be used to obtain a solution at a minimal, incremental computational cost. For convergence criteria, the maximum change in pressure from one iteration to the next may be a small fraction of the maximum pressure in the fracture. In addition, the inlet and outlet flow rates may agree within a user-selected tolerance.

2.3 Model Verification

The nonlinear extension model may be verified (or validated) against analytic and numerical solutions for various geometries.

2.3.1 1-D Test of Linear Flow in a Tapering Fracture

Figure 14:
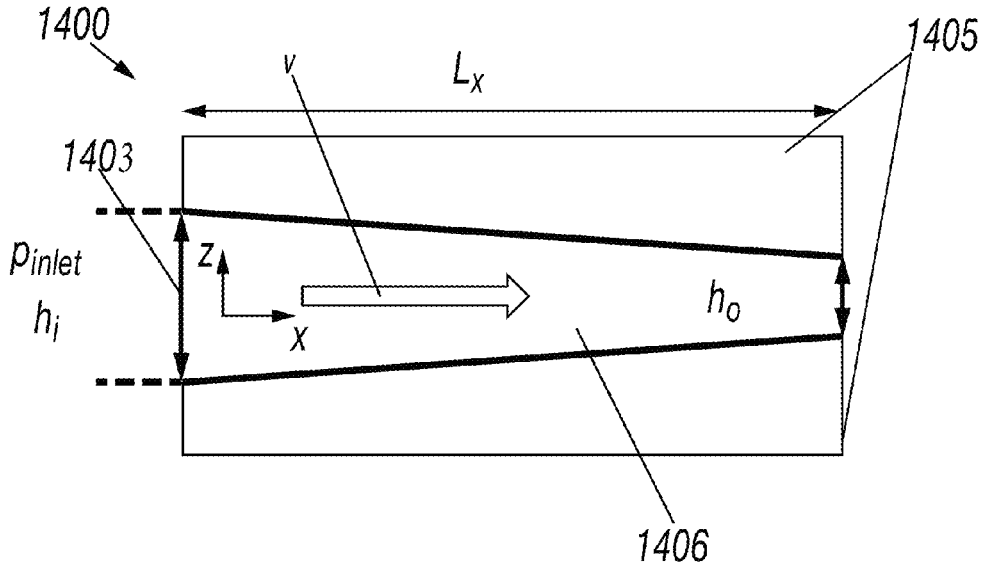
FIG. 14 is a schematic diagram depicting flow through a tapered fracture.

In another example, 1-D flow in a tapering fracture with constant injection rate at the left edge may be considered as show in FIG. 14. FIG. 14 is a schematic diagram 1400 depicting a verification test for uniform, uni-directional flow between convergent plates with constant injection into an inlet 1403. Flow into an inlet $h_i$ at left (x=0) and through a passage 1406 between divergent plates 1405 is depicted. The dimensions of the plates 1405 are depicted as having a length $L_x$, the inlet $h_i$ and an outlet $h_o$.

The fracture (depicted by the opening 1406) is initialized with water and a second fluid is injected at x=0 with constant flux. The local flow velocity (v) increases toward the outlet $h_o$ due to fluid conservation, presenting potential issues for the fluid-front tracking algorithm as the interface between the phases accelerates.

Depending upon the contrast in fluid properties, the inlet pressure, $p_{inlet}$, can change by many orders of magnitude as the second fluid is injected. By matching the timing and magnitude of the evolution in $p_{inlet}$, the interface advection and pressure solver within this idealized variable aperture fracture may be verified.

This configuration may be simulated with a constant injection into the left of the domain (x=0) and zero pressure at the outlet ($x=L_x$) and with hi=0.25 in (0.64 cm) and $h_o$–0.125 in (0.32 cm). A 1-D finite difference simulation may be used to predict the inlet pressure for comparison with the 2-D model. With the 1-D simulation, the injected volume may be calculated and the location of the fluid front that satisfies that injected volume may be found for a given time. The 1-D domain may be discretized and $\partial p/\partial x$ calculated by inverting Equation (45) within each cell, and numerically integrating the inversion from $x=L_x$, where p=0, back to the inlet to obtain $p_{inlet}$.

Table 1 depicts fluid properties for an initial saturating fluid ("Fluid 0") and various injected fluids (Fluids 0-3) as follows:

TABLE 1

| Property | Fluid 0 | Fluid 1 | Fluid 2 | Fluid 3 |
|---|---|---|---|---|
| $\tau$ (Pa) | 0 | 0 | 0 | 13.8 |
| n (—) | 1 | 1 | 0.37 | 0.83 |
| k (Pa · $s^n$) | $5.56 \times 10^{-4}$ | 0.01 | 19.0 | 1.63 |

In an example, simulations were performed with a low viscosity Newtonian fluid filling the fracture (Fluid 0 in Table 1) at t=0 and various Newtonian and non-Newtonian fluids injected at the left edge (Fluids 1 through 3 in Table 1). Fluid 1 is a highly viscous, Newtonian fluid; Fluid 2 is a power-law fluid; and Fluid 3 is a Herschel-Bulkley fluid. The injection rate was 0.172 barrels per minute per 10 foot (0.30 m) of fracture.

Figure 15:
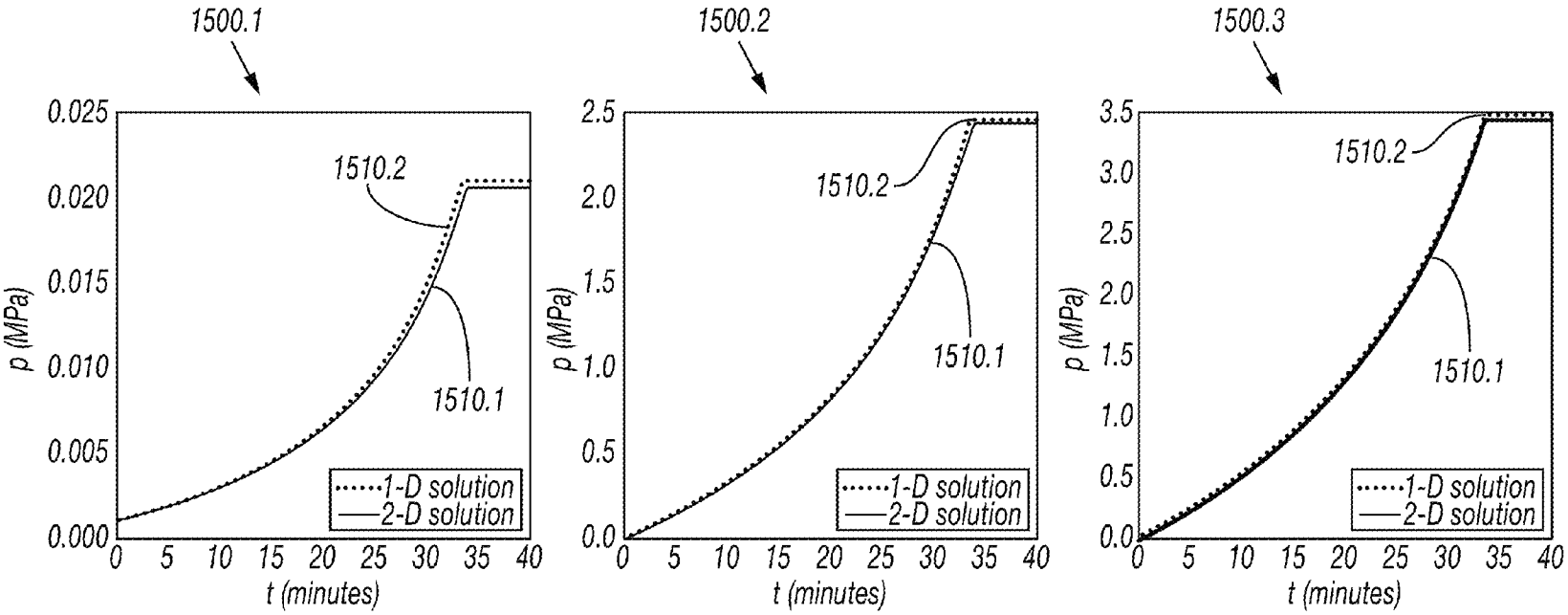
FIGS. 15.1-15.3 are graphs comparing 1-D and 2-D simulations.

Agreement between the two numerical solutions for each of the injected fluids is provided as shown in FIGS. 15.1-15.3. FIGS. 15.1-15.3 are graphs 1500.1-1500.3 depicting pressure (p) (y-axis) versus time (t) (x-axis) for Fluids 1-3 of Table 1, respectively. These graphs show a comparison between the 2-D model and the 1-D numerical solution for injection of the various fluids listed in Table 1.

As shown in each of the graphs 1500.1-1500.3 2-D and 3-D simulations of the fluids are depicted by lines 1510.1 and 1510.2, respectively. While the initial pressure is approximately 1 kPa, the final pressure ranges between approximately one and three orders of magnitude larger, depending upon the fluid properties.

2.3.2 1-D Test of Radial Flow in a Constant Aperture Fracture

Another test case considers radial flow between two parallel plates as shown in FIGS. 16 and 17. FIG. 16 is a schematic diagram 1600 depicting parallel plates 1612 having an inlet 1614 therethrough. This figure provides geometry of a verification test for radially symmetric flow between two parallel plates with constant injection by an injector 1715 into the inlet at a center $C_0$ at at x=0, y=0). Although this scenario as described is radially symmetric, the computational grid (or mesh) is not radially symmetric and may induce anisotropy despite attempts to ensure that fluid properties are isotropic (see Equation (49)).

The 2-D simulation models a portion (e.g., one wing) of the assumed symmetric fracture using the domain described in FIG. 16. FIG. 17 is a schematic diagram 1700 depicting a 2-D computational domain simulating one symmetric half (x>0) of the full fracture domain of inlet 1614' bisected along a plane of symmetry $P_s$ and with injection at centerline $C_0$. The geometry of the inlet 1614' has dimensions $L_y$=290' and $L_x$=145' and a mesh of 100 cells in the vertical and 50 cells in the horizontal direction. Lx=radius r of the circular inlet 1714'.

In these cases, the fracture at inlet 1614' was filled with a low viscosity Newtonian fluid (e.g., Fluid 0 in Table 1) at t=0, and various Newtonian and non-Newtonian fluids (e.g., Fluids 1-3 in Table 1) were injected at the center $C_0$ of left edge at a rate of 5 barrels per minute (corresponding to 10 barrels per minute in the full fracture). To avoid extremely high pressure within a single cell (and any associated convergence issues) the fluid was injected into a region of the mesh 3 cells across.

FIGS. 18.1-18.3 depict three graphs 1800.1-1800.3 showing simulations for each of the Fluids 1-3, respectively, passing through the bisected inlet 1614' of FIG. 17. Each of the three Fluids 1-3 were run out to 200 seconds and the resulting fluid fronts show excellent symmetry as shown in FIGS. 18.1-18.3. These figures show 2-D simulation results at 200 seconds for injection of Fluids of Table 1.

For comparison, a 1-D simulation following the algorithm described in Section 2.3.1 was applied to the same problem. FIGS. 19.1-19.3 depict graphs 1900.1-1900.3 of pressure p (y-axis) versus radius r (x-axis). These graphs 1900.1-1900.3 plot lines showing a comparison of the results of the 1-D with the 2-D simulations for injection of the Fluids 1-3 of Table 1 along the 0°, 45° and 90° directions (see FIG. 17), respectively. As the simulations approach the injector, the simulations capture a singular behavior of the pressure field to differing degrees. In addition, there are minimal differences between pressure fields reported along the three different lines from the injector.

III. Predicting Nonlinear Deformation and Hydraulic Conductivity of Fractures Under Normal Stress This Section III provides another version 2056 of the method of generating proppant parameters 256. As shown in the flow chart of FIG. 20, the method 2056 involves the same features 260, 262, 266, 268 and 269 as previously described. In this version, the predicting 264 aperture change for a prescribed closure stress using the linear asperity model (see, e.g., FIGS. 5.1 and 5.2) has been modified to predict 2064 aperture change using nonlinear deformation. The method 2064 may involve predicting aperture change and conductivity using nonlinear deformation and may be performed using a numerical prediction and/or an analytical approach.

Numerical predictions may be made using numerical models including spatial distribution of variations in aperture. Such predictions may be used to predict the evolution of fracture closure and hydraulic conductivity under stress. Analytic predictions may also be made by holding open deformation and conductivity of fractures by either natural (roughness) or artificial (e.g., proppant) mechanisms.

The analytic approach seeks to honor the geometry of connectivity of the channels within the fracture while providing an efficient solution for fracture closure and fracture conductivity. In addition, the analytic approach seeks to captures nonlinear effects due to stiffening of the material holding the fracture open as well as the development of additional contact points within the channels.

Fracture conductivity may be determined 266 as previously described, and/or as described further below in Section IV below. The method may be validated (verified) 269 as previously described, or as further described in Section V below. Validation 269 may involve, for example, comparison with numerical and analytic solutions to demonstrate good multi-threaded performance.

As described herein, nonlinear stiffening of the asperities, such as would capture the compaction of proppant material and accommodate strongly nonlinear pillar constitutive laws, may be considered using computational framework for pillars and channels between two half-spaces.

The development of an accurate and efficient numerical model for predicting the deformation and conductivity of either natural or artificially propped fractures is provided. This is achieved by leveraging two internal representations of the pillars/channels within the fracture as: 1) a fine grid for flow simulation to avoid spurious creation or destruction of channels, and 2) a simplified cylindrical pillars to efficiently predict the mechanical changes in aperture.

The deformation model predicts both the reduction of fracture aperture and the nonlinear redistribution of stress due to pinch-points developing in the channels between pillars. The deformation model achieves a rapid solution through simplifications to the fracture geometry and through application of a preconditioner that reduces the number of iterations required. Fracture conductivity may be calculated on a Cartesian grid using the original distribution of aperture with changes in aperture prescribed according to the results of the mechanical model.

Examples indicate verification of the behavior of the code against both analytic results and another simulator. The performance of the method may permit simulation of many hundreds of pillars/channels within many fractures in seconds. Comparisons with the higher fidelity model indicate the nonlinear extension model predicts the average aperture to within 5-10% and conductivity to within a factor of 2-4. The nonlinear extension model may be used to provide efficiency, and to facilitate more extensive parameter studies. Nonlinearity in the constitutive model of the pillars within a fracture including potential pillar spreading may also be provided. Future applications of the method may consider nonlinearity due to spreading and compaction of weak proppant pillars and embedment of proppant in weak formations.

3.1 Introduction

The hydraulic conductivity of fractures under stress may be of interest for a range of applications. For example, in geothermal settings, the deformed state and associated hydraulic conductivity of natural and hydraulically-induced fractures at depth may be predicted. Examples of prediction are provided by R. Jung, Goodbye or Back to The Future, in Effective And Sustainable Hydraulic Fracturing, Proceedings of the International Conference For Effective and Sustainable Hydraulic Fracturing (HF2013), InTech, pp. 95-121, Brisbane, Australia, May 20-22 (2013), the entire contents of which is hereby incorporated by reference herein.

In the context of gas storage, precipitation and dissolution of minerals within natural fractures, along with evolving effective stress state, can lead to changes in the conductivity of potential leakage pathways. See, e.g., J. P. Morris, J. W. Johnson, Predicting The Long-Term Evolution Of Fracture Transport Properties in Co2 Sequestration Systems, US Rock Mechanics/Geomechanics Symposium, pp. ARMA 11-399, June 26-29, San Francisco (2011) (referred to herein as "Morris (2011))," the entire contents of which is hereby incorporated by reference herein.

In addition, artificial components, such as proppant, may be introduced into hydraulic fractures in order to maintain conductivity under stress. See, e.g., L. R. Kern, T. K.

Perkins, R. E. Wyant, The Mechanics Of Sand Movement In Fracturing, Transactions of the American Institute of Mining and Metallurgical Engineers 216 403-405 (1959); and C. Montgomery, Fracturing Fluids, Proceedings Of The Int'l Conf. For Effective And Sustainable Hydraulic Fracturing (HF2013), InTech, pp. 3-24, Brisbane, Australia, May 20-22 (2013), the entire contents of which are hereby incorporated by reference herein.

Further, some classes of proppant placement technology may involve attempting to induce heterogeneity in the arrangement of the proppant in order to create open flow channels within the propped fracture (heterogeneous proppant placement). See, e.g., A. Medvedev, K. Yudina, M. K. Panga, C. C. Kraemer, A. Pena, On The Mechanisms Of Channel Fracturing, SPE 163836; and J. P. Morris, N. Chugunov, G. Meouchy, Understanding Heterogeneously Propped Hydraulic Fractures Through Combined Fluid Mechanics, Geomechanics, And Statistical Analysis, 48th U.S. Rock Mechanics/Geomechanics Symposium, Minneapolis, pp. 2014-7408, June 1-4, (2014) (referred to herein as "Morris (2014)"), the entire contents of which are hereby incorporated by reference herein.

Whether natural or engineered, the fracture conductivity may be dominated by induced channelization within the fracture either due to the spatial distribution of aperture (in the case of natural fractures) or heterogeneity in the distribution of proppant (in the case of proppant placement during hydraulic fracturing). For example, both experimental and modeling studies indicate that individual natural fractures exhibit an evolving network of channels under stress. See: L. J. Pyrak-Nolte, L. R. Myer, N. G. W. Cook, P. A. Witherspoon, Hydraulic And Mechanical Properties Of Natural Fractures In Low Permeability Rock, G. Herget, S. Vongpaisal (Eds.), Proceedings of the Sixth International Congress on Rock Mechanics, Rotterdam: Balkema, 1987, pp. 225-231, Montreal, Canada, August 1987; and L. Pyrak-Nolte, J. Morris, Single fractures under normal stress: The relation between fracture specific stiffness and fluid flow, Int'l Jnl. of Rock Mechanics and Mining Sciences, 37 245-262 (2000) (referred to herein as "Purak-Nolte (2000)"), the entire contents of which are hereby incorporated by reference herein.

Observations of reactive transport in variable aperture fractures may also indicate that dissolution-induced aperture changes can lead to channels that dominate the conductivity of the fracture. See, e.g., R. L. Detwiler, R. J. Glass, W. L. Bourcier, Experimental Observations Of Fracture Dissolution: The Role Of Peclet Number On Evolving Aperture Variability, Geophys. Res. Lett, 30 (12) 1648 (2003), the entire contents of which is hereby incorporated by reference herein. Pumping parameters may control the presence or absence of channels within the proppant pack that dominate the performance of heterogeneous proppant placement techniques. See, Morris (2011).

Solutions may be developed for the detailed deformation of fractures taking into account the spatial distribution of material within the fracture. In some cases, a fracture with two parallel half-spaces separated by a spatial distribution of contacting points may be considered. See, e.g., J. A. Greenwood, J. B. P. Williamson, Contact Of Nominally Flat Surfaces, Proceedings of the Royal Society of London. Series A, Mathematical and Physical Sciences 295 (1442) (1966) 300-319; and S. Brown, C. Scholz, Closure Of Random Elastic Surfaces In Contact, Jnl. Of Geophysical Research-Solid Earth And Planets 90 5531-5545 (1985), the entire contents of which is hereby incorporated by reference herein.

In some cases, the contact regions as deformable pillars and including the interaction between the pillars may be treated by allowing each of the half-spaces to deform about the pillars. See, e.g., D. L. Hopkins, The Effect Of Surface Roughness on Joint Stiffness, Aperture, And Acoustic Wave Propagation, Ph.D. Thesis, University of California at Berkeley (1990) (referred to herein as "Hopkins (1990)"), the entire contents of which is hereby incorporated by reference herein.

The solutions may also involve considering a regular grid of small contact elements (referred to as asperities) and exploiting fast multipole methods. See, e.g., Purak-Nolte (2000). A combination of boundary elements may be used to simulate the rock matrix deformation with an asperity mechanical model to capture the detailed geometry and mechanical response of an arbitrary combination of pillars and channels. See, e.g., Purak-Nolte (2000) and Morris (2011). The deformation of mineralized pillars (see, e.g., Morris (2011)) and heterogeneous arrangements of proppant within a fracture (Morris 2014) may also be considered.

Deformation of natural channels within a variable aperture fracture may be predicted using an asperity model. See, e.g., Pyrak-Nolte (2000). In some cases, simulations may involve extensive computational requirements when considering highly subdiscretized pillars/channels. In some cases, simulations may be provided with increased computational efficiency where the number of pillars and associated channels remains small. See, e.g., Hopkins (1990). Additional computational burden may be imposed in methods involving the use of a large number of asperities to sub-discretize the individual physical pillars and channels. More pillars and channels may lead to increased reliability of the model. In some cases, if too coarse a representation is utilized for the discretization of the fracture, the connectivity of the flow field may be altered by the incidental introduction of numerical artifacts that either create or remove channels from the model. Because the presence or absence of channels may affect hydraulic conductivity, changes in flow geometry may affect the predicted flow field within the fracture.

To provide a balance between increased computational burden and a need for resolution, a nonlinear extension approach may be used. As the resolution is increased, geomechanical calculations may use a majority of computational effort and the increased resolution may be needed for an accurate conductivity calculation. The hybrid approach involves solving the geomechanical deformation on a relatively coarse grid, while conductivity is calculated using a more refined discretization. The hybrid approach seeks to respect the geometry and connectivity of channels within the fracture (either natural or artificial), while changes in aperture due to stress are also included such that, for the same amount of computational effort, many more channels can be included within a single computation.

Asperity models may be used involving a linear elastic constitutive response for the asperities. See, e.g., Pyrak-Nolte (2000), Morris (2011), and Morris (2014). Extensions to the models may be provided to allow for elastic, perfectly plastic behavior and/or to address material failure. See: P. Ameli, J. E. Elkhoury, J. P. Morris, R. L. Detwiler, Fracture Permeability Alteration Due to Chemical And Mechanical Processes: a Coupled Highresolution Model, Rock Mech Rock Eng., DOI 10.1007/s00603-014-0575-z (2014); and E. A. Ejofodomi, G. Cavazzoli, J. Morris, R. Prioul, Application Of Channel Fracturing In The Vaca Muerta Shale Formation, SPE Latin American and Caribbean Petroleum Engr. Conf., pp. 169383—MS, Maracaibo, Venezuela, 21-23 May (2014), the entire contents of which is hereby incorporated by reference herein.

3.1.1 The Nonlinear Extension Method

Figure 20:
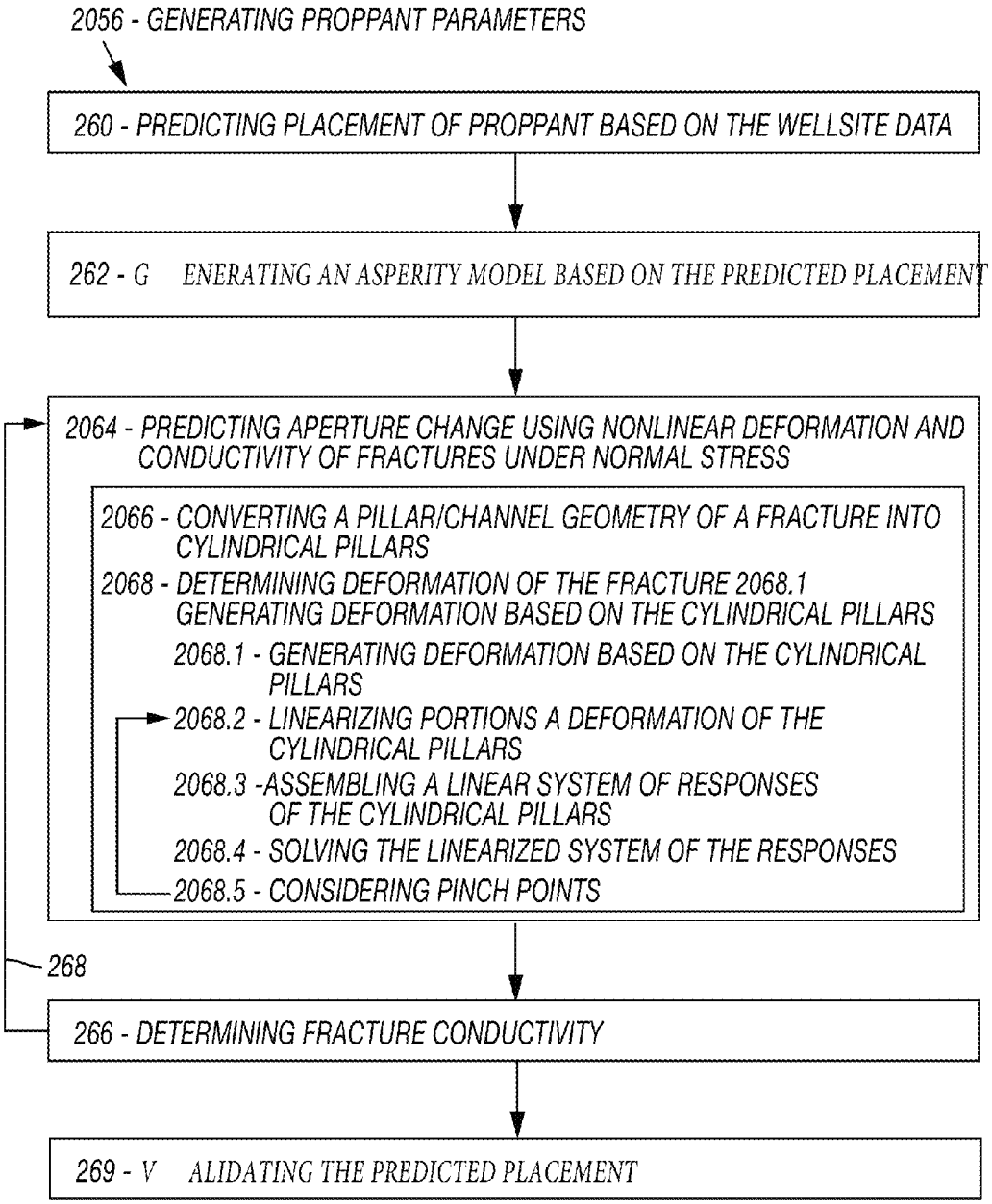
FIG. 20 is a flow chart depicting another method of generating proppant parameters.

This nonlinear extension method may be similar to the nonlinear method of FIG. 5.2, except that the method of FIG. 20 provides further detail on nonlinear deformation. As set forth in the Sections below, the 2064 predicting aperture change and conductivity using nonlinear deformation involves converting 2066 the pillar/channel geometry into a simplified approximation, such as a cylindrical pillars or cylindrical representation (see Section 4.3), and determining 2068 deformation of the fracture (see Section 4.4).

The converting 2066 may be performed using a mechanical approach involving pillar geometry, or using an analytical approach involving a cylinder approximation projection onto a Cartesian grid. The determining 2068 may be performed by generating deformation 2068.1 based on the cylindrical pillars (see Section 3.4.1), linearizing 2068.2 portions of the deformation of cylindrical pillars (see Section 3.4.2), assembling 2068.3 a linear system of responses of the cylindrical pillars (see Section 3.4.3), and considering 2068.4 pinch-points (see Section 3.4.4). The fracture conductivity 266 may then be determined (see Section IV). For additional pinch-points, the linearizing 2068.2, assembling 2068.3, and solving 2068.4 may be repeated.

For a fracture with a local coordinate system x, y, spanning $0 \le x \le L_x$ and $0 \le y \le L_x$, the detailed geometry of the pillars/channels characterizing the variable topography of a rough fracture or the packed spatial distribution of proppant within the fracture is assumed to be provided (see, e.g., FIGS. 7.1 and 7.2). The method approximates the detailed pillar geometry with a smaller number of coarse, cylindrical pillars for the purpose of accelerating the geomechanical calculation. A higher fidelity Cartesian grid may be used determine conductivity (see Section IV below).

The method proceeds by progressively adding stress to the fracture in order to smoothly approach the requested stress level. Within each stress increment, the estimate, represented by a nonlinear system of equations, is linearized (see Section 3.4.2) to obtain an iterative solution to the linear system, and to identify points of contact ("pinch-points") (see Section 3.4.4 below). After the target stress state is reached, the final fracture aperture and conductivity is calculated (see Section IV below).

3.2 Conversion from Cartesian Grid to Cylindrical Representation

The accuracy of the conductivity prediction depends on the presence or absence of channels within the heterogeneous distribution of proppant or natural roughness. To accelerate the geomechanical calculation, relatively few, simple computational elements (cylindrical pillars) are used. In the process of approximating the channel geometry with coarser pillars, spurious channels may be introduced or removed.

Figure 21:
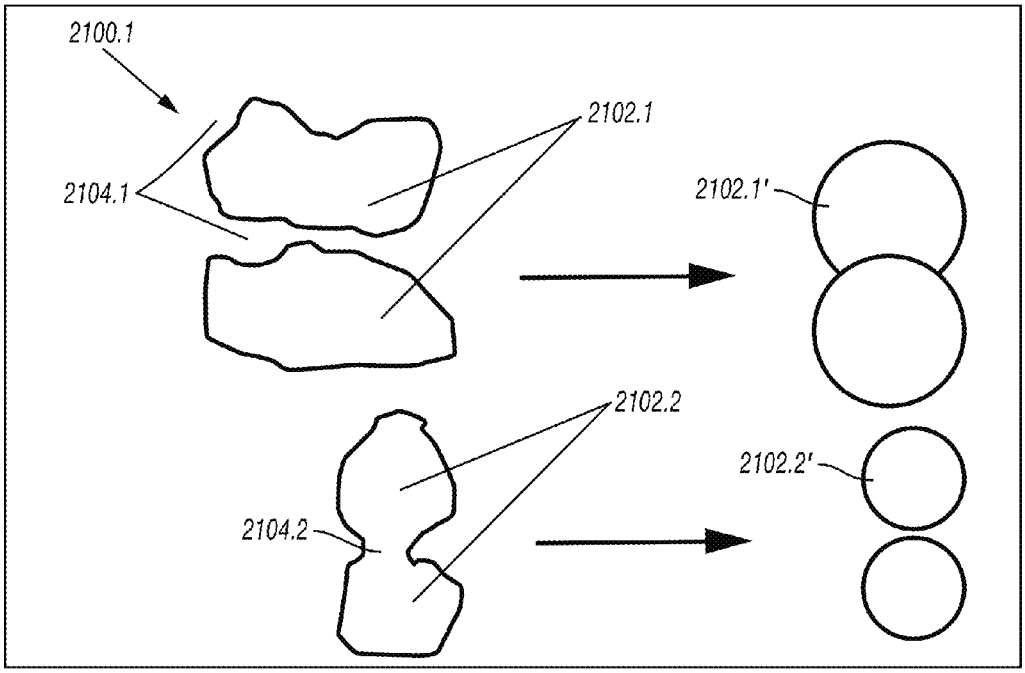
FIGS. 21 and 22 are schematic diagram depicting cylindrical representations by various models.
Figure 22:
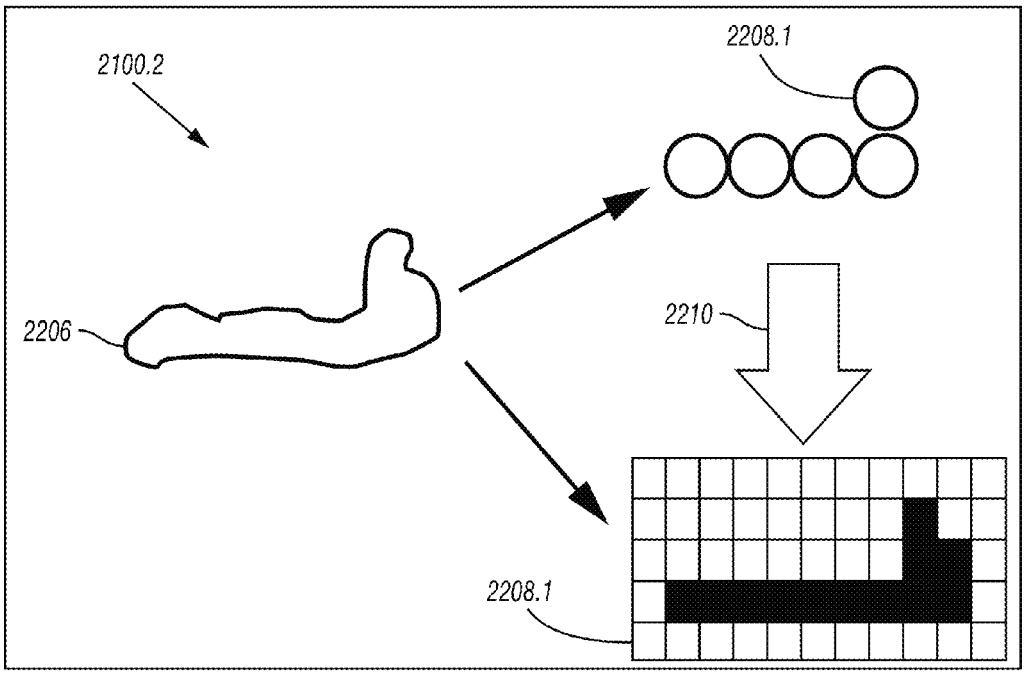

FIGS. 21 and 22 are schematic diagrams depicting models 2100.1, 2100.2 lacking a channel and adding a channel, respectively. These figures present two scenarios where the conversion to cylinders may introduce errors into the conductivity estimation. In the example of FIG. 21, the initial pillar geometry includes pillars 2102.1 containing a narrow channel 2104.1 that is removed in the conversion to a cylindrical representation 2102.1'.

In the example of FIG. 22, the initial pillar geometry includes two neighboring pillars 2102.1 with a neck of material 2104.2 spanning the gap between them. The conversion to cylindrical approximation 2102.2' removes the material 2104.2 from the gap, creating a spurious channel.

Changes in the flow network spanning a fracture can lead to many orders of magnitude change in the conductivity prediction. To avoid the spurious creation or removal of channels within the conductivity calculation, representations of the distribution of material within the fracture are utilized.

FIG. 22 is a schematic diagram depicting a model using multiple internal representations of pillars/channels. A true (arbitrary) proppant pillar shape 2206 is provided. An approximation with cylinders 2208.1 and a projection onto a Cartesian (flow) grid 2208.2 are generated. The cylinder approximation 2208.1 may be a fast geomechanical representation. The projection 2208.2 may be a conductivity representation that honors geometry and/or channels.

The multiple internal representations include a mechanical representation that makes simplifying assumptions regarding the pillar/channel geometry (i.e.: cylinders) in order to achieve a rapid solution, and an analytical representation using a Cartesian grid to capture the pillar/channel geometry as accurately as possible for the conductivity calculation. The mechanical representation may involve making simplifying assumptions regarding the spatial distribution of the pillars and their geometry in order to achieve a rapid solution. The analytical representation may use a more detailed grid to capture the channel geometry as accurately as possible for the conductivity calculation.

Figure 23:
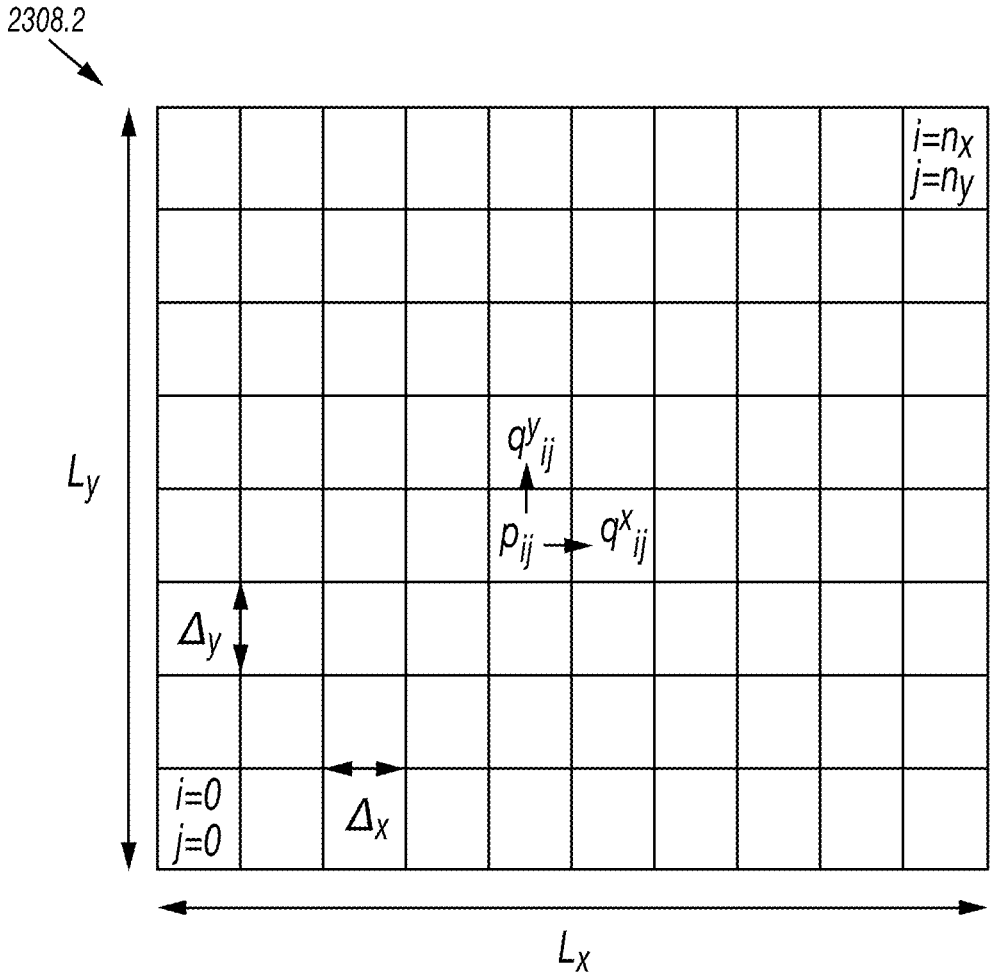
FIG. 23 is a Cartesian grid with pressure depicted thereon.

As indicated by arrow 2210, changes in aperture may be communicated from the geomechanical representation 2208.1 to the Cartesian grid 2208.2. Changes in aperture predicted by the geomechanical calculation may be communicated to the Cartesian grid as shown in the schematic diagram of FIG. 23. The Cartesian grid 2202 defines a plurality of rectangles (called cells), each having a width $\Delta x$ and a length $\Delta y$ The overall dimensions of the grid are $L_x$ by $L_y$ and with each cell having a pressure $p_{ij}$ with fluxes $q_{ij}^x$ and $q_{ij}^y$. As shown in FIG. 23, the Cartesian grid 2208.2 may be used for calculating fluid flow. Pressures $p_{ij}$ are cell-centered, while fluxes $q_{ij}^x$ and $q_{ij}^y$ are face-centered. In this way, the mechanical deformation may be predicted without introducing changes to the channel connectivity.

3.3 Prediction of Fracture Deformation

Fracture deformation 2068 may be performed using the techniques described with respect to the method of FIG. 5.2. For example, the fracture deformation 2068 may be involve determining 582 cylinder and half-space deformation consistent with applied stress, and/or an extension thereof.

3.3.1 Deformation Model for Cylindrical Pillars

It may be assumed that the detailed channel distribution has been approximated by a given number of pillars with locations ($x_i$, y') and initial radii (4) within this fracture (e.g., provided directly as input or via the conversion from the detailed geometry). The linear response of such a set of pillars to a prescribed stress may be considered. See, e.g., of Hopkins (1990). A more general approach that includes nonlinear deformation of the pillars may also be considered.

Given a prescribed closure stress $\sigma_n$ for a fracture of dimensions $L_x$ and $L_y$ as shown in FIG. 23, a resultant deformation of the fracture faces and pillars may be predicted. A total normal force, $F_n$, applied to the fracture may be provided as follows:

$$F_n = \sigma_n L_x L_y \tag{53}$$

Each pillar, I, carries its portion of the force, $f_I$, such that:

$$\Sigma_I f I = Fn \tag{54}$$

The surrounding formation may be modeled with two half-spaces. It is also assumed that both the pillars and formation can deform nonlinearly to capture combinations of elastic and plastic effects. To simplify the calculation, that nonlinear effects in the formation are assumed to be localized to a zone that is comparable to the initial aperture of the fracture. Consequently, the far-field interactions between the pillars may be taken to be linearly elastic. The localized nonlinear deformation of the formation at pillar I and the deformation of pillar I itself are lumped into a deformed height of pillar $l_I$. The height, $l_I$, and radius, $\alpha_I$, of the pillars may be a function of the force carried by the pillar as follows $$l_I = l_I(f_I) \tag{55}$$

$$\alpha_I = \alpha_I(f_I) \tag{56}$$

These functions may be different for each pillar due to variations in either the pillar heights or material heterogeneity within the fracture.

Under closure stress, the average deformed height of each individual pillar, $l_I$, may be consistent with an average aperture of the fracture at the location of the pillar. This may be expressed by a system of displacement compatibility equations as follows:

$$D + \Sigma_J w_{IJ} = l_I, \forall i \tag{57}$$

where the local aperture is the sum of the unperturbed half-space gap, D, and the contributions to the local deformation due to forcing from all pillars. The quantity D is the separation of the elastic half-spaces in the absence of any pillars to hold them apart. As D is decreased, the forces induced upon the pillars increase. The value of D that induces the prescribed level of stress within the fracture is to be found.

The functional form of $l_I(f_I)$ that models the potentially nonlinear behavior of the pillars is assumed. This term may also include nonlinearity due to local inelastic deformation of the formation under the pillar. It is assumed that the influence terms, $w_{IJ}$ are approximated using elastic solutions for the deformation of a half-space. The self-influence term, $w_{II}$ represents the average additional aperture due to the distribution of force under asperity I. The average deformation is sensitive to the total force, $f_I$, applied to the pillar, and the spatial distribution of that force across the surface of the pillar.

The average displacement under a circle with uniform distribution of stress, $\bar{u}_I^S$, is represented as follows:

$$\bar{u}_I^S = \frac{16}{3\pi^2}\frac{(1-\nu^2)}{Ea_I}f_I \tag{58}$$

where E is the Young's modulus and v is the Poisson ratio. The average displacement under a rigid circular punch, $\bar{u}_I^U$, is provided as follows:

$$\bar{u}_I^U = \frac{1}{2}\frac{(1-\nu^2)}{Ea_I}f_I \tag{59}$$

See: K. Johnson, Contact Mechanics, ninth printing 2003 ed., Cambridge University Press, 1985 (referred to herein as "Johnson (1985)").

The change in aperture due to displacement of the two surfaces is double that of the displacement of the individual surfaces and can be written as follows:

$$\omega_{II} = \beta\frac{(1-\nu^2)}{Ea_I}f_I \tag{60}$$

where β is 1 for the case of a rigid pillar and $32/3\pi^2 \approx 1.081$ for the case of uniform loading of the pillar. Except where otherwise noted, β=1.

An approximation for $w_{IJ}$ for the case of I≠J may also be provided. Because details of precise distribution of stress under each pillar is not required, an approximate deflection outside the footprint of the pillar by that due to a point load may be used. The deflection of an elastic half-space due to a point normal load, $f_J$ is provided as follows:

$$u_z(r) = \frac{f_J}{4\pi G}\frac{2(1-\nu)}{r} = \frac{(1-\nu^2)}{\pi E r}f_J \tag{61}$$

where G is the shear modulus of the formation. See Johnson (1985). Consequently, $w_{IJ}$ may be approximated using a sum of the deflection of two half-spaces due to a point normal load, $f_J$ at the location of pillar I using the following:

$$w_{IJ} = \frac{2(1-\nu^2)}{\pi E r_{IJ}}f_J, \text{ for } I \neq J \tag{62}$$

where $$r_{IJ} = \sqrt{(x_I - x_J)^2 + ((y_{IJ} - y_J)^2)} \tag{63}$$

Note that Equation (62) is identical to the far-field influence reported in an equation by Pyrak-Nolte (2000):

$$w_{IJ} = W_{IJ} f_J \tag{64}$$

where $$W_{IJ} = \begin{cases} \beta\dfrac{(1-\nu^2)}{Ea_I}, & \text{if } I = J \\ \dfrac{2(1-\nu^2)}{\pi E r_{IJ}}, & \text{if } I \neq J \end{cases} \tag{65}$$

The displacement compatibility Equation (57) becomes:

$$D + \Sigma_J W_{IJ} f_J = l_I(f_I), \forall I \tag{66}$$

subject to the constraint on total stress as described by Equation (54). Equation (66) is potentially nonlinear in $f_J$, depending upon the functional form of the $l_I$. In addition, the $W_{II}$ terms include $a_I$, which may also be a function of $f_I$.

3.3.2 Linearization of Functional Forms for L and F/A

The $l_I$ term on the right-hand side of Equation (66) and the $f_I/a_I$ term in $w_{II}$ introduce $f_I$ implicitly. Consequently, $l_I$ and $f_I/a_I$ may be expanded as follows:

$$l_I = l_I^0 + C_{lI}(f_I - f_I^0) \tag{67}$$

$$\frac{f_I}{\alpha_I} = \frac{f_I^0}{a_I^0} + C_{fal}(f_I - f_I^0) \tag{68}$$

$C_{lI}$ is a constant that captures the linear dependence of pillar width change with stress and the superscript 0 indicates some reference state. $C_{faI}$ is a constant that can be obtained through expansion of $f_I/a_I$ using the initial slope of $a_I$. This may be rewritten as follows:

$$\begin{aligned}\frac{f_I}{a_I} &= \frac{f_I^0+\Delta f_I}{a_I^0+\Delta a_I} \\ &= \frac{f_I^0 1+\frac{\Delta f_I}{f_I^0}}{a_I^0+\frac{\Delta a_I}{a_I^0}} \\ &\approx \frac{f_I^0}{a_I^0}\left(1+\frac{\Delta f_I}{f_I^0}\right)\left(1-\frac{\Delta a_I}{a_I^0}\right) \\ &\approx \frac{f_I^0}{a_I^0}\left(1+\frac{\Delta f_I}{f_I^0}-\frac{\Delta a_I}{a_I^0}\right) \\ &\approx \frac{f_I^0}{a_I^0}+\frac{\Delta f_I}{a_I^0}-\frac{f_I^0}{a_I^{02}}\Delta a_I \\ &\approx \frac{f_I^0}{a_I^0}+\frac{\Delta f_I}{a_I^0}-\frac{f_I^0}{a_I^{02}}\frac{da_I}{df}\bigg|_{f=f_I^0}\Delta f_I \\ &\approx \frac{f_I^0}{a_I^0}+\Delta f_I\left(\frac{1}{a_I^0}-\frac{f_I^0}{a_I^{02}}\frac{da_I}{df}\bigg|_{f=f_I^0}\right)\end{aligned} \tag{69}$$

and, comparing with Equation (68) provides the following:

$$C_{fa_I} \approx \frac{1}{a_I^0}\left(1-\frac{f_I^0\frac{da_I}{df}\Big|_{f=f_I^0}}{a_I^0}\right) \tag{70}$$

where the initial slope of $a_I$ may be obtained via experiment or some other analysis. In the frequently assumed linear elastic case, the pillars may not spread and, consequently, da/df=0 and $C_{faI}=1/a^0_I$. Equation (66) may be rewritten as follows:

$$D+\sum_{J\neq I} W_{IJ} f_J \approx \frac{(1-\nu^2)}{E}\left\{\frac{f_I^0}{a_I^0}+C_{fa_I}(f_I-f_I^0)\right\} = l_I^0 + C_{II}(f_I-f_I^0) \tag{71}$$

The solution for the change in force and far-field displacements may be iteratively considered as follows:

$$\Delta D = D - D^0 \tag{72}$$

$$\Delta f_I = f_I^0 \tag{73}$$

under increasing stress where the superscripted 0 refers to the solution from the previous stress state, Equation (66) may be rewritten as follows:

$$\Delta D+\sum_{J\neq I} W_{I,J}\Delta f_J + \left\{\beta\frac{(1-\nu^2)}{E}C_{faI}-C_{II}\right\}\Delta f_I\Bigg| = l_I^0 - D^0 - \beta\frac{(1-\nu^2)}{E}\frac{f_I^0}{a_I^0} - \sum_{J\neq I} W_{I,J} f_J^0 \tag{74}$$

Consequently, the linear system may be solved as follows:

$$\sum_I \Delta f_I = \Delta F_n \tag{75}$$

$$\sum_J B_{IJ}\Delta f_J + \Delta D = c_I \tag{76}$$

for the unknown $\Delta f_I$ and $\Delta D$ where:

$$B_{IJ} = \begin{cases} \beta\frac{(1-\nu^2)}{E}C_{faI}-C_{iI}, & \text{if } I=J \\ W_{IJ}=\frac{2(1-\nu^2)}{\pi E r_{i,J}}, & \text{if } I\neq J \end{cases} \tag{77}$$

and $$c_I = l_I^0 - D^0 - \beta\frac{(1-\nu^2)}{E}\frac{f_I^0}{a_I^0} - \sum_{J\neq I} W_{IJ} f_J^0 \tag{78}$$

For the case of a linear elastic pillar, the $C_{II}$ can be related back to the longitudinal modulus, $M_I$, of the pillar. The definition of M provides the following:

$$\sigma_{nI}=M_I\epsilon_{nI} \tag{79}$$

where $$\sigma_{nI} = \frac{f_I}{\pi a_I^2} \tag{80}$$

$$\epsilon_{nI} = \frac{l_I^0 - l_I}{l_I^0} \tag{81}$$

Combining these equations provides the following:

$$l_I^0 - l_I = l_I^0\epsilon_{nI} = l_I^0\frac{\sigma_{nI}}{M_I} = \frac{l_I^0}{M_I\pi a_I^2}f_r \tag{82}$$

and, comparing with Equation (67) provides the following:

$$C_{II} = -\frac{l_I^0}{M_I\pi a_I^2} \tag{83}$$

specifically for the case of a linear elastic pillar. The method provided herein remains general and considers the nonlinear case.

3.3.3 Solving the Linearized System

Within each nonlinear stress increment step, an iterative solution is provided utilizing solutions from the previous nonlinear step as the initial guess for the solution of each subsequent iteration. The system of equations described by Equation (76) may be considered dense and with reduced conditioning. The equations may be normalized such that all entries are of similar magnitude. Assume n pillars are provided, numbered 0 through n−1, then n+1 simultaneous equations are generated as follows:

$$\sum_{j=0}^{n} A_{IJ} x_J = b_I \tag{84}$$

where the following is defined $$x_0 = \Delta D \tag{85}$$

$$x_I = \Delta f_{I-1}/C, \text{ for } I=1, \ldots, n \tag{86}$$

where $$C = \frac{n}{\sum_{I=0}^{n-1} B_{II}} \tag{87}$$

and $$b_I = c_{I+1}, \text{ for } I=0, \ldots, (n-1) \tag{88}$$

$$b_n = F_n/C \tag{89}$$

and $$A_1 0 = 1, \text{ for } I=0, \ldots, (n-1) \tag{90}$$

$$A_{I(J+1)} = CB_{IJ}, \text{ for } I=0, \ldots, (n-1), J=0, \ldots, (n-1) \tag{91}$$

$$A_{n0} = 0, \tag{92}$$

$$A_{n(J+1)} = 1, \text{ for } J=0, \ldots, (n-1) \tag{93}$$

In this way, the magnitude of the dominant terms in each line of the linear equations may be of order 1. In practice, the self-contributions, $B_{II}$, are larger than the other $B_{IJ}$ that represents cross-interactions between the pillars.

For example, if all pillars have identical properties, then $CB_{II}=1$. If the other $CB_{IJ}$ entries are denoted by $\epsilon$, the following matrix with ones (1s) at the following locations is provided:

$$A = \begin{vmatrix} 1 & 1 & \epsilon & \epsilon & \ldots & \epsilon & \epsilon \\ 1 & \epsilon & 1 & \epsilon & \ldots & \epsilon & \epsilon \\ 1 & \epsilon & \epsilon & 1 & \ldots & \epsilon & \epsilon \\ \vdots & \vdots & \vdots & \vdots & \vdots & \vdots & \vdots \\ 1 & \epsilon & \epsilon & \epsilon & \ldots & \epsilon & 1 \\ 0 & 1 & 1 & 1 & \ldots & 1 & 1 \end{vmatrix} \tag{94}$$

The asymmetry introduced by the additional equation for force balance, leads to a matrix with limited conditioning. Consequently, a suitable preconditioner, P, is developed such that $P^{-1}A$ has a lower condition number than A. Because the terms are small, a preconditioner is obtained by choosing the following:

$$P = \begin{vmatrix} 1 & 1 & 0 & 0 & \ldots & 0 & 0 \\ 1 & 0 & 1 & 0 & \ldots & 0 & 0 \\ 1 & 0 & 0 & 1 & \ldots & 0 & 0 \\ \vdots & \vdots & \vdots & \vdots & \vdots & \vdots & \vdots \\ 1 & 0 & 0 & 0 & \ldots & 0 & 1 \\ 0 & 1 & 1 & 1 & \ldots & 1 & 1 \end{vmatrix} \tag{95}$$

with the corresponding inverse as follows:

$$P^{-1} = \begin{vmatrix} 1/n & 1/n & 1/n & \ldots & 1/n & 1/n & -1/n \\ (n-1)/n & -1/n & -1/n & \ldots & -1/n & -1/n & 1/n \\ -1/n & (n-1)/n & -1/n & \ldots & -1/n & -1/n & 1/n \\ \vdots & \vdots & \vdots & \vdots & \vdots & \vdots & \vdots \\ -1/n & -1/n & -1/n & \ldots & (n-1)/n & -1/n & 1/n \\ -1/n & -1/n & -1/n & \ldots & -1/n & (n-1)/n & 1/n \end{vmatrix} \tag{96}$$

An iterative solution to the preconditioned system may be provided as follows:

$$P^{-1}A = P^{-1}b \tag{97}$$

using a biconjugate gradient stabilized method. See, e.g., H. A. van der Vorst, Bi-cgstab: A Fast And Smoothly Converging Variant of Bi-Cg For The Solution Of Nonsymmetric Linear Systems, SIAM J. Sci. Stat. Comput. 13 (2) 631644, doi:10.1137/0913035 (1992), the entire contents of which is hereby incorporated by reference herein.

3.3.4 Pinch-Point Algorithm

Pinch-points may be added using the techniques described with respect to FIG. 5.2 and/or as further described in this section. For each additional pinch-point detected, portions of the methods 256 of FIG. 5.2 and/or 2056 of FIG. 20 may be repeated.

As the stress applied to the channels within the fracture is increased, it is possible for fracture surfaces within the open channels to make contact at "pinch-points." The presence of such pinch-points may reduce the conductivity within the fracture. Such pinch-points may also carry stress, leading to nonlinearity. If the stress carried by the pinch-points is neglected, the pillars alone carry the load, and the channels may close prematurely. At high stress levels, fractions of the total load may be taken up by such pinch-points. As a consequence, methods that neglect pinch-point mechanics may underestimate the conductivity of the stressed fracture.

Pinch-point mechanics may be accommodated by treatment as virtual pillars that are introduced into the stress calculation if contact is detected at their location. At the start of the calculation, a list of potential pinch-points to be monitored on a regular grid may be identified. The spacing of the pinch-points may be chosen automatically based upon the size of the pillars (e.g., sized such that 5 pinch-points span the average pillar size). Any candidate pinch-points that happen to fall within an existing pillar may be deleted from the list. The pinch-point mechanics may involve creating a list of pinch-points, incrementally providing stress, determining deformation 2068 with the list of pinch-points, adjusting (e.g., adding/removing) pinch-points, remove any pinch-points found to be in tension, sorting a list of points of overlap from largest to smallest, adding a portion of locations at the points of overlap to the list of pinch-points in order of greatest overlap to smallest overlap, repeating the incrementally providing stress until the target stress level is reached. The pinch-point mechanics proceeds by repeating the 2068.2 linearizing, 2068.3 assembling, and 2068.4 solving (see, e.g., Section 3.4.2 above) for each pinch-point.

IV. Determining Fracture Conductivity

The fracture conductivity may be determined 266 as described with respect to FIGS. 2-6. These approaches involve obtaining the deformed pillar states ($l_I$, $a_I$, $f_I$) and the resultant deformed fracture aperture at a set of arbitrary points within the fracture. A means for determining 266 the hydraulic conductivity of the deformed fracture (FIG. 20) may also involve solving flow in the fracture using fully 3-D numerical techniques. In cases where reduced computational cost is needed, a lubrication approximation within the fracture and reduce the dimensionality of the numerical solution to 2-D may be performed. See, e.g., Pyrak-Nolte (2000) and Section 3.4.3 above.

The pressures $p_{ij}$ in the Cartesian grid (FIG. 23) are cell-centered and indexed using i and j such that:

$$p\left(x=\left[i+\frac{1}{2}\right]\Delta x,\ y\left[j+\frac{1}{2}\right]\Delta y\right)=p_{ij} \tag{98}$$

The right-going and up-going volumetric fluxes (units of volume per unit time) from cell i, j are defined on the faces of the cells (see FIG. 23) and are denoted by $q_{ij}^x$ and $q_{ij}^y$ respectively.

A solution for the pore pressure field can be obtained by requiring conservation of fluid mass within the fracture while flow is induced between an inlet and outlet pressure boundary condition. The total volumetric flux entering cell i, j can be written $$Q_{ij}=q_{i-1j}^x-q_{ij-x}+q_{ij-1}^y-q_{ij}^y \tag{99}$$

The fluxes may be obtained by using local conductivities to relate the pressure drop to the induced flux:

$$q_{ij}^x=c_{ij}^x(p_{ij}-p_{i+1j}) \tag{100}$$

$$q_{ij}^y=c_{ij}^y(p_{ij}-p_{ij+1}) \tag{101}$$

where the conductivities, $c^x_{ij}$ and $c^y_{ij}$ depend upon what occupies the cell in question. In the event that the cell is within an open channel, the conductivity is taken to be an approximation for flow between two plates. If the cell is within a proppant pillar, it is treated as a porous medium, and the conductivity is calculated using Darcy' s law. If the pillar represents solid rock, the cell is ascribed an arbitrarily low permeability. See, e.g., Morris (2014). The conductivities use averages of the apertures of the cells linked by that face as follows:

$$w_{ij}^x=\frac{2w_{ij}w_{i+1j}}{w_{ij}+w_{i+1j}} \tag{102}$$

$$w_{ij}^y=\frac{2w_{ij}w_{ij+1}}{w_{ij}+w_{ij+1}} \tag{103}$$

The conductivity in open cells is given by the following cubic law:

$$c_{ij}^x=\Delta y\frac{(w_{ij}^x)^3}{12\mu}\frac{1}{\Delta x} \tag{104}$$

$$c_{ij}^y=\Delta x\frac{(w_{ij}^y)^3}{12\mu}\frac{1}{\Delta y} \tag{105}$$

Similarly, for cells within pillars, an average permeability to use between the two cells is provided as follows:

$$k_{ij}^x=\frac{2k_{ij}k_{i+1j}}{k_{ij}+k_{i+1j}} \tag{106}$$

-continued $$k_{ij}^y=\frac{2k_{ij}k_{ij+1}}{k_{ij}+k_{ij+1}} \tag{107}$$

and the conductivity is calculated using Darcy's law for the packed material as follows:

$$c_{ij}^x=\Delta y w_{ij}^x\frac{k_{ij}^x}{\mu}\frac{1}{\Delta x} \tag{108}$$

$$c_{ij}^y=\Delta x w_{ij}^y\frac{k_{ij}^y}{\mu}\frac{1}{\Delta y} \tag{109}$$

For each non-boundary condition cell, an equation for the pressure field by requiring mass conservation may be obtained:

$$Q_{ij}=0 \tag{110}$$

substituting the cell face fluxes provides the following:

$$q_{i-1j}^x-q_{ij}^x+q_{ij-1}y-q_{ij=0}^y \tag{111}$$

and expressing the fluxes in terms of face conductivities and pressure drops provides the following:

$$c_{i-1j}^x(p_{i-1j}-p_{ij})-c_{ij}^x(p_{ij}-p_{P+1j})+c_{ij-1}^y(p_{ij-1}-p_{ij})-c_{ij}^y(p_{ij}-p_{ij+1})=0 \tag{112}$$

the discrete equation for flux conservation for cell i, j may be obtained as follows:

$$c_{i-1j}^x p_{i-1j}+c_{ij}^x p_{i+1j}+c_{ij-1}^y p_{ij-1}+c_{ij}^y p_{ij+1}-(c_{i-1j}^x+c_{ij}^x+c_{ij-1}^y+c_{ij}^y)p_{ij}=0 \tag{113}$$

For estimating the x-conductivity the system is subject to the following boundary conditions:

$$p_{0j}=\Delta p,\forall j \tag{114}$$

$$p_{nx-1j}=0,\forall j \tag{115}$$

while for estimating the y-conductivity the system is subject to the boundary conditions:

$$p_{i0}=\Delta p,\forall i \tag{116}$$

$$p_{iny-1}=0,\forall i \tag{117}$$

The boundary conditions (either Equations (114,115) or Equations (116,117)) are substituted into the system of Equations (113) and assembled into a linear system:

$$Ax=b \tag{118}$$

before passing the system to a linear solver. A direct sparse solver to obtain the pressure field is utilized.

Once the pressures, $p_{ij}$ have been obtained, the face fluxes can be calculated from (100,101) and then the total inlet and outlet fluxes can be calculated. From these total fluxes, fracture conductivity can be inferred.

V. Validation

Validation (verification) may be determined 269 as described with respect to FIGS. 2-6. Validation may also be performed using the methods described in Sections III and IV. Validation 269 may be performed to verify the fracture conductivity determined 266. Validation may also be performed to verify the methods used during simulation. Examples of validations are provided.

5.1 Conductivity Validation

Validation 269 may be performed to verify the fracture conductivity determined 266. Two verification problems involving flow within an open, unpropped fracture and flow through a uniformly propped fracture are considered. The fracture may be meshed with approximately square elements. In order to test the implementation of the equations for Δx 6=Δy and $L_x$ 6=$L_y$, a fracture discretization with the properties listed in Table 2 below which involves high aspect ratio domain and an atypically high aspect ratio computational elements is considered.

TABLE 2

| Property | Value |
|---|---|
| $L_x$ | 30 m |
| $L_y$ | 70 m |
| $n_x$ | 65 |
| $n_y$ | 760 |
| Δx | 0.462 m |
| Δy | 0.0921 m |
| w | 5 mm |
| Δp | 1 Pa |

Table 3 provides geometrical properties of the fracture used to verify model implementation for flow through an open fracture and flow through a homogeneously propped fracture. The aspect ratio of the elements was intentionally chosen to be unrealistically high to test the robustness of the implementation.

5.1.1 Example

Conductivity—Flow Through an Open Channel

The flux between two plates is given by the following cubic law:

$$Q = W\frac{w^3}{12\mu}\frac{\Delta p}{L} \tag{119}$$

where L and W are the lengths of the fracture in the direction parallel and perpendicular to flow, respectively, w is the gap between the plates, Δp is the pressure drop in the flow direction and μ is the fluid viscosity. When the model of FIG. 20 is used to calculate the conductivity of an open fracture discretized according to Table 2, a comparison with the analytic results obtained using Equation (119), as reported in Table 3 below is obtained:

TABLE 3

| | Numerical ($m^3/s$) | Analytic ($m^3/s$) | Rel. Error |
|---|---|---|---|
| Qx | $2.46845 \times 10^{-5}$ | $2.46853 \times 10^{-5}$ | −0.003% |
| Qy | $4.46999 \times 10^{-6}$ | $4.47017 \times 10^{-6}$ | −0.004% |

Table 4 provides a comparison between the analytic solution for flow between two plates using the discretization described in Table 3. Less than 0.01% error between the code and the analytic solution is observed, suggesting that the implementation is accurate for both non-square domains and non-square flow elements.

5.1.2 Example

Conductivity—Flow Through a Channel Filled With Permeable Material

Neglecting edge effects, the flux through a rectangular cuboid permeable medium sandwiched between two plates is given by:

$$Q = Ww\frac{k}{\mu}\frac{\Delta p}{L} \tag{120}$$

where L and W are the lengths of the fracture in the direction parallel and perpendicular to flow, respectively, w is the gap between the plates, Δp is the pressure drop in the flow direction, μ is the fluid viscosity and k is the permeability of the porous medium.

In similar fashion to the previous section, flow through the same fracture geometry (Table 3) is considered. This time the flow contains 300 D permeability material (e.g., packed sand used to prop hydraulic fractures). Because the problem is linear, any finite choice of permeability is suitable for the purpose of verifying the equations.

Table 4 below indicates that the results agree to 6 significant figures, suggesting the implementation of flow through a porous pack even for high aspect ratio elements and computational domains:

TABLE 4

| | Numerical ($m^3/s$) | Analytic ($m^3/s$) | Rel. Error |
|---|---|---|---|
| Qx | $3.5082 \times 10^{-9}$ | $3.5082 \times 10^{-9}$ | <0.003% |
| Qy | $6.35287 \times 10^{-10}$ | $6.35287 \times 10^{-6}$ | <0.003% |

Table 4 provides a comparison between code and analytic solution for flow between two plates propped homogeneously with 300 D permeable material (e.g., proppant) using the discretization described in Table 3.

5.1.3 Example

Conductivity—Convergence for a Heterogeneously Packed Fracture

Application of the method to a heterogeneous arrangement of proppant within a fracture may be tested. How many cells are needed across each pillar in order to make a sufficiently accurate prediction of the fracture conductivity may be established. To test this, the pillar arrangements shown in FIGS. 24.1 and 24.2 were discretized with increasing numbers of flow cells, $n_a$, spanning the radius a=1 m of the pillars.

FIG. 24.1 is a schematic diagram depicting a fracture 2412.1 showing the heterogeneous proppant 2414.1 arrangement considered for flow convergence study. FIG. 24.2 is a schematic diagram depicting a Cartesian grid 2412.2 which shows the discretization corresponding to $n_a$=4, where 4 cells are used through the radius of each pillar 3414.2. Table 5 below compares the predicted conductivity for a range of discretizations of the fracture.

TABLE 5

| $n_a$ | Δx (m) | Conductivity (D · m) | Change vs $n_a$ = 128 |
|---|---|---|---|
| 4 | 0.25 | 2713 | −4.8% |
| 8 | 0.125 | 2740 | −3.9% |
| 16 | 0.0625 | 2808 | −1.5% |
| 32 | 0.003125 | 2832 | −0.67% |
| 64 | 0.015625 | 2844 | −0.25% |
| 128 | 0.0078125 | 2851 | 0.00% |

Table 5 provides results of convergence study for flow calculation with increasing numbers of elements spanning the radius a=1 m of the pillars shown in FIGS. 24.1 and 24.2.

Even for relatively coarse grids (e.g.: $n_a$=4, as depicted at right in FIG. 24.2), conductivity predictions that are within 5% of the highest resolution considered ($n_a$=128) are achieved. Thus, $n_a$=4 is now assumed.

5.2 Validation of Models by Comparison

Validations 269 may be performed to compare various methods used herein. Such validations may involve a comparison of one or more of the simulations and/or results provided herein.

5.2.1 Example

Model Comparison for Linear Geomechanical Deformation

Simulation using the analytical method may be compared against a more detailed "asperity" model that has itself been verified against numerous analytic solutions. See, e.g., Morris (2014) and Pyrak-Nolte (2000).

Higher fidelity methods may assume that features within the fracture are represented by a regular grid of "asperities" of identical radius, having different height and mechanical properties. This allows the asperity model to discretize complicated shapes. The faster model allows for circular pillars of different radii and arbitrary location. To assist in direct comparison between the codes, different numbers of pillars arranged upon a regular grid with grid spacing of 0.5 m within a fracture spanning 5 m on a side with the properties in Table 6 below may be considered:

TABLE 6

| | |
|---|---|
| E | 30.0e9 |
| ν | 0.25 |
| β | 1.079823 |
| $L_x$ | 5.0 |
| $L_y$ | 5.0 |
| $M_I$ | 300 MPa |

Table 6 provides mechanical and geometrical properties of the fracture used for the first, second, and third verification problems below.

The choice of β may be made to match that assumed internally by the asperity model. The asperity model mesh used the grid size of 0.5 m, while our fast-running model used a pillar radius of 0.282095 m to obtain pillars with the same area as the 0.5 m by 0.5 m asperities.

Table 7 below depicts relative error between an asperity model and the method provided herein for three verification problems 1-3.

TABLE 7

| Problem | Average error | Max error |
|---|---|---|
| 1 | 0.12% | 1.5% |
| 2 | 0.80% | 3.6% |
| 3 | 0.25% | 1.5% |

The asperity model uses a more precise functional form for the deformation rather than the far-field approximation. Consequently, the greatest errors are at points close to the pillar. Table 7 reports the relative error between the simulations indicating that on average less than 0.1% error is obtained, and indicates that the maximum error is 1.5%.

The first verification problem considered a single pillar located at x=1.25, y=3.75 with initial height of 5 mm, subjected to a closure stress of 0.75 MPa. The asperity model is shown in FIG. 25.1 along with the comparison between the two approaches as shown in FIG. 25.2.

FIG. 25.1 is a graph 2500.1 having dimensions y(m) (y-axis) versus x(m) (x-axis) and depicting an asperity-based point 2516 of contact for the first verification problem. FIG. 25.2 is a graph 2500.2 depicting aperture (mm) (y-axis) versus x(m) (x-axis). Graph 2500.2 is a comparison between the asperity model (RapidSHAC) and a nonlinear extension model using the methods herein for several different line outs (SHAC at y=1.75, 3.25, and 3.75) within the domain.

Agreement between the compared models is about exact at the center of the pillar and similar away from the pillar. However, the asperity model uses a more precise functional form for the deformation rather than only the far-field approximation. Consequently, greater errors are at points close to the pillar. As indicated in Table 8 below, relative error exists between the two methods, and an average less than 0:1% error and a maximum error of 1:5% is obtained.

The second verification problem considered three pillars of 5 mm height located at (x; y)=(1:25; 3:75), (3:25; 3:25), and (2:75; 1:75) subjected 3 MPa closure stress. The asperity model is shown in FIG. 26.1 along with the comparison between the two models as shown in FIG. 26.2.

FIG. 26.1 is a graph 2600.1 having dimensions y(m) (y-axis) versus x(m) (x-axis) and depicting an asperity points 2616 of contact for the second verification problem. FIG. 26.2 is a graph 2600.2 depicting aperture (mm) (y-axis) versus x(m) (x-axis). Graph 3600.2 is a comparison between the asperity model (RapidSHAC) and the nonlinear extension model herein for several different line outs (SHAC at y=1.75, 3.25, and 3.75) within the domain. Once again, agreement between the two is about exact at the center of the pillar and similar away from the pillar, with largest discrepancies in the near-pillar regions.

A third verification problem considers the same three pillars with varied their heights to further test the nonlinear extension model. The pillars located at (x,y)=(1.25,3.75), (3.25,3.25), and (2.75,1.75) were given heights of 4 mm, 5 mm, and 5.5 mm, respectively, and were subjected 2 MPa closure stress.

The asperity computational model is shown in FIGS. 27.1 and 27.2 along with the comparison between the two models. FIG. 27.1 is a graph 2700.1 having y(m) (y-axis) versus x(m) (x-axis) depicting a comparison between high-resolution asperity simulations having average aperture of 2.07 mm and conductivity of 58.3 D·m.

FIG. 27.2 is a graph 2700.2 having y(m) (y-axis) versus x(m) (x-axis) depicting the nonlinear extension model predictions of aperture distribution having an average aperture of 1.97 mm and conductivity of 25.9 D·m) within a fracture with non-trivial pillar geometries. The graphs 2700.1, 2700.2 indicate agreement between the two predictions of aperture change within the channel regions.

Once again, agreement between the two is about exact at the center of the pillar and similar away from the pillar, with largest discrepancies in the near-pillar regions.

In summary, the nonlinear extension model shows agreement with the asperity model for the expected portions of the domain and elsewhere the discrepancies are within several percent relative error.

5.2.2 Example

Model Comparison for Complex Pillar Geometry

The asperity-based approach represents the proppant using a Cartesian grid for both flow and conductivity. See, e.g., Pyrak-Nolte (2000). In this section, the nonlinear extension method using cylinders for geomechanics and grid for flow is compared against a finely meshed asperity simulation for more general pillar geometries. The results of the comparison shown in FIG. 28 indicate the two methods are in agreement.

FIG. 28 is a graph 2800 depicting a comparison between the two models of FIGS. 27.1 and 27.2. FIG. 28 depicts a comparison between the asperity model and the nonlinear extension model for several different line outs within the domain for verification problem 3.

Tables 8 and 9 below show simulation parameters, including mechanical and geometrical properties of the fracture, used for general pillar geometry verification problem (Section 5.2.1 above).

TABLE 8

| | |
|---|---|
| E | 30.0e9 |
| ν | 0.25 |
| β | 1.0 |
| $L_x$ | 40.0 |
| $L_y$ | 40.0 |
| $M_I$ | 300 MPa |
| $\sigma_n$ | 2.5 MPa |

TABLE 9

| | Aperture (mm) | Conductivity (D · m) |
|---|---|---|
| Asperity model | 1.1 | 19 |
| Nonlinear extension model without pinch-points | 0.71 | 0.0012 |
| Nonlinear extension model with pinch-points | 0.90 | 4.6 |

The asperity simulation predicted a final average aperture of 2.07 mm, versus our model prediction of 1.97 mm. In addition, the asperity simulation predicted a conductivity of 58.3 D·m in contrast with the new fast-running prediction of 25.9 D·m.

In summary, the average aperture is accurate to within approximately 5% while the conductivity agrees to within about a factor of 2. The conductivity calculation is sensitive to slight changes in aperture or geometry, indicating that agreement acceptable.

5.2.3 Example

Model Comparison for a Nonlinear Problem Involving Pinch-Points

Pinch-point mechanics may be accommodated via fine discretization of the fracture surfaces and contact detection. See, Pyrak-Nolte (2000). The change in aperture predicted by the nonlinear extension approach with and without pinch-points is compared with the asperity-based approach in FIGS. 29.1-29.3 for two pillars subjected to stress sufficient to partially close the channels between.

FIGS. 29.1-29.3 are graphs 2900.1-2900.3 having y(m) (y-axis) versus x(m) (x-axis) depicting a comparison between high-resolution asperity simulation having average aperture of 2.07 mm and conductivity of 58.3 D·m. FIG. 29.1 shows a high-resolution asperity-based simulation (1.1 mm average aperture and 19 D·m conductivity), FIG. 29.2 shows a nonlinear extension model without pinch-points (0.71 mm average aperture and 0.0012 D·m conductivity), and FIG. 29.3 shows a nonlinear extension model with pinch-points (0.9 mm average aperture and 4.6 D·m conductivity). These models as shown in Graphs 2900.1-.3 indicate agreement between the predictions of aperture and conductivity, provided pinch-point mechanics are included in the calculation.

Table 10 shows simulation parameters including mechanical and geometrical properties of the fracture used for a pinch-point verification problem.

TABLE 10

| | |
|---|---|
| E | 30.0e9 |
| ν | 0.25 |
| β | 1.0 |
| $L_x$ | 10.0 |
| $L_y$ | 10.0 |
| $M_I$ | 300 MPa |
| $\sigma_n$ | 6 MPa |

Table 10 shows the numerical results of the calculations. In this example, neglecting pinch-points led to a 5 order reduction in the predicted conductivity compared with the asperity-based approach. Table 11 provides a comparison between the asperity model and the nonlinear extension model developed for the pinch-point test.

TABLE 11

| | |
|---|---|
| E | 30 GPa |
| ν | 0.25 |
| β | 1.0 |
| Lx | 100.0 m |
| Ly | 30.0 m |
| aI | 2.0 m |
| lI | 5 mm |
| MI | 230 MPa |
| pillar spacing | 3.0 m |
| σn | 1 MPa |

By including pinch-points within approximately a factor of 4 of the asperity-based prediction, the conductivity calculation may be sensitive to slight changes in aperture or geometry. Consequently, this level of difference may be deemed acceptable.

5.3 Performance Comparison

Efficiency of the various models may be compared. To facilitate the application of the method to large numbers of fractures, code used in the various simulations may be parallelized via multithreading, such as OpenMP multithreading. The model may be applied to many (potentially hundreds) of separate fractures containing tens or hundreds of pillars/channels. The calculations for each fracture may be treated separately and implemented in a thread-safe manner.

5.3.1 Example

Deformation Calculation Performance

Asperity methods may consider entirely arbitrary combinations of pillar geometry with fracture roughness and detailed additional points of contact under stress. See, e.g., Pyrak-Nolte (2000) and Morris (2014). Ten or more asperity elements may be used across a single pillar or channel to capture the mechanical deformation. Models may use more limited internal discretization of the pillars, and may be more efficient than the asperity-based approach for the case of circular pillars.

The performance of the deformation calculation using the nonlinear extension model of the present disclosure may be compared with an asperity model (see, e.g., Morris (2014)) for a single fracture containing 330 circular pillars. Both models may be run single-threaded to simplify the performance comparison on a 2.4 GHz core. The execution time required by the asperity model is shown in Table 12 below:

TABLE 12

| | Asperity model | | | Nonlinear extension model | |
|---|---|---|---|---|---|
| Δx | number of elements | CPU time | (time/elements)$^2$ | number of elements | CPU time |
| 1.0 m | 3000 | 2.9 s | 2.2e−07 | 330 | ~0.1 s |
| 0.5 m | 12000 | 46.2 s | 3.2e−07 | 330 | ~0.1 s |
| 0.2 m | 75000 | 2596 s | 4.6e−07 | 330 | ~0.1 s |

Table 12 provides execution times for solution of a fracture containing 330 pillars with an asperity model with increasing resolution. In contrast, for a comparable problem, the fast running model presented in this work took approximately 0.1 s to execute.

For the resolution of 10 elements across a pillar, the asperity model takes over 40 minutes. The cost of the asperity calculation is roughly proportional to the square of the number of elements. For a comparable problem involving 330 pillars, the nonlinear extension method takes approximately 0.1 s.

5.3.2 Example

Combined Deformation And Conductivity Calculation Performance

In an example, the nonlinear extension model in single-threaded mode was used to simulate the three HPP geometries shown in FIGS. 30.1-30.3. These figures provide graphs 3000.1-3000.3 containing 100, 400 and 900 pillars, respectively, within a single fracture. FIGS. 30.1-30.3 depict heterogeneous proppant pillar arrangements considered by the code performance study.

The resultant execution times are reported in Table 13 as follows:

TABLE 13

| NPillars | Execution time |
|---|---|
| 100 | 0.1 sec |
| 400 | 1.1 sec |
| 900 | 7.8 sec |

Table 13 describes multithreading performance for a problem with 64 fractures with 400 pillars each (25,600 pillars total). $N_{Threads}$ is the number of threads and $T_{Wall}$ is the so called "wall time" taken.

For ideal parallelization, the wall time is inversely proportional to the number of threads. Consequently, the product, $N_{Threads}T_{Wall}$, would ideally be constant. The results indicate scaling with a 36% loss in efficiency versus single threaded as the number of threads is increased from 1 to 8 for this specific problem. Table 14 shows a single threaded performance of the nonlinear extension model for increasing numbers of pillars within a fracture on 2.4 GHz core. The execution time on a 2.4 GHz core is a matter of seconds.

To investigate multithreaded performance, a problem including 64 fractures containing 400 pillars each was considered using 1, 2, 4 and 8 threads running on 2.4 GHz cores. Table 14 below reports the time of execution achieved by assigning each thread an equal number of fractures to calculate.

TABLE 14

| NThreads | TWall | NThreadsTWall | Efficiency loss |
|---|---|---|---|
| 1 | 72.7 sec | 72.7 sec | — |
| 2 | 38.1 sec | 76.2 sec | 4.8% |
| 4 | 21.9 sec | 87.6 sec | 20% |
| 8 | 12.4 sec | 99.2 sec | 36% |

These results reflect scaling with a loss of approximately ⅓ in efficiency scaled from 1 to 8 threads.

The preceding description has been presented with reference to some embodiments. Persons skilled in the art and technology to which this disclosure pertains will appreciate that alterations and changes in the described structures and methods of operation can be practiced without meaningfully departing from the principle, and scope of this application. For example, while the system and method presented herein were described with specific reference to a fracturing operation, it will be appreciated that the system and method may likewise apply to other reservoir stimulation operations, such as acidizing. Moreover, while only a limited number of realizations were used as examples, it should be understood that any number of realizations may be performed and assessed. Accordingly, the foregoing description should not be read as pertaining only to the precise structures and workflows described and shown in the accompanying drawings, but rather should be read as consistent with and as support for the following claims, which are to have their fullest and fairest scope.

In the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In this detailed description, each numerical value should be read once as modified by the term "about" (unless already expressly so modified), and then read again as not so modified unless otherwise indicated in context. Also, in this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

The statements made herein merely provide information related to the present disclosure and may not constitute prior art, and may describe some embodiments illustrating the invention.

Although only a few example embodiments have been described in detail above, those skilled in the art will readily appreciate that many modifications are possible in the example embodiments without materially departing from the system and method for performing wellbore stimulation operations. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method for performing a stimulation operation at a wellsite, the wellsite having a wellbore penetrating a formation having fractures therein, the method comprising:

predicting placement of proppant in the fractures based on wellsite data, the wellsite data comprising geometry of the fractures;

generating an asperity model based on the predicted placement;

predicting aperture change for a prescribed closure stress using the asperity model;

determining fracture conductivity based on the predicted aperture change; and placing proppant into the fractures with a stimulation fluid by injecting the stimulation fluid having the proppant therein into the formation based on the determined fracture conductivity.

2. The method of claim 1, further comprising collecting the wellsite data from the wellsite.

3. The method of claim 1, further comprising producing fluid from the formation through the fractures.

4. The method of claim 1, wherein the predicting placement comprises:

providing fracture aperture distribution and a pumping schedule;

determining Lagrangian markers projecting the Lagrangian markers onto a flow grid; and determining network conductivity and flow field based on flow between parallel plates.

5. The method of claim 4, further comprising repeating the predicting placement until pumping is complete.

6. The method of claim 4, wherein the Lagrangian markers are one of injection, advection and combinations thereof.

7. The method of claim 1, wherein the generating the asperity model comprises:

determining fracture aperture distribution based on the wellsite data;

determining proppant spatial distribution based on the predicted placement;

generating material mixing based on the determined fracture aperture and the determined proppant spatial distribution; and generating an asperity representation of a combination of fracture roughness and proppant based on the material mixing.

8. The method of claim 1, wherein the predicting of aperture change comprises:

pre-determining asperity based on asperity influence tables;

adjusting far-field displacement based on the pre-calculated asperity;

generating asperity and half-space deformation interaction using the asperity tables and based on the adjusted far-field displacement;

determining if asperity is within tolerance of a target stress state; and determining aperture distribution from the determined asperity and half-space deformation.

9. The method of claim 8, further comprising adding new contacts and repeating the generating with the additional contacts.

10. The method of claim 1, wherein the predicting aperture change comprises:

predetermining asperity to asperity influence tables;

adjusting far-field displacement to approach a requested stress state;

generating asperity and half-space deformation interaction based on the asperity to asperity influence tables;

adding new contacts;

determining if fracture is within tolerance of a target stress; and determining aperture distribution from the determined asperity and half space deformation.

11. The method of claim 1, wherein the predicting aperture change comprises:

approximating an asperity grid with coarse cylinders;

determining cylinder and half-space deformation consistent with applied stress;

adding pinch points; and projecting aperture change due to cylinders back onto the asperity grid.

12. The method of claim 1, wherein the predicting aperture change comprises:

converting a geometry of the fractures into cylindrical pillars; and determining deformation of the fractures.

13. The method of claim 12, wherein the determining deformation of the fractures comprises:

generating deformation based on the cylindrical pillars;

linearizing portions of deformation of the cylindrical pillars;

assembling a linear system of responses of the cylindrical pillars; and solving the linearized system of responses.

14. The method of claim 1, wherein the determining fracture conductivity comprises:

identifying proppant filled and non-contacting asperities;

converting the identified proppant filled and non-contacting asperities into a flow network; and obtaining fracture conductivity by solving flow network at a current stress level.

15. The method of claim 1, further comprising adding pinch-points and repeating the determining fracture conductivity for each pinch-point.

16. The method of claim 1, further comprising validating the determined fracture conductivity.

17. The method of claim 16, wherein the validating comprises performing the predicting placement using multiple simulations and comparing the multiple simulations.

18. A method for performing a stimulation operation at a wellsite, the wellsite having a wellbore penetrating a formation having fractures therein, the method comprising:

determining proppant parameters of the fractures by:

predicting placement of proppant in the fractures based on wellsite data using a plurality of simulations, the wellsite data comprising geometry of the fractures;

generating an asperity model based on the predicted placement;

predicting aperture change for a prescribed closure stress using the asperity model;

determining fracture conductivity based on the predicted aperture change;

validating the predicted placement by comparing the plurality of simulations; and placing proppant into the fractures with a stimulation fluid by injecting the stimulation fluid having the proppant therein into the formation based on the determined fracture conductivity.

19. The method of claim 18, wherein the plurality of simulations comprises at least one of an analytical solution, a power-law solution, a Bingham fluids solution, and combinations thereof.

20. The method of claim 18, wherein the validating comprises tracking an interface between multiple phases within the fractures.

21. The method of claim 18, wherein the plurality of simulations comprise a plurality of a 1-D, a 2-D, and a 3-D simulation, and combinations thereof.

22. The method of claim 18, wherein the plurality of simulations comprises a 2-D simulation, the determining further comprising extending the 2-D model for a Newtonian fluid.

23. The method of claim 18, wherein the validating involves using a nonlinear extension model involving solving a geomechanical deformation on a coarse grid and wherein the determining fracture conductivity is performed using a refined discretization.

24. A method for stimulating a wellbore at a wellsite, the wellsite having a wellbore penetrating a formation having fractures therein, the method comprising:

determining proppant parameters of the fractures by:

predicting placement of proppant in the fractures based on wellsite data, the wellsite data comprising geometry of the fractures;

generating an asperity model based on the predicted placement;

predicting aperture change for a prescribed closure stress using the asperity model; and determining fracture conductivity based on the predicted aperture change; and placing proppant into the fractures with a stimulation fluid by injecting the stimulation fluid having the proppant therein into the formation based on the determined fracture conductivity; and producing fluid from the reservoirs and into the wellbore through the propped fractures.

* * * * *